US009311861B2

(12) United States Patent
Nose et al.

(10) Patent No.: US 9,311,861 B2
(45) Date of Patent: Apr. 12, 2016

(54) DISPLAY DEVICE IN WHICH FEATURE DATA ARE EXCHANGED BETWEEN DRIVERS

(71) Applicant: Synaptics Display Devices GK, Tokyo (JP)

(72) Inventors: Takashi Nose, Tokyo (JP); Hirobumi Furihata, Tokyo (JP); Akio Sugiyama, Tokyo (JP); Toshio Mizuno, Tokyo (JP)

(73) Assignee: Synaptics Display Devices GK, Tokyo (JP)

( * ) Notice: Subject to any disclaimer, the term of this patent is extended or adjusted under 35 U.S.C. 154(b) by 108 days.

(21) Appl. No.: 14/097,002

(22) Filed: Dec. 4, 2013

(65) Prior Publication Data

US 2014/0160176 A1 Jun. 12, 2014

(30) Foreign Application Priority Data

Dec. 10, 2012 (JP) ..... 2012-269721

(51) Int. Cl.
*G09G 3/34* (2006.01)
*G09G 3/36* (2006.01)

(52) U.S. Cl.
CPC ..... *G09G 3/3406* (2013.01); *G09G 3/3685* (2013.01); *G09G 2320/064* (2013.01); *G09G 2320/0646* (2013.01); *G09G 2360/16* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,973,973 | B2 | 7/2011 | Nose et al. | |
| 2005/0122287 | A1* | 6/2005 | Nishitani et al. | 345/63 |
| 2006/0061842 | A1* | 3/2006 | Oka et al. | 358/522 |
| 2006/0221259 | A1* | 10/2006 | Miyazawa et al. | 348/790 |
| 2006/0284899 | A1* | 12/2006 | Kimura | 345/690 |
| 2007/0268524 | A1 | 11/2007 | Nose et al. | |

FOREIGN PATENT DOCUMENTS

| | | | |
|---|---|---|---|
| JP | 07-281633 | A | 10/1995 |
| JP | 4198720 | B2 | 12/2008 |
| JP | 2010-113052 | A | 5/2010 |

* cited by examiner

*Primary Examiner* — Van Chow
(74) *Attorney, Agent, or Firm* — McGinn IP Law Group, PLLC

(57) ABSTRACT

A display device includes a display panel including a display region and first and second drivers. Feature data indicating feature values of first and second images displayed on first and second portions of the display region are exchanged between the first and second drivers, and the first and second drivers drive the first and second portions of the display region in response to the feature data.

20 Claims, 25 Drawing Sheets

DISPLAY DEVICE IN WHICH FEATURE DATA ARE EXCHANGED BETWEEN DRIVERS

CROSS REFERENCE

This application claims priority of Japanese Patent Application No. Japanese Patent Application No. 2012-269721, filed on Dec. 10, 2012, the disclosure which is incorporated herein by reference.

TECHNICAL FIELD

The present invention relates to a display device, a display panel driver, and an operating method of a display device, in particular, to a panel display device configured to drive a display panel by using a plurality of display panel drivers, and a display panel driver and the operating method which are applied to the display device.

BACKGROUND ART

The recent increase in the panel size and resolution of LCD (liquid crystal display) panels has caused a problem of the increase in the power consumption. One approach for suppressing the power consumption is to decrease the brightness of the backlight. However, the decrease in the brightness of the backlight undesirably causes a problem that the display quality is deteriorated due to the insufficient contrast for images with reduced brightness.

One approach for reducing the brightness of the backlight without deterioration of the display quality is to perform a correction calculation such as the gamma correction on input image data for emphasizing the contrast. In this operation, controlling the brightness of the backlight together with performing the correction calculation allows further suppressing the deterioration in the image quality.

In view of such background, the inventors have proposed a technique in which a correction calculation based on a calculation expression is performed on input image data (for example, Japanese Patent Gazette No. 4,198,720 B). In this technique, the correction calculation is performed using a calculation expression in which the input image data are defined as a variable and coefficients are determined on the basis of correction point data. Here, the correction point data define a relation of the input image data to corrected image data (output image data); the correction point data are determined depending on the APL (average picture level) of the image to be displayed or the histogram of the grayscale levels of respective pixels in the image.

Also, Japanese Patent Application Publication No. H07-281633 A discloses a technique for controlling the contrast by determining a gamma value on the basis of the APL of the image to be displayed and the variance (or standard deviation) of the brightnesses of pixels and performing a gamma correction by using the determined gamma value.

Moreover, Japanese Patent Application Publication No. 2010-113052 A discloses a technique for decreasing the power consumption with reduced deterioration of the image quality, in which an extension process (that is, a process of multiplying the grayscale levels by $\beta$(where $1 < \beta < 2$)) is performed on display data while the backlight brightness is reduced. The extension process disclosed in this patent document is a sort of correction calculation performed on the input image data.

Although the above-described correction calculation is effective for improving the image quality, these patent documents are silent on a problem which may occur in the case that a technique of performing a correction calculation on input image data is applied to a display device which incorporates a plurality of display panel drivers to drive the display panel (for example, display devices applied to mobile terminals which include a large display panel, such as tablets). According to a study of the inventors, a problem related to the necessary data transmission rate and cost may occur, when the technique for performing a correction calculation on the input image data is applied to a display device which includes a plurality of display panel drivers to drive a display panel.

SUMMARY OF THE INVENTION

Therefore, an objective of the present invention is to provide a display device which incorporates a plurality of drivers to drive a display panel, in which an appropriate correction calculation is performed on input image data with a reduced data transmission rate and cost.

In an aspect of the present invention, a display device includes a display panel, a plurality of drivers driving the display panel and a processor. The drivers include: a first driver driving a first portion of a display region of the display panel; and a second driver driving a second portion of the display region. The processor supplies first input image data associated with a first image displayed on the first portion of the display region and supplies second input image data associated with a second image displayed on the second portion of the display region. The first driver is configured to calculate first feature data indicating a feature value of the first image from the first input image data. The second driver is configured to calculate second feature data indicating a feature value of the second image from the second input image data. The first driver is configured to calculate first full-screen feature data indicating a feature value of an entire image displayed on the display region of the display panel, based on the first and second feature data, to generate first output image data by performing a correction calculation on the first input image data in response to the first full-screen feature data, and to drive the first portion of the display region in response to the first output image data. The second driver is configured to generate second output image data by performing the same correction calculation as that performed in the first driver, on the second input image data and to drive the second portion of the display region in response to the second output image data.

In one embodiment, the first driver transmits the first feature data to the second driver. In this case, the second driver may be configured to calculate second full-screen feature data indicating the feature value of the entire image displayed on the display region of the display panel, based on the first feature data received from the first driver and second feature data, and to generate second output image data by performing the correction calculation on the second input image data in response to the second full-screen feature data.

In another aspect of the present invention, a display panel driver for driving a first portion of a display region of a display panel is provided. The display panel driver includes: a feature data calculation circuit receiving input image data associated with a first image displayed on the first portion of the display region and calculating first feature data indicating a feature value of the first image from the input image data; a communication circuit receiving from another driver second feature data indicating a feature value of a second image displayed on a second portion of the display region driven by the other driver; a full-screen feature data operation circuit calculating full-screen feature data indicating a feature value of an entire image displayed on the display region of the display panel, based on the first and second feature data; a correction circuit generating output image data by performing a correction calculation on the input image data in response to the full-screen feature data; and a drive circuitry driving the first portion of the display region in response to the output image data.

In still another aspect of the present invention, provided is an operation method of a display device including a display panel and a plurality of drivers driving the display panel, the plurality of drivers comprising a first driver driving a first portion of a display region of the display panel and a second driver driving a second portion of the display region. The operation method includes:

supplying first input image data associated with a first image displayed on the first portion of the display region to the first driver;

supplying second input image data associated with a second image displayed on the second portion of the display region to the second driver;

calculating first feature data indicating a feature value of the first image from the first input image data in the first driver;

calculating second feature data indicating a feature value of the second image from the second input image data in the second driver;

transmitting the second feature data from the second driver to the first driver;

calculating first full-screen feature data indicating a feature value of an entire image displayed on the display region of the display panel, based on the first and second feature data in the first driver;

generating first output image data by performing a correction calculation on the first input image data, based on first full-screen feature data in the first driver;

driving the first portion of the display region in response to the first output image data;

generating second output image data by performing the same correction calculation as that performed in the first driver on the second input image data in the second driver; and driving the second portion of the display region in response to the second output image data.

In one embodiment, the operation method may further include transmitting the first feature data from the first driver to the second driver. In this case, in generating the second output image data in the second driver, second full-screen feature data indicating the feature value of the entire image displayed on the display region of the display panel may be calculated based on the first and second feature data in the second driver, and the second output image data may be generated by performing the correction calculation on the second input image data in response to the second full-screen feature data.

DESCRIPTION OF PREFERRED EMBODIMENTS

A description is first given of a display device configured to perform a correction calculation on input image data, for easy understanding of the technical concept of the present invention.

Figure 1:
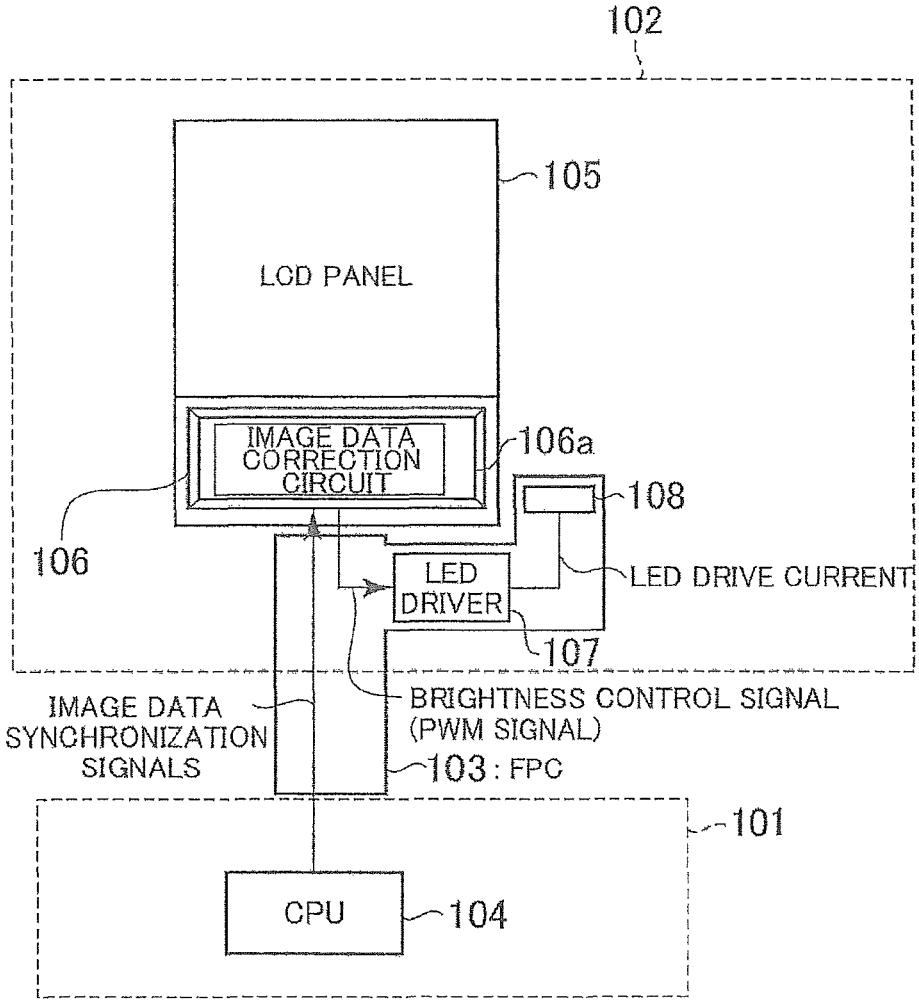
FIG. 1 is a block diagram illustrating an example of a liquid crystal display device configured to perform a correction calculation on input image data.

FIG. 1 is a block diagram illustrating an example of a display device configured to perform a correction calculation on input image data. The display device illustrated in FIG. 1 is configured as a liquid crystal display device and includes a main block 101, a liquid crystal display block 102 and an FPC (flexible printed circuit board) 103. The main block 101 includes a CPU (central processing unit) 104, and the liquid crystal display block 102 includes an LCD panel 105. A driver IC 106 is mounted on the LCD panel 105. The driver IC 106 includes image data correction circuit 106a for performing a correction calculation on image data. Also, the FPC 103 includes signal lines which connect the CPU 104 and the driver IC 106, and an LED (light emitting diode) driver 107 and an LED backlight 108 are mounted on the FPC 103.

The liquid crystal display device in FIG. 1 schematically operates as follows. The CPU 104 supplies image data and synchronization signals to the driver IC 106. The driver IC 106 drives data lines of the LCD panel 105 in response to the image data and the synchronization signals received from the CPU 104. In driving the LCD panel 105, the image data correction circuit 106*a* of the driver IC 106 performs a correction calculation on the image data, and the corrected image data are used to drive the LCD panel 105. Since the correction calculation for emphasizing the contrast (for example, a gamma correction) is performed on the input image data, the deterioration in the image quality is suppressed even if the brightness of the backlight is low. Moreover, the deterioration in the image quality can be further suppressed by controlling the brightness of the backlight depending on the feature value (for example, APL (average picture level)) of the image calculated in the correction calculation. In the configuration of FIG. 1, a brightness control signal generated on the basis of the feature value of the image which is calculated by the image data correction circuit 106*a* is supplied to the LED driver 107 to thereby control the brightness of the LED backlight 108.

Although FIG. 1 illustrates the liquid crystal display device in which the LCD panel 105 is driven by the single driver IC 106, portable terminals that include a relatively large liquid crystal display panel, such as tablets, often incorporate a plurality of driver ICs to drive the liquid crystal display panel. One issue of such a configuration is that the same correction calculation should be commonly performed with respect to the entire image displayed on the LCD panel 105 when the correction calculation is performed on the image data. For example, when different correction calculations are performed in the different driver ICs, an image is displayed on the LCD panel 105 with different contrasts by the driver ICs. This may result in that a boundary may be visually perceived between the adjacent portions of the LCD panel 105 driven by the different driver ICs.

Figure 2:
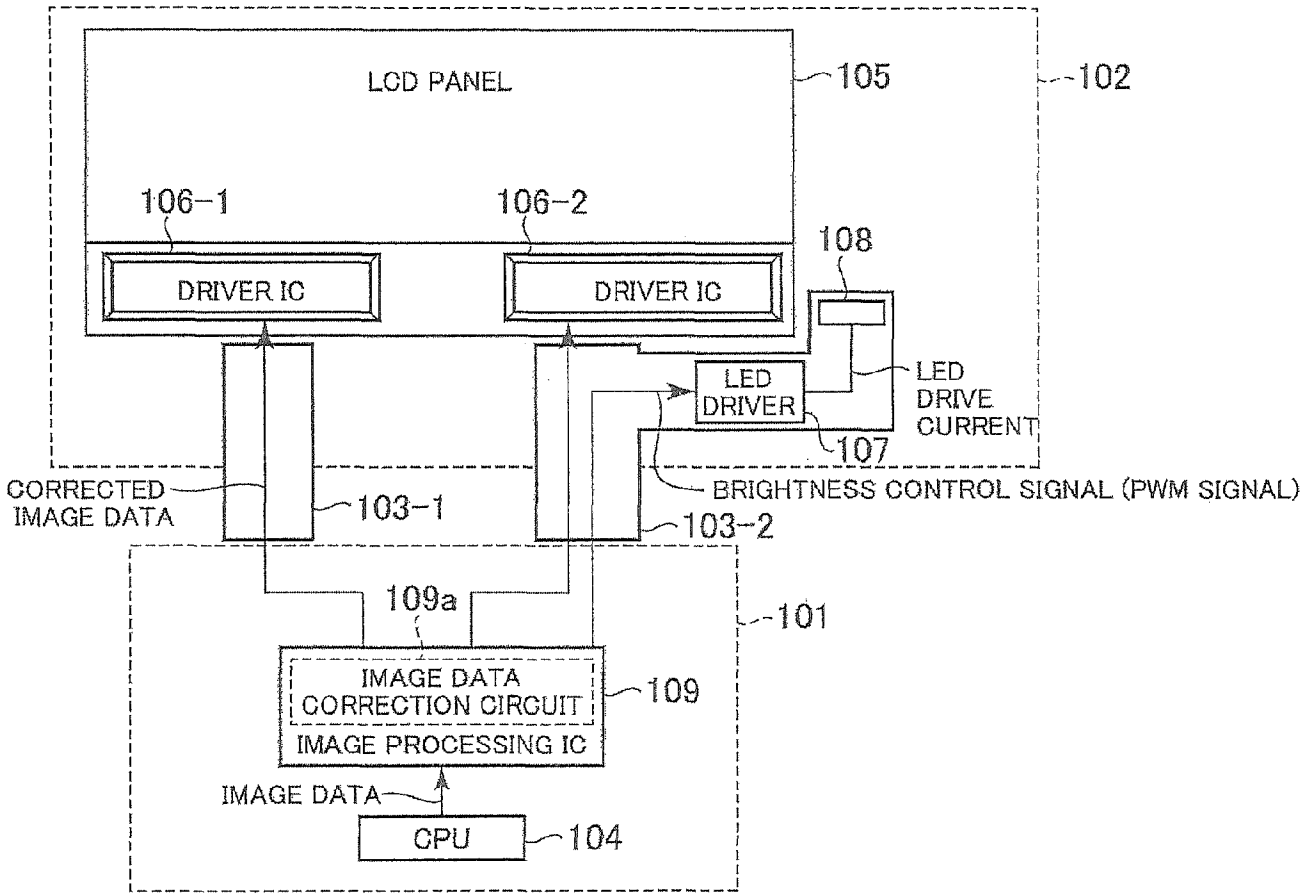
FIG. 2 is a block diagram illustrating an example of a liquid crystal display device which incorporates a plurality of driver ICs to drive a liquid crystal display panel and is configured to perform a correction calculation on input image data.

One approach of performing a common correction calculation with respect to the whole of the LCD panel 105, as shown in FIG. 2, may be to perform the correction calculation on image data on the transmitting side and transmit the corrected image data to the respective driver ICs. In the configuration in FIG. 2, an image processing IC 109 including an image data correction circuit 109*a* is provided in the main block 101. On the other hand, the two driver ICs 106-1 and 106-2 are mounted on the LCD panel 105. The image processing IC 109 is connected to the driver IC 106-1 via signal lines laid on the FPC 103-1 and further connected to the driver IC 106-2 via signal lines laid on the FPC 103-2. In addition, the LED driver 107 and the LED backlight 108 are mounted on the FPC 103-2.

The CPU 104 supplies image data to the image processing IC 109. The image processing IC 109 supplies the corrected image data, which are generated by correcting the image data by the image data correction circuit 109*a*, to the driver ICs 106-1 and 106-2. In this operation, the image data correction circuit 109*a* performs the same correction calculation with respect to the whole of the LCD panel 105. The driver ICs 106 drive the data lines and gate lines of the LCD panel 105 in response to the corrected image data received from the image processing IC 109. Furthermore, the image processing IC 109 generates a brightness control signal in response to the feature value of the image, which is calculated in the image data correction circuit 109*a*, and supplies the brightness control signal to the LED driver 107. Consequently, the brightness of the LED backlight 108 is controlled.

The configuration in FIG. 2, however, requires an additional IC (a picture processing IC) to perform the same correction calculation with respect to the whole of the LCD panel 105. This results in an increase in the number of ICs incorporated in the liquid crystal display device. This is disadvantageous in terms of the cost. In particular, in the case that a small number of driver ICs (for example, two driver ICs) are used to drive a LCD panel, the increase of the number of ICs by one causes a severe disadvantage in terms of the cost.

Figure 3:
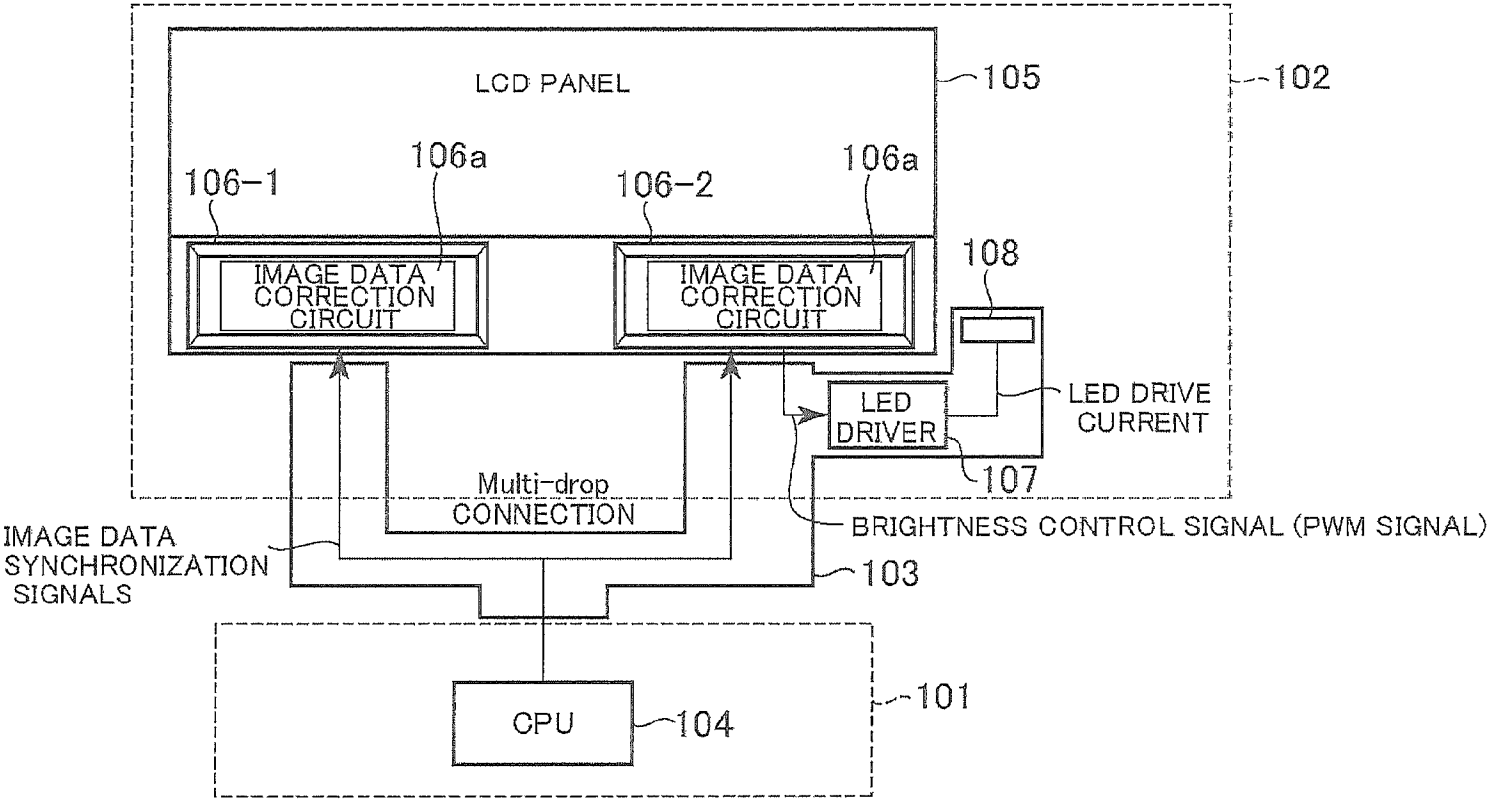
FIG. 3 is a block diagram illustrating another example of a liquid crystal display device which incorporates a plurality of driver ICs to drive a liquid crystal display panel and is configured to perform a correction calculation on input image data.

Another approach for performing the same correction calculation with respect to the whole of the LCD panel 105 may be, as shown in FIG. 3, to supply image data of entire image to be displayed on the LCD panel 105 to the respective driver ICs. In detail, in the configuration illustrated in FIG. 3, two driver ICs 106-1 and 106-2 are mounted in the LCD panel 105. An image data correction circuit 106*a* is integrated in each of the driver ICs 106-1 and 106-2 for performing a correction calculation on the image data. Also, signal lines to connect the CPU 104 to the driver ICs 106-1 and 106-2 is laid on the FPC 103, and the LED (light emitting diode) driver 107 and the LED backlight 108 are mounted on the FPC 103. Note that the CPU 104 and the driver ICs 106-1 and 106-2 are connected via a multi-drop connection. That is, the driver ICs 106-1 and 106-2 receive the same data from the CPU 104.

The liquid crystal display device illustrated in FIG. 3 operates as follows. The CPU 104 supplies image data of entire images, which are to be displayed on the LCD panel 105, to each of the driver ICs 106-1 and 106-2. It should be noted that, when image data of an entire image are supplied to one of the driver ICs 106-1 and 106-2, the image data of the entire image are also supplied to the other, since the CPU 104 is connected to the driver ICs 106-1 and 106-2 via a multi-drop connection. The image data correction circuit 106*a* of each of the driver ICs 106-1 and 106-2 calculates the feature value of each entire image from the received image data and performs the correction calculation on the image data on the basis of the calculated feature value. The driver ICs 106-1 and 106-2 drive the data lines and gate lines of the LCD panel 105 in response to the corrected image data obtained by the correction calculation. Furthermore, the driver IC 106-2 generates the brightness control signal in response to the feature value of each image, which is calculated by the image data correction circuit 106*a*, and supplies the brightness control signal to the LED driver 107. Consequently, the brightness of the LED backlight 108 is controlled.

In the configuration in FIG. 3, in which each of the driver ICs 106-1 and 106-2 receives image data of each entire image, the feature value of each entire image can be calculated from the received image data and therefore the same correction calculation can be performed with respect to the whole of the LCD panel 105.

The configuration in FIG. 3, however, requires transmitting image data of each entire image to be displayed on the LCD panel 105 to the respective driver ICs (namely, the driver ICs 106-1 and 106-2) in each frame period, and therefore the data transmission rate required to transfer the image data is increased. This undesirably leads to increases in the power consumption and in the EMI (electromagnetic interference).

The present invention, which is based on the inventors' study of the inventors described above, is directed to provide a technique for performing a suitable correction calculation on input image data, while decreasing the necessary data transmission rate and cost, for a display device which incorporates a plurality of display panel drivers to drive the display panel. It should be noted that the above-described description of the configurations illustrated in FIGS. 1 to 3 does not mean that the Applicant admits that the configurations illustrated in FIGS. 1 to 3 are known in the art. In the following, embodiments of the present invention will be described in detail.

(First Embodiment)

Figure 4:
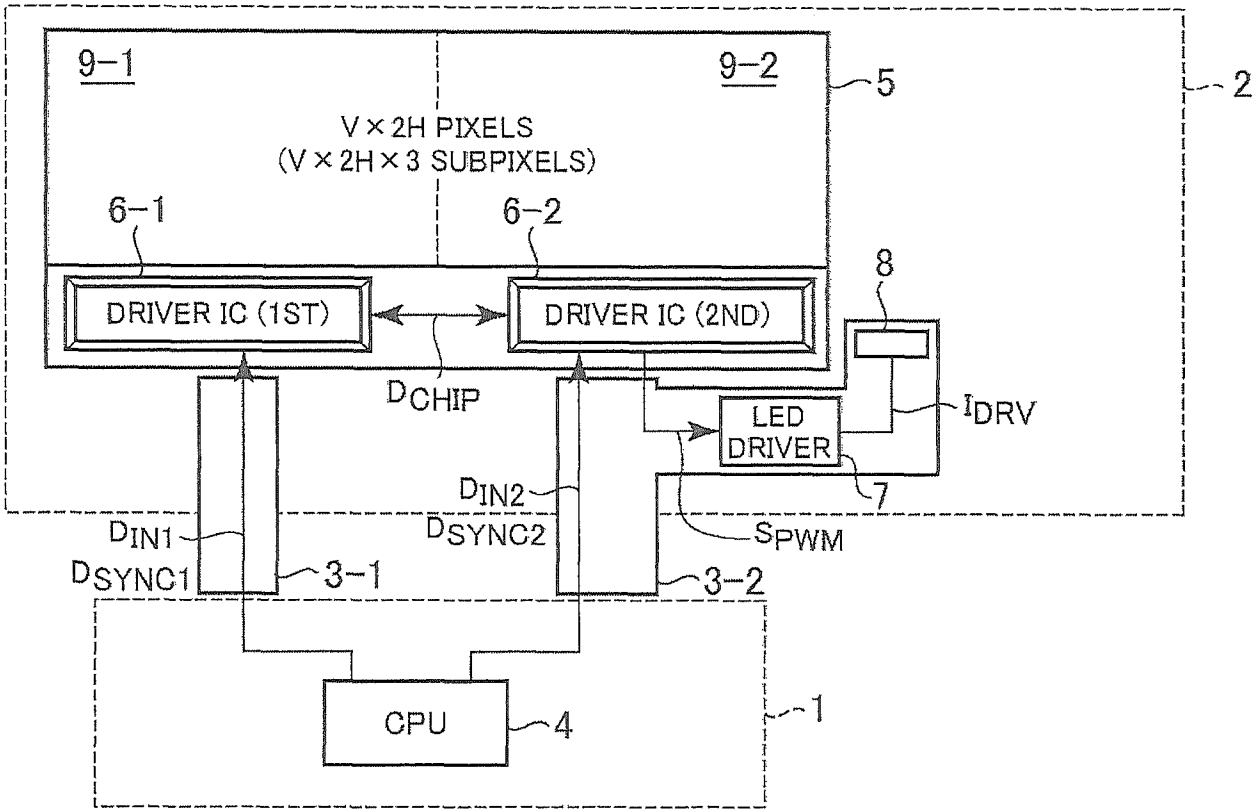
FIG. 4 is a block diagram illustrating an exemplary configuration of a display device in a first embodiment of the present invention.

FIG. 4 is the block diagram illustrating an exemplary configuration of a display device in a first embodiment of the present invention. The display device in FIG. 1 is configured as a liquid crystal display device and includes a main block 1, a liquid crystal display block 2 and FPCs 3-1 and 3-2. The main block 1 includes a CPU 4 and the liquid crystal display block 2 includes an LCD panel 5. The main block 1 and the liquid crystal display block 2 are coupled by the FPCs 3-1 and 3-2.

In the LCD panel 5, a plurality of data lines and a plurality of gate lines are laid, and pixels are arranged in a matrix. In this embodiment, pixels are arranged in V rows and H columns in the LCD panel 5. In this embodiment, each pixel includes a subpixel associated with red (hereinafter, referred to as R subpixel), a subpixel associated with green (hereinafter, referred to as G subpixel) and a subpixel associated with blue (hereinafter, referred to as B subpixel). This implies that subpixels are arranged in V rows and 3H columns in the LCD panel 5. Each subpixel is placed at an intersection of a data line and a gate line in the LCD panel 5. In driving the LCD panel 5, the gate lines are sequentially selected, and desired drive voltages are fed to the data lines and written into the subpixels connected to the selected gate line. As a result, the respective subpixels in the LCD panel 5 are set to desired grayscale levels to display a desired image on the LCD panel 5.

Additionally, a plurality of driver ICs, in this embodiment, two driver ICs 6-1 and 6-2, are mounted on the LCD panel 5 by using a surface mounting technology such as a COG (Chip on Glass) technique. Note that the driver ICs 6-1 and 6-2 may be referred to as a first driver and a second driver, respectively, hereinafter. In this embodiment, the display region of the LCD panel 5 includes two portions: a first portion 9-1 and a second portion 9-2 and the respective pixels (strictly, the subpixels included in the pixels) provided in the first and second portions 9-1 and 9-2 are driven by the driver ICs 6-1 and 6-2, respectively.

The CPU 4 is a processing device which supplies to the driver ICs 6-1 and 6-2 the image data to be displayed on the LCD panel 5 and synchronization data used for controlling the driver ICs 6-1 and 6-2.

In detail, the FPC 3-1 includes signal lines which connect the CPU 4 to the driver IC 6-1. Input image data $D_{IN1}$ and synchronization data $D_{SYNC1}$ are transmitted to the driver IC 6-1 via these signal lines. Here, the input image data $D_{IN1}$ are associated with a partial image to be displayed on the first portion 9-1 of the display region of the LCD panel 5 and indicate the grayscale levels of the respective subpixels in the pixels provided in the first portion 9-1. In this embodiment, the grayscale level of each subpixel in the pixels in the LCD panel 5 is represented with eight bits. Since each pixel in the LCD panel 5 includes three subpixels (an R subpixel, a G subpixel and a B subpixel), the input image data $D_{IN1}$ represent the grayscale levels of each pixel in the LCD panel 5 with 24 bits. The synchronization data $D_{SYNC1}$ are used to control the operation timing of the driver IC 6-1.

Similarly, the FPC 3-2 includes signal lines which connect the CPU 4 to the driver IC 6-2. Input image data $D_{IN2}$ and synchronization data $D_{SYNC2}$ are transmitted to the driver IC 6-2 via these signal lines. Here, the input image data $D_{IN2}$ are associated with a partial image to be displayed on the second portion 9-2 of the display region of the LCD panel 5 and indicate the grayscale levels of the respective subpixels in the pixels provided in the second portion 9-2. Similarly to the input image data $D_{INT}$, the input image data $D_{IN2}$ represent the grayscale level of each subpixel in the pixels provided in the second portion 9-2 with eight bits. The synchronization data $_{DSYNC2}$ are used to control the operation timing of the driver IC 6-2.

In addition, an LED driver 7 and an LED backlight 8 are mounted on the FPC 3-2. The LED driver 7 generates an LED drive current $I_{DRV}$ in response to the brightness control signal $S_{PWM}$ received from the driver IC 6-2. The brightness control signal $S_{PWM}$ is a pulse signal generated by PWM (pulse width modulation) and has a waveform corresponding to (or identical to) the waveform of the brightness control signal $S_{PWM}$. The LED backlight 8 is driven by the LED drive current $I_{DRV}$ to illuminate the LCD panel 5.

It should be noted here that the CPU 4 is peer-to-peer connected to the driver ICs 6-1 and 6-2. The input image data $D_{IN2}$, which are supplied to the driver IC 6-2, are not supplied to the driver IC 6-1, and the input image data $D_{IN1}$, which are supplied to the driver IC 6-1, are not supplied to the driver IC 6-2. That is, the input image data corresponding to the entire display region in the LCD panel 5 are supplied to none of the driver ICs 6-1 and 6-2. This enables reducing the data transmission rate required to transmit the input image data $D_{IN1}$ and $D_{IN2}$.

In addition, signal lines are connected between the driver ICs 6-1 and 6-2, and the driver ICs 6-1 and 6-2 exchange inter-chip communication data $D_{CHIP}$ via the signal lines. The signal lines which connect the driver ICs 6-1 and 6-2 may be laid on the glass substrate of the LCD panel 5.

The inter-chip communication data $D_{CHIP}$ are used for the driver ICs 6-1 and 6-2 to exchange feature data. The feature data indicate one or more feature values of the partial images displayed on the portions driven by the driver ICs 6-1 and 6-2, respectively (that is, the first portion 9-1 and the second portion 9-2) of the display region of the LCD panel 5. The driver IC 6-1 calculates a feature values) of the image displayed on the first portion 9-1 of the display region of the LCD panel 5 from the input image data $D_{IN1}$ supplied to the driver IC 6-1, and transmits the feature data indicating the calculated feature value(s), as the inter-chip communication data $D_{CHIP}$, to the driver IC 6-2. Similarly, the driver IC 6-2 calculates a feature value(s) of the image displayed on the second portion 9-2 of the display region of the LCD panel 5 from the input image data $D_{1N2}$ supplied to the driver IC 6-2 and transmits the feature data indicating the calculated feature value(s), as the inter-chip communication data $D_{CHIP}$ to the driver IC 6-1.

Various parameters may be used as the feature value(s) included in the feature data exchanged between the driver ICs 6-1 and 6-2. In one embodiment, the APL calculated for each color (namely, the APL calculated for each of the R, G and B subpixels) may be used as a feature value. In an alternative embodiment, the histogram of the grayscale levels of the subpixels calculated for each color may be used as feature values. In still another embodiment, a combination of the APL and the variance of the grayscale levels of the subpixels, which are calculated for each color, may be used as feature values.

In the case that the input image data $D_{IN1}$ and $D_{IN2}$ supplied to the driver ICs 6-1 and 6-2 are RGB data, the feature value(s) may be calculated on the basis of brightness data (or Y data) obtained by performing an RGB-YUV transform on the input image data $D_{IN1}$ and $D_{IN2}$. In this case, the APL calculated from the brightness data may be used as a feature value in one embodiment. Each driver IC **6-*i* performs the RGB-YUV transform on the input image data $D_{INi}$ to calculate the brightness data which indicate the brightness for each pixel, and then calculates the APL as the average value of the brightnesses of the respective pixels in the image displayed on the first portion 9-*i***. In another embodiment, the histogram of the brightnesses of the pixels may be used as feature values. In still another embodiment, a combination of the APL calculated as the average value and the variance (or standard deviation) of the brightnesses of the pixels may be used as feature values.

One feature of the display device in this embodiment is that one or more feature values of entire images displayed on the display region of the LCD panel 5 are calculated in each of the driver ICs 6-1 and 6-2 on the basis of the feature data exchanged between the driver ICs 6-1 and 6-2, and the correction calculations are performed on the input image data $D_{IN1}$ and $D_{IN2}$ in response to the basis of the calculated feature values, in the driver ICs 6-1 and 6-2, respectively. Such operation allows performing a correction calculation based on the feature values of an entire image displayed on the display region of the LCD panel 5, which are calculated in each of the driver ICs 6-1 and 6-2. In other words, the correction calculation can be performed on the basis of the feature values of each entire image displayed on the display region of the LCD panel 5 without using an additional image processing IC (refer to FIG. 2). This contributes to a cost reduction. On the other hand, it is not necessary to transmit the image data corresponding to the entire images to be displayed on the display region of the LCD panel 5 to each of the driver ICs 6-1 and 6-2. That is, the input image data $D_{IN1}$ corresponding to the partial images to be displayed on the first portion 9-1 of the display region of the LCD panel 5 are transmitted to the driver IC 6-1, and the input image data $D_{IN2}$ corresponding to the partial images to be displayed on the second portion 9-2 of the display region of the LCD panel 5 are transmitted to the driver IC 6-2. Such operation of the display device in this embodiment effectively reduces the necessary data transmission rate.

Figure 5:
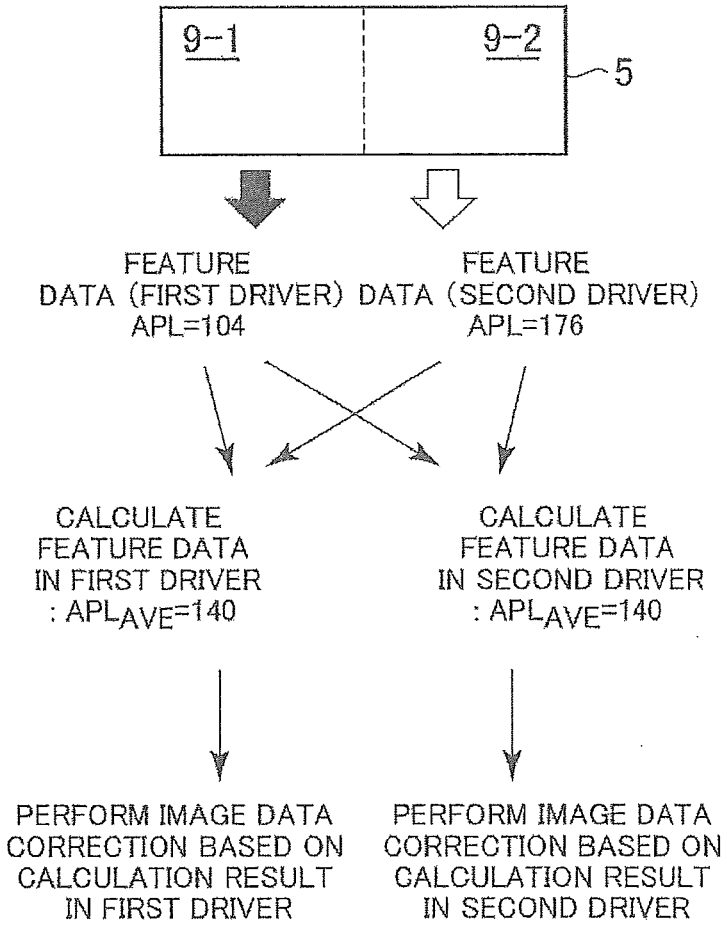
FIG. 5 is a conceptual diagram illustrating an exemplary operation of the display device in this embodiment.

FIG. 5 is a conceptual diagram illustrating one exemplary operation of the display device in this embodiment. It should be noted that, although FIG. 5 illustrates an example in which the APL calculated from the brightness data is used as a feature value, the feature value is not limited to the APL.

As shown in FIG. 5, the driver IC 6-1 (the first driver) calculates the APL of the partial image displayed on the first portion 9-1 of the display region of the LCD panel 5, on the basis of the input image data $D_{IN1}$ transmitted to the driver IC 6-1. Similarly, the driver IC 6-2 (the second driver) calculates the APL of the partial image displayed on the second portion 9-2 of the display region of the LCD panel 5, on the basis of the input image data $D_{IN2}$ transmitted to the driver IC 6-2. In the example in FIG. 5, the driver IC 6-1 calculates the APL of the partial image displayed on the first portion 9-1 as 104, and the driver IC 6-2 calculates the APL of the partial image displayed on the second portion 9-2 as 176.

Furthermore, the driver IC 6-1 transmits the feature data indicating the APL calculated by the driver IC 6-1 (the APL of the partial image displayed on the first portion 9-1 ) to the driver IC 6-2 and the driver IC 6-2 transmits the feature data indicating the APL calculated by the driver IC 6-2 (the APL of the partial image displayed on the second portion 9-2) to the driver IC 6-1.

The driver IC 6-1 calculates the APL of the entire image displayed on the display region of the LCD panel 5, from the APL calculated by the driver IC 6-1 (namely, the APL of the partial image displayed on the first portion 9-1) and the APL indicated in the feature data received from the driver IC 6-2 (namely, the APL of the partial image displayed on the second portion 9-2). It should be noted that the average value $APL_{AVE}$ of the APL of the partial image displayed on the first portion 9-1 and the APL of the partial image displayed on the second portion 9-2 is the APL of the entire image displayed on the display region. In the example in FIG. 5, the APL of the partial image displayed on the first portion 9-1 is 104, and the APL of the partial image displayed on the second portion 9-2 is 176. Thus, the driver IC 6-1 calculates the average value $APL_{AVE}$ as 140.

Similarly, the driver IC 6-2 calculates the APL of the entire image displayed on the display region of the LCD panel 5, namely, the average value $APL_{AVE}$ between the APL of the partial image displayed on the first portion 9-1 and the APL of the partial image displayed on the second portion 9-2, from the APL calculated by the driver IC 6-2 (namely, the APL of the partial image displayed on the second portion 9-2) and the APL indicated in the feature data received from the driver IC 6-1 (namely, the APL of the partial image displayed on the first portion 9-1). In the example in FIG. 5, the driver IC 6-2 calculates the average value $APL_{AVE}$ as 140, similarly to the driver IC 6-1.

The driver IC 6-1 performs the correction calculation on the input image data $D_{IN1}$ on the basis of the APL of the entire image displayed on the display region which is calculated by the driver IC 6-1 (namely, the average value $APL_{AVE}$) and drives the subpixels of the pixels disposed in the first portion 9-1 on the basis of the corrected image data obtained by the correction calculation. Similarly, the driver IC 6-2 performs the correction calculation on the input image data $D_{IN2}$ on the basis of the average value $APL_{AVE}$ calculated by the driver IC 6-2 and drives the subpixels of the pixels disposed in the second portion 9-2 on the basis of the corrected image data obtained by the correction calculation.

Here, the average values $APL_{AVE}$ calculated by the respective driver ICs 6-1 and 6-2 are the same value (in principle). As a result, each of the driver ICs 6-1 and 6-2 can perform the correction calculation based on the feature value(s) of the entire image displayed on the display region of the LCD panel 5. As thus described, each of the driver ICs 6-1 and 6-2 can perform the correction calculation based on the feature value(s) of the entire image displayed on the display region of the LCD panel 5 in this embodiment, even if the input image data corresponding to the entire image displayed on the display region of the LCD panel 5 are not transmitted to the driver ICs 6-1 and 6-2.

It should be noted that, as described above, parameters other than the APL calculated as the average value of the brightnesses of the pixels, such as the histogram of the brightnesses of the pixels and the variance (or standard deviation) of the brightnesses of the pixels may be used as feature values included in the feature data.

Three properties are desired for the feature values indicated in the feature data exchanged as the inter-chip communication data $D_{CHIP}$. First, it is desired that the feature values include much information with regard to the partial images on the first portion 9-1 and the second portion 9-2 in the display region of the LCD panel 5. Secondly, it is desired that the feature values of the entire image displayed on the display region of the LCD panel 5 can be reproduced by a simple calculation. Thirdly, it is desired that the data quantity of the feature data is small.

From these aspects, one preferable example for the feature values included in the feature data is a combination of the APL (namely, the average of the grayscale levels of the subpixels) and the mean square value of the grayscale levels of the subpixels, which are calculated for each color. The use of the combination of the APL and the mean square value of the grayscale levels of the subpixels calculated for each color as the feature values exchanged between the driver ICs 6-1 and 6-2 allows each of the driver ICs 6-1 and 6-2 to calculate the APL and mean square value of the grayscale levels of the subpixels with respect to the entire image displayed on the display region of the LCD panel 5 for each color and to further calculate the variance $\sigma^2$ of the grayscale levels of the subpixels with respect to the entire image displayed on the display region of the LCD panel 5 for each color.

In detail, it is possible to calculate the APL of the entire image displayed on the display region of the LCD panel 5 from the APLs of the partial images displayed on the first and second portions 9-1 and 9-2, for each color. It is also possible to calculate the variance $\sigma^2$ of the grayscale levels of the subpixels of the entire image displayed on the display region of the LCD panel 5 from the APLs and the mean square values of the grayscale levels of the subpixels, calculated for the partial images displayed on the first and second portions 9-1 and 9-2, for each color. The APL and the variance $\sigma^2$ of the grayscale levels of the subpixels are a combination of parameters suitable for roughly representing the distribution of the grayscale levels of the subpixels and the correction calculation based on such parameters allows suitably enhancing the contrast of the image. Moreover, the data amount of the combination of the APL and the mean square value of the grayscale levels of the subpixels which are calculated for each color is small (as compared with the histogram, for example). As thus discussed, the combination of the APL and the mean square value of the subpixels, which are calculated for each color, has desirable properties as the feature values included in the feature data.

To further reduce the data amount, it is advantageous to use a combination of the APL calculated as the average value of the brightnesses of the pixels and the mean square value of the brightnesses of the pixels as the feature values. The use of the combination of the APL calculated as the average value of the brightnesses of the pixels and the mean square value of the brightnesses as the feature values exchanged between the driver ICs 6-1 and 6-2 allows each of the driver ICs 6-1 and 6-2 to calculate the APL and the mean square value of the brightnesses of the pixels with respect to the entire image displayed on the display region of the LCD panel 5, and to further calculate the variance $\sigma^2$ of the brightnesses of the pixels with respect to the entire image displayed on the display region of the LCD panel 5. In detail, it is possible to calculate the APL of the entire image displayed on the display region of the LCD panel 5 from the APLs of the partial images displayed on the first and second portions 9-1 and 9-2. it is also possible to calculate the variance $\sigma^2$ of the brightnesses of the pixels with respect to the entire image displayed on the display region of the LCD panel 5 from the APLs and the mean square values of the brightnesses of the pixels, which are calculated for the partial images displayed on the first and second portions 9-1 and 9-2. The APL and the variance of the brightnesses of the pixels are a combination of parameters suitable for roughly representing the distribution of the grayscale levels of the pixels. Furthermore, the data amount of the combination of the APL and the mean square value of the brightnesses of the pixels is small (as compared with the above-described combination of the APL and the mean square value of the grayscale levels of the subpixels calculated for each color, for example). As thus described, the combination of the APL calculated as the average value of the brightnesses of the pixels and the mean square value of the brightnesses of the pixels has desirable properties as the feature values included in the feature data.

Figure 6:
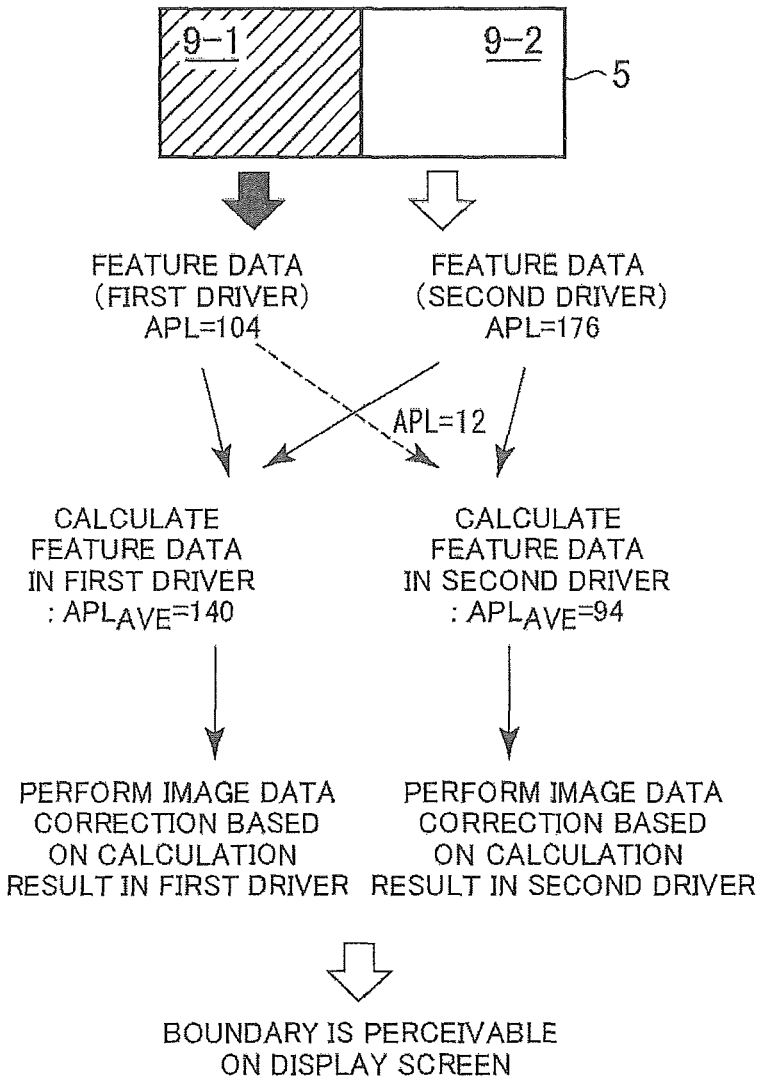
FIG. 6 is a conceptual diagram illustrating a problem of a communication error which may occur in communications of inter-chip communication data between the driver ICs.

One problem which potentially occurs in the operation shown in FIG. 5 is that the image displayed on the display region of the LCD panel 5 may suffer from unevenness when a communication error occurs in the exchange of the inter-chip communication data $D_{CHIP}$ (namely, the feature data) between the driver ICs 6-1 and 6-2. In particular, a communication error is likely to occur when the signal lines used for the communications of the inter-chip communication data $D_{CHIP}$ between the driver ICs 6-1 and 6-2 are laid on the glass substrate of the LCD panel 5. FIG. 6 is the view illustrating the problem of a communication error which potentially occurs in the communications of the inter-chip communication data $D_{CHIP}$ between the driver ICs 6-1 and 6-2.

For example, let us consider the case that the communication from the driver IC 6-2 to the driver IC 6-1 is successfully completed, while a communication error occurs in the communication from the driver IC 6-1 to the driver IC 6-2. More specifically, let us consider the case that a communication error occurs in transmitting the feature data that indicate the APL calculated by the driver IC 6-1 (the APL of the partial image displayed on the first portion 9-1) to the driver IC 6-2, and the driver IC 6-2 resultantly recognizes that the APL of the partial image displayed on the first portion 9-1 is 12. In this case, the driver IC 6-2 erroneously calculates the $APL_{AVE}$ of the entire image displayed on the display region of the LCD panel 5 as 94. On the other hand, the driver IC 6-1 correctly calculates that the $APL_{AVE}$ of the entire image displayed on the display region of the LCD panel 5 is 140. This results in that the driver ICs 6-1 and 6-2 performs the different correction calculations and a boundary can be visually perceived between the first portion 9-1 and the second portion 9-2 of the display region of the LCD panel 5.

In the below-described configuration and operation of the driver ICs 6-1 and 6-2, a technical approach is used which enables performing the same correction calculation in the driver ICs 6-1 and 6-2 even when the communications of the feature data are not successfully completed in a certain frame period; this effectively addresses the problem that a boundary may be visually perceived between the first portion 9-1 and the second portion 9-2 of the display region of the LCD panel 5. In the following, an exemplary configuration and operation of the driver ICs 6-1 and 6-2 is described in detail.

Figure 7:
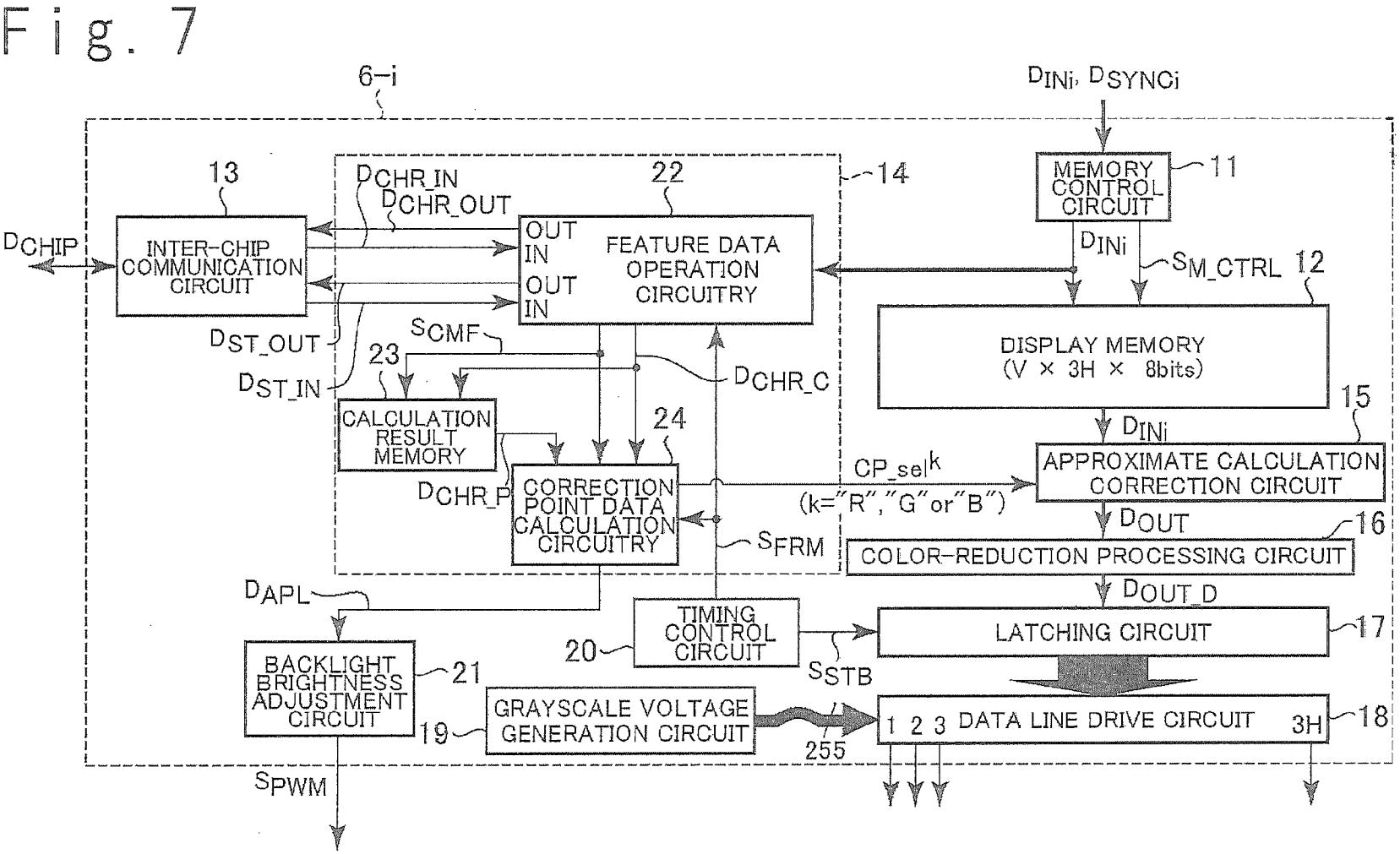
FIG. 7 is a block diagram illustrating an exemplary configuration of the driver ICs in the first embodiment.

FIG. 7 is a block diagram illustrating an exemplary configuration of the driver ICs 6-1 and 6-2 in a first embodiment. In the following, the driver ICs 6-1 and 6-2 may be collectively referred to as the driver IC **6-*i*. In connection to this, the input image data fed to the driver IC 6-*i* may be referred to as input image data $D_{INi}$ and the synchronization data fed to the driver IC 6-*i*** may be referred to as synchronization data $D_{SYNCi}$.

Each driver IC **6-*i* includes a memory control circuit 11, a display memory 12, an inter-chip communication circuit 13, a correction point dataset feeding circuit 14, an approximate calculation correction circuit 15, a color-reduction processing circuit 16, a latch circuit 17, a data line drive circuit 18, a grayscale voltage generation circuit 19, a timing control circuit 20 and a backlight brightness adjustment circuit 21**.

The memory control circuit 11 has the function of controlling the display memory 12 and writing the input image data $D_{INi}$, which are received from the CPU 4, into the display memory 12. More specifically, the memory control circuit 11 generates display memory control signals $S_{M_CTRL}$ from the synchronization data $D_{SYNCi}$ received from the CPU 4 to control the display memory 12. Additionally, the memory control circuit 11 transfers the input image data $D_{INi}$ to the display memory 12 in synchronization with synchronization signals (for example, a horizontal synchronization signal $H_{SYNC}$ and a vertical synchronization signal $V_{SYNC}$) generated from the synchronization data $D_{SYNCi}$ and writes the input image data $D_{INi}$ into the display memory 12.

The display memory 12 is used to transiently hold the input image data $D_{INi}$ within the driver IC **6-*i*. The display memory 12 has a memory capacity sufficient to store one frame image. In this embodiment, in which the grayscale level of each subpixel of each pixel in the LCD panel 5 is represented with 8 bits, the memory capacity of the display memory 12 is V×3H×8 bits. The display memory 12 sequentially outputs the input image data $D_{INi}$ stored therein in response to the display memory control signals $S_{M_CTRL}$ received from the memory control circuit 11. The input image data $D_{INi}$ are outputted in units of pixel lines each including pixels arrayed along one gate line in the LCD panel 5**.

The inter-chip communication circuit 13 has the function of exchanging the inter-chip communication data $D_{CHIP}$ with the other driver IC. In other words, the inter-chip communication circuits 13 in the driver ICs 6-1 and 6-2 exchange the inter-chip communication data $D_{CHIP}$ between each other.

The inter-chip communication data $D_{CHIP}$ received by the inter-chip communication circuit 13 of one driver IC from the other driver IC includes feature data and communication state notification data generated by the other driver IC. Hereinafter, the feature data transmitted by the other driver IC is referred to as input feature data $D_{CHR_IN}$. Also, the communication state notification data transmitted by the other driver IC is referred to as communication state notification data $D_{ST_IN}$.

The input feature data $D_{CHR_IN}$ indicate the feature value(s) calculated by the other driver IC. For example, the input feature data $D_{CHR_IN}$ received by the driver IC 6-1 from the driver IC 6-2 indicates the feature value(s) calculated by the driver IC 6-2 (namely, the feature value(s) of the partial image displayed on the second portion 9-2).

Also, the communication state notification data $D_{ST_IN}$ indicate whether or not the other driver IC has successfully received the feature data. For example, the communication state notification data $D_{ST_IN}$ received by the driver IC 6-1 from the driver IC 6-2 indicate whether the driver IC 6-2 has successfully received the feature data from the driver IC 6-1. Each driver IC **6-*i* can recognize whether the other driver IC has successfully received the feature data, on the basis of the communication state notification data $D_{ST_IN}$. The inter-chip communication circuit 13 transfers the input feature data $D_{CHR_IN}$ and the communication state notification data $D_{ST_IN}$ received from the other driver IC to the correction point dataset feeding circuit 14**.

On the other hand, the inter-chip communication data $D_{CHIP}$ to be transmitted by the inter-chip communication circuit 13 to the other driver IC include feature data and communication state notification data generated in the driver IC in which the inter-chip communication circuit 13 is integrated, which are to be transmitted to the other driver. The feature data generated in the driver IC in which the inter-chip communication circuit 13 is integrated, which are to be transmitted to the other driver IC, are hereinafter referred to as output feature data $D_{CHR_OUT}$. Also, the communication state notification data to be transmitted to the other driver IC are hereinafter referred to as communication state notification data $D_{ST_OUT}$.

The output feature data $D_{CHR_OUT}$ indicate the feature value(s) calculated by the driver IC in which the inter-chip communication circuit 13 is integrated. For example, the output feature data $D_{CHR_OUT}$ transmitted by the inter-chip communication circuit 13 in the driver IC 6-1 indicate the feature value(s) calculated by the driver IC 6-1 and are transmitted to the driver IC 6-2.

Also, the communication state notification data $D_{ST_OUT}$ indicate whether the driver IC in which the inter-chip communication circuit 13 is integrated has successfully received the feature data. For example, the communication state notification data $D_{ST_OUT}$ transmitted by the inter-chip communication circuit 13 in the driver IC 6-1 indicate whether the driver IC 6-1 has successfully received the input feature data $D_{CHR_IN}$. The communication state notification data $D_{ST_OUT}$ generated by the driver IC 6-1 are transmitted to the inter-chip communication circuit 13 in the driver IC 6-2 and used in processes performed in the driver IC 6-2.

The correction point dataset feeding circuit 14 feeds correction point datasets $CP_sel^R$, $CP_sel^G$ and $CP_sel^B$, which may be collectively referred as correction point dataset $CP_sel^k$, hereinafter, to the approximate calculation correction circuit 15. Here, the correction point dataset $CP_sel^k$ specifies the input-to-output relation of the correction calculation performed in the approximate calculation correction circuit 15. In this embodiment, a gamma correction is used as the correction calculation performed in the approximate calculation correction circuit 15. The correction point dataset $CP_sel^k$ is a set of data used to determine the shape of the gamma curve to be applied in the gamma correction. Each correction point dataset $CP_sel^k$ includes six correction point data CP0 to CP5 and specifies the shape of the gamma curve corresponding to a certain gamma value γ with one set of correction point data CP0 to CP5.

In order to perform gamma corrections with different gamma values on the input image data $D_{INi}$ associated with the R, G and B subpixels, a correction point dataset is selected for each color (that is, each of red, green and blue) in this embodiment. Hereinafter, the correction point dataset selected for the R subpixels is referred to as the correction point dataset $CP_sel^B$, the correction point dataset selected for the G subpixels is described as the correction point dataset $CP_sel^G$, and the correction point dataset selected for the B subpixels is described as the correction point dataset $CP_sel^B$.

Figure 8:
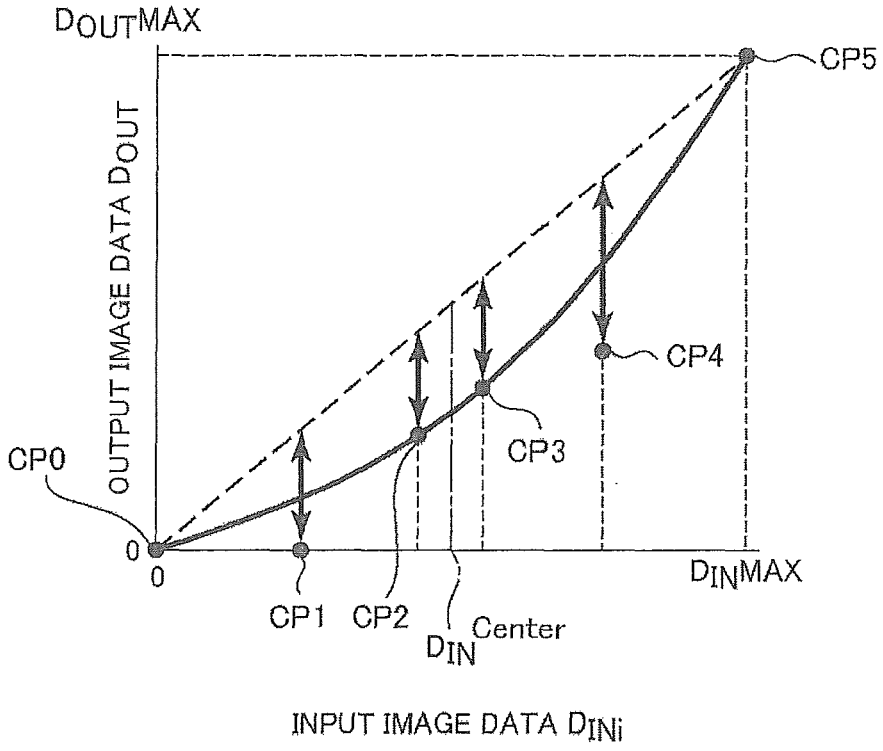
FIG. 8 is a graph illustrating a gamma curve specified by correction point data CP0 to CP5 included in a correction point dataset $CP_sel^k$, and contents of a correction calculation (or gamma correction) in accordance with the gamma curve.

FIG. 8 illustrates the gamma curve specified by correction point data CP0 to CP5 included in a correction point dataset $CP_sel^k$, and the contents of the correction calculation (gamma correction) in accordance with the gamma curve. The correction point data CP0 to CP5 are defined as coordinate points in the coordinate system in which the lateral axis (first axis) represents the input image data $D_{IN1}$ and the longitudinal axis (second axis) represent the output image data $D_{OUT}$. Here, the correction point data CP0 and CP5 are located on the both ends of the gamma curve. The correction point data CP2 and CP3 are located at positions near the center of the gamma curve. Also, the correction point data CP1 is located at a position between the correction point data CP0 and CP2. The correction point data CP4 is located at a position between the correction point data CP3 and CP4. The positions of the correction point data CP1 to CP4 are suitably determined to specify the shape of the gamma curve.

When the positions of the correction point data CP1 to CP4 are defined at the positions below the straight line which connects the both ends of the gamma curve, for example, the gamma curve is specified as having a downward convex shape as shown in FIG. 8. As described later, the gamma correction is performed to generate the output image data $D_{OUT}$ in the approximate calculation correction circuit 15 in accordance with the gamma curve with the shape specified by the correction point data CP0 to CP5 included in the correction point dataset $CP_sel^k$.

In this embodiment, the correction point dataset feeding circuit 14 in the driver IC 6-*i* calculates the feature value(s) of the partial image displayed on the i-th portion 9-*i* of the display region of the LCD panel 5 from the input image data $D_{INi}$. Furthermore, the correction point dataset feeding circuit 14 in the driver IC 6-*i* calculates the feature value(s) of the entire image displayed on the display region of the LCD panel 5 on the basis of the feature value(s) calculated by the correction point dataset feeding circuit 14 and the feature value(s) indicated in the input feature data $D_{CHR_IN}$ received from the different driver IC, and determines the correction point dataset $CP_sel^k$ on the basis of the feature value(s) of the entire image displayed on the display region of the LCD panel 5.

In one embodiment, a combination of the APL calculated as the average value of the grayscale levels of the subpixels and the mean square value of the grayscale levels of the subpixels calculated for each color (namely, for each of the R, G and B subpixels) is employed as the feature values exchanged between the driver ICs 6-1 and 6-2. The correction point dataset feeding circuit 14 in the driver IC 6-*i* calculates the APL of the partial image displayed on the i-th portion 9-*i* of the display region of the LCD panel 5 and the mean square value of the grayscale levels of the subpixels for each of the R, G and B subpixels, on the basis of the input image data $D_{INi}$. The correction point dataset feeding circuit 14 in the driver IC 6-*i* further calculates the feature values of the entire image displayed on the display region of the LCD panel 5 from the feature values calculated by the correction point dataset feeding circuit 14 and the feature values indicated in the input feature data $D_{CHR_IN}$ received from the different driver IC for each of the R, G and B subpixels.

In detail, the APL of the R subpixels of the entire image displayed on the display region of the LCD panel 5 is calculated from the APL of the R subpixels calculated by the correction point dataset feeding circuit 14 and the APL of the R subpixels indicated in the input feature data $D_{CHR_IN}$ received from the different driver IC. Also, the mean square value of the grayscale levels of the R subpixels of the entire image displayed on the display region of the LCD panel 5 is calculated from the mean square value of the grayscale levels of the R subpixels calculated by the correction point dataset feeding circuit 14 and the mean square value of the grayscale levels of the R subpixels indicated in the input feature data $D_{CHR_IN}$ received from the other driver IC. Furthermore, the variance $\sigma^2$ of the grayscale levels of the R subpixels is calculated from the APL and the mean square value of the grayscale levels of the R subpixels, with respect to the entire image displayed on the display region of the LCD panel 5, and the APL and variance $\sigma^2$ of the grayscale levels of the R subpixels are used to determine the correction point dataset $CP_sel^R$. Similarly, with respect to the entire image displayed on the display region of the LCD panel 5, the APL and mean square value of the grayscale levels of the G subpixels are calculated and the variance $\sigma^2$ of the grayscale levels of the G subpixels is then calculated. The APL and the variance $\sigma^2$ of the grayscale level of the G subpixels are used to determine the correction point dataset $CP_sel^G$. Also, with respect to the entire image displayed on the display region of the LCD panel 5, the APL and mean square value of the grayscale levels of the B subpixels are calculated and the variance $\sigma^2$ of the grayscale levels of the B subpixels is then calculated. The APL and variance $\sigma^2$ of the grayscale levels of the B subpixels are used to determine the correction point dataset $CP_sel^B$.

In another embodiment, a combination of the APL calculated as the average value of the brightnesses of the pixels and the mean square value of the brightnesses of the pixels is used as the feature values exchanged between the driver ICs 6-1 and 6-2. Here, the brightness of each pixel is obtained by performing the RGB-YUV transform on the RGB data of the pixel indicated in the input image data $D_{INi}$. The correction point dataset feeding circuit 14 in the driver IC 6-*i* performs the RGB-YUV transform on the input image data $D_{INi}$ (which are RGB data), and calculates the brightnesses of the respective pixels of the partial image displayed on the i-th portion 9-*i* of the display region of the LCD panel 5, and further calculates the APL and the mean square value of the brightnesses of the pixels, from the calculated brightnesses of the respective pixels. The correction point dataset feeding circuit 14 in the driver IC 6-*i* further calculates the feature values of the entire image displayed on the display region of the LCD panel 5 from the feature values calculated by the correction point dataset feeding circuit 14 and the feature values indicated in the input feature data $D_{CHR_IN}$ received from the other driver IC. The APL and the mean square value of the brightnesses of the pixels with respect to the entire image displayed on the display region of the LCD panel 5 are used to calculate the variance $\sigma^2$ of the brightnesses and further used to determine the correction point datasets $CP_sel^R$, $CP_sel^G$ and $CP_sel^B$. In this case, the correction point datasets $CP_sel^R$, $CP_sel^G$ and $CP_sel^B$ may be the same. The configuration and operation of the correction point dataset feeding circuit 14 will be described later in detail.

The approximate calculation correction circuit 15 performs a gamma correction on the input image data $D_{INi}$ in accordance with the gamma curve specified by the correction point dataset $CP_sel^k$ received from the correction point dataset feeding circuit 14 to generate output image data $D_{OUT}$.

The number of bits of the output image data $D_{OUT}$ is larger than that of the input image data $D_{INi}$. This is effective for avoiding the information of the grayscale level of each pixel being lost by the correction calculation. In this embodiment, in which the input image data $D_{INi}$ represent the grayscale level of each subpixel of each pixel with eight bits, the output image data $D_{OUT}$ is generated to represent the grayscale level of each subpixel of each pixel with 10 bits, for example.

The approximate calculation correction circuit 15 performs the gamma calculation using a calculation expression, without using an LUT (lookup table). The use of no LUT in the approximate calculation correction circuit 15 is effective for reducing the circuit size of the approximate calculation correction circuit 15 and also effective for reducing the power consumption required to switch the gamma value. It should be noted that the gamma correction performed by the approximate calculation correction circuit 15 uses an approximate expression, not a strict expression. The approximate calculation correction circuit 15 determines coefficients of the approximate expression used for the gamma correction from the correction point dataset $CP_sel^k$ received from the correction point dataset feeding circuit 14 to perform the gamma correction in accordance with the desired gamma value. In order to perform a gamma correction based on a strict expression, an exponentiation calculation is required and this undesirably increases the circuit size. In this embodiment, the gamma correction based on the approximate expression, which involves no exponentiation calculation, is used to thereby reduce the circuit size.

Figure 9:
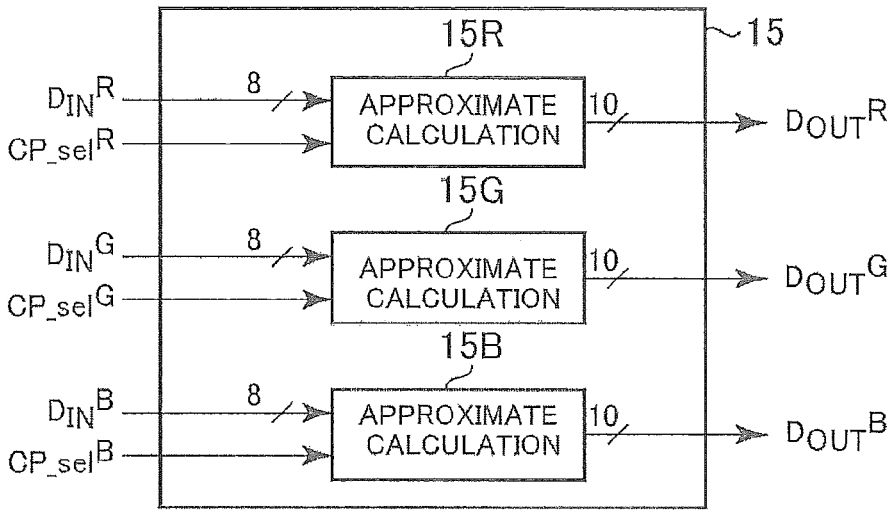
FIG. 9 is a block diagram illustrating an exemplary configuration of an approximate calculation correction circuit in the first embodiment.

FIG. 9 is a block diagram illustrating an exemplary configuration of the approximate calculation correction circuit 15. In the following, data indicating the grayscale levels of R subpixels in the input image data $D_{INi}$ are referred to as input image data $D_{INi}^R$. Similarly, data indicating the grayscale levels of G subpixels in the input image data $D_{INi}$ are referred to as input image data $D_{INi}^G$, and data indicating the grayscale levels of B subpixels in the input image data $D_{INi}$ are referred to as input image data $D_{INi}^B$. Correspondingly, data indicating the grayscale levels of R subpixels in the output image data $D_{OUT}$ is referred to as output image data $D_{OUT}^R$. Similarly, data indicating the grayscale levels of G subpixels in the output image data $D_{OUT}$ are referred to as output image data $D_{OUT}^G$, and data that indicating the grayscale levels of B subpixels in the output image data $D_{OUT}$ are referred to as output image data $D_{OUT}^B$.

The approximate calculation correction circuit 15 includes approximate calculation units 15R, 15G and 15B prepared for R, G and B subpixels, respectively. The approximate calculation units 15R, 15G and 15B perform a gamma correction based on the calculation expression on the input image data $D_{INi}^R$, $D_{INi}^G$ and $D_{INi}^B$, respectively, to generate the output image data $D_{OUT}^R$, $D_{OUT}^G$ and $D_{OUT}^B$, respectively. As mentioned above, the numbers of bits of the respective output image data $D_{OUT}^R$, $D_{OUT}^G$ and $D_{OUT}^B$, which are larger than those of the respective input image data $D_{INi}^R$, $D_{INi}^G$ and $D_{INi}^B$, are 10 bits.

The coefficients of the calculation expression used by the approximate calculation unit 15R for the gamma correction is determined on the basis of the correction point data CP0 to CP5 of the correction point dataset $CP_sel^R$. Similarly, the coefficients of the calculation expressions used by the approximate calculation units 15G and 15B for the gamma corrections are determined on the basis of the correction point data CP0 to CP5 of the correction point dataset $CP_sel^G$ and $CP_sel^B$, respectively.

The approximate calculation units 15R, 15G and 15B have the same function, except that the input image data and correction point dataset fed thereto are different. Hereinafter, the approximate calculation units 15R, 15G and 15B may be referred to as approximate calculation unit 15*k*, when they are not distinguished from one another.

Referring back to FIG. 7, the color-reduction processing circuit 16, the latch circuit 17 and the data line drive circuit 18 function as a drive circuitry which drives the data lines in the i-th portion 9-*i* of the display region of the LCD panel 5, in response to the output image data $D_{OUT}$ outputted from the approximate calculation correction circuit 15. More specifically, the color-reduction processing circuit 16 performs color reduction processing on the output image data $D_{OUT}$ generated by the approximate calculation correction circuit 15 to generate color-reduced image data $D_{OUT_D}$. The latch circuit 17 latches the color-reduced image data $D_{OUT_D}$ from the color-reduction processing circuit 16 in response to a latch signal $S_{STB}$ received from the timing control circuit 20 and transfers the latched color-reduced image data $D_{OUT_D}$ to the data line drive circuit 18. The data line drive circuit 18 drives the data lines in the i-th portion 9-*i* of the display region of the LCD panel 5 in response to the color-reduced image data $D_{OUT_D}$ received from the latch circuit 17. In detail, the data line drive circuit 18 selects corresponding grayscale voltages from a plurality of grayscale voltages fed from the grayscale voltage generation circuit 19 in response to the color-reduced image data $D_{OUT_D}$, and drives the corresponding data lines of the LCD panel 5 to the selected grayscale voltages. In this embodiment, the number of the grayscale voltages fed from the grayscale voltage generation circuit 19 is 255.

The timing control circuit 20 controls the operation timing of the driver IC 6-I in response to the synchronization data $D_{SYNCi}$ supplied to the driver IC 6-*i*. In detail, the timing control circuit 20 generates a frame signal $S_{FRM}$ and the latch signal $S_{STB}$ in response to the synchronization data $D_{SYNCi}$ and supplies to the correction point dataset feeding circuit 14 and the latch circuit 17, respectively. The frame signal $S_{FRM}$ is used for notifying the correction point dataset feeding circuit 14 of a start of each frame period. The frame signal $S_{FRM}$ is asserted at the beginning of each frame period. The latch signal $S_{STB}$ is used to allow the latch circuit 17 to latch the color-reduced image data $D_{OUT_D}$. The operation timings of the correction point dataset feeding circuit 14 and the latch circuit 17 are controlled by the frame signal $S_{FRM}$ and the latch signal $S_{STB}$.

The backlight brightness adjustment circuit 21 generates a brightness control signal $S_{PWM}$ for controlling the LED driver 7. The brightness control signal $S_{pwm}$ is a pulse signal generated by a pulse width modulation (PWM) performed in response to APL data $D_{APL}$ received from the correction point dataset feeding circuit 14. Here, the APL data $D_{APL}$ indicate the APL(s) used to determine the correction point dataset $CP_sel^k$ in the correction point dataset feeding circuit 14. The brightness control signal $S_{PWM}$ is supplied to the LED driver 7 and the brightness of the LED backlight 8 is controlled by the brightness control signal $S_{PWM}$. It should be noted that the brightness control signal $S_{PWM}$ generated by the backlight brightness adjustment circuits 21 in one of the driver ICs 6-1 and 6-2 is supplied to the LED driver 7, and the brightness control signal $S_{PWM}$ generated by the backlight brightness adjustment circuits 21 of the other is not used.

In the following, a description is given of an exemplary configuration and operation of the correction point dataset feeding circuit 14 in each driver IC 6-*i*. The correction point dataset feeding circuit 14 includes a feature data operation circuitry 22, a calculation result memory 23 and a correct ion point data calculation circuitry 24.

Figure 10:
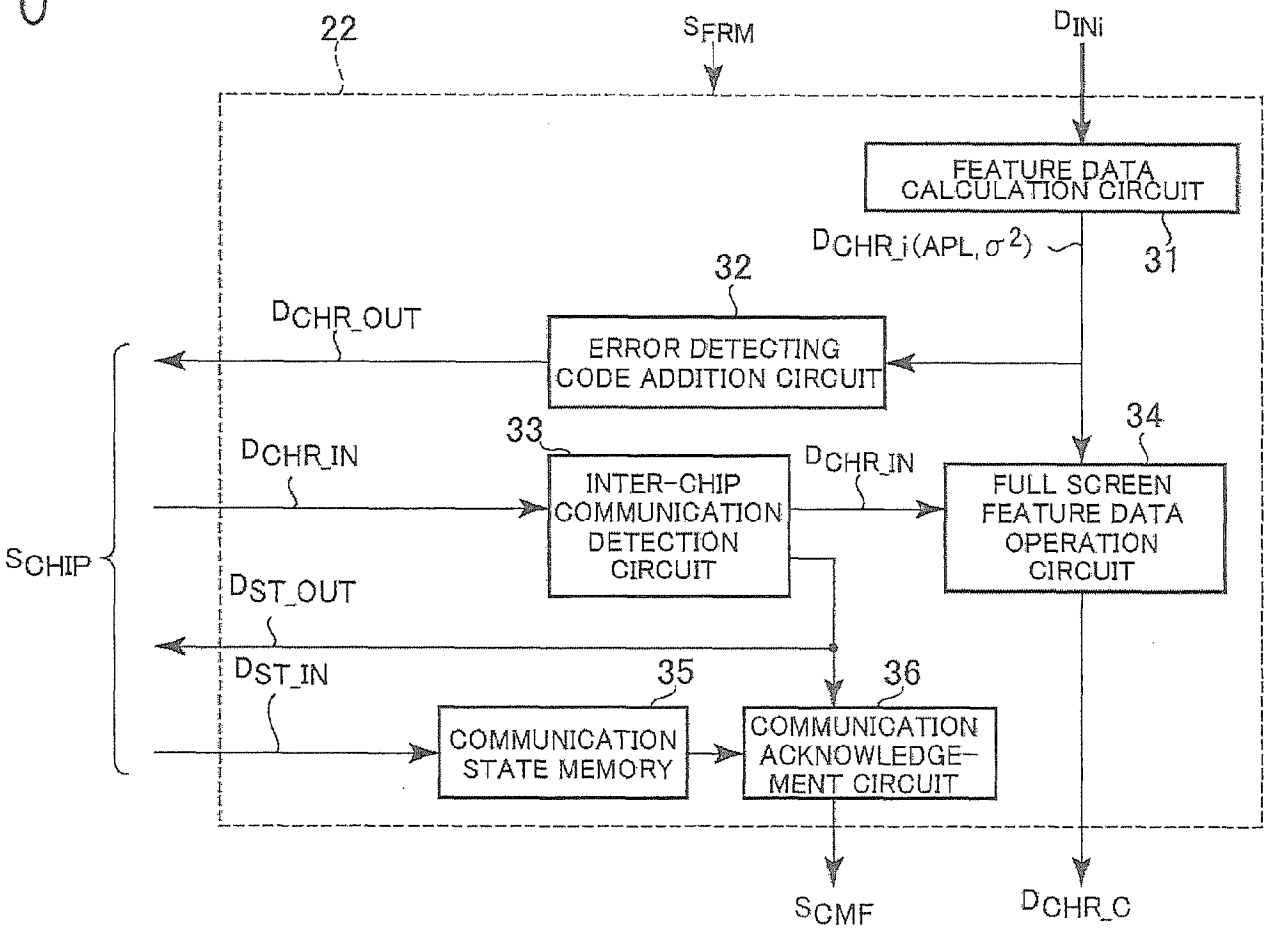
FIG. 10 is a block diagram illustrating an exemplary configuration of a feature data operation circuitry in the first embodiment.

FIG. 10 is the block diagram illustrating an exemplary configuration of the feature data operation circuitry 22. The feature data operation circuitry 22 includes a feature data calculation circuit 31, an error detecting code addition circuit 32, an inter-chip communication detection circuit 33, a full-screen feature data operation circuit 34, a communication state memory 35 and a communication acknowledgement circuit 36.

The feature data calculation circuit 31 in the driver IC 6-*i* calculates the feature value(s) of the partial image displayed on the i-th portion 9-*i* of the display region of the LCD panel 5 in the current frame period and outputs feature data $D_{CHR_i}$ indicating the calculated feature value(s). As mentioned above, in one embodiment, the APL and the mean square value of the grayscale levels of the subpixels in the partial image displayed on the i-th portion 9-*i* calculated for each of the R, G and B subpixels may be used as the feature values exchanged between the driver ICs 6-1 and 6-2. In this case, the feature data $D_{CHR_i}$ include the following data:

(a) the APL of the R subpixels of the partial image displayed on the i-th portion 9-*i* (hereinafter, referred to as "$APL_i^R$");

(b) the APL of the G subpixels of the partial image displayed on the i-th portion 9-*i* (hereinafter, referred to as "$APL_i^G$");

(c) the APL of the B subpixels of the partial image displayed on the i-th portion 9-*i* (hereinafter, referred to as "$APL_i^B$");

(d) the mean square value of the grayscale levels of the R subpixels of the partial image displayed on the i-th portion 9-*i* (hereinafter, referred to as "$<g_R^2>_i$");

(e) the mean square value of the grayscale levels of the G subpixels of the partial image displayed on the i-th portion 9-*i* (hereinafter, referred to as "$<g_G^2>_i$"); and (f) the mean square value of the grayscale levels of the B subpixels of the partial image displayed on the i-th portion 9-*i* (hereinafter, referred to as "$<g_B^2>_i$]).

When the grayscale level of each R subpixel of the partial image displayed on the i-th portion 9-*i* is assumed as $g_{jR}$, the APL and the mean square value of the grayscale levels of the R subpixels of the partial image displayed on the i-th portion 9-*i* are calculated by the following expressions:

$$APL_i^R=\Sigma g_{jR}/n, \text{ and} \tag{1a}$$

$$<g_R^2>_i=\Sigma(g_{jR})^2/n, \tag{2a}$$

where n is the number of the pixels (namely, the number of the R subpixels) included in the i-th portion 9-*i* of the display region of the LCD panel 5, and Σ represents the sum for the i-th portion 9-*i*.

Similarly, when the grayscale level of each G subpixel of the picture displayed on the i-th portion 9-*i* is assumed as $g_{jG}$, the APL and the mean square value of the grayscale levels of the G subpixels of the partial image displayed on the i-th portion 9-*i* are calculated by the following expressions:

$$APL_i^G=\Sigma g_{jG}/n, \text{ and} \tag{1b}$$

$$<g_G^2>_i=\Sigma(g_{jG})^2/\text{n}. \tag{2b}$$

Furthermore, when the grayscale level of each B subpixel of the partial image displayed on the i-th portion 9-*i* is assumed as $g_{jB}$, the APL and the mean square value of the grayscale levels of the B subpixels of the partial image displayed on the i-th portion 9-*i* are calculated by the following expression:

$$APL_i^B=\Sigma g_{jB}/n, \text{ and} \tag{1b}$$

$$<g_B^2>_i=\Sigma(g_{jB})^2/\text{n}. \tag{2b}$$

When the APL calculated as the average of the brightnesses of the pixels and the mean square value of the brightnesses of the pixels are used as the feature values exchanged between the driver ICs 6-1 and 6-2, on the other hand, the feature data $D_{CHR_i}$ include the following data:

(a) the APL of the pixels of the partial image displayed on the i-th portion 9-*i* (hereinafter, referred to as "$APL_i$"); and (b) the mean square value of the brightnesses of the pixels of the partial image displayed on the i-th portion 9-*i* (hereinafter, referred to as "$<Y^2>_i$").

When the brightness of each pixel of the partial image displayed on the i-th portion 9-*i* is assumed as $Y_j$, the APL and the mean square value of the brightnesses of the pixels of the partial image displayed on the i-th portion 9-*i* are calculated by the following expressions:

$$APL_i=\Sigma Y_j/n, \text{ and} \tag{1d}$$

$$<Y^2>_i=\Sigma(Y_j^2)/n, \tag{2d}$$

where n is the number of the pixels included in the i-th portion 9-*i* of the display region of the LCD panel 5, and Σ represents the sum for the i-th portion 9-*i*.

The thus-calculated feature data $D_{CHR_i}$ are transmitted to the error detecting code addition circuit 32 and the full-screen feature data operation circuit 34.

The error detecting code addition circuit 32 adds an error detecting code to the feature data $D_{CHR_i}$ received from the feature data calculation circuit 31 to generate output feature data $D_{CHR_OUT}$ which are feature data to be transmitted to the other driver IC. The output feature data $D_{CHR_OUT}$ are transferred to the inter-chip communication circuit 13 and transmitted as the inter-chip communication data $D_{CHIP}$ to the other driver IC. When receiving the transmitted output feature data $D_{CHR_OUT}$ as the input feature data $D_{CHR_IN}$ the other driver IC can judge whether the input feature data $D_{CHR_IN}$ has been successfully received by using the error detecting code included in the output feature data $D_{CHR_OUT}$.

The inter-chip communication detection circuit 33 receives the input feature data $D_{CHR_IN}$, which are the feature data transmitted by the other driver IC, from the inter-chip communication circuit 13 and performs an error detection on the received input feature data $D_{CHR_IN}$ to judge whether the input feature data $D_{CHR_IN}$ has been successfully received. The inter-chip communication detection circuit 33 further outputs the judgment result as the communication state notification data $D_{ST_OUT}$. The communication state notification data $D_{ST_OUT}$ include communication ACK (acknowledged) data which indicate that the communication has been successfully completed or communication NG (no good) data which indicate that the communication has been unsuccessfully completed.

In detail, the input feature data $D_{CHR_IN}$ received from the other driver IC include an error detecting code added by the error detecting code addition circuit 32 in the other driver IC. The inter-chip communication detection circuit 33 performs the error detection on the input feature data $D_{CHR_IN}$ received from the other driver IC by using this error detecting code. If not detecting a data error in the input feature data $D_{CHR_IN}$, the inter-chip communication detection circuit 33 judges that the input feature data $D_{CHR_IN}$ has been successfully received and outputs communication ACK data as the communication state notification data $D_{sT_OUT}$. When detecting a data error for which error correction is impossible, on the other hand, the inter-chip communication detection circuit 33 outputs communication NG data as the communication state notification data $D_{sT_OUT}$. The outputted communication state notification data $D_{sT_OUT}$ are transferred to the communication acknowledgement circuit 36. In addition, the inter-chip communication detection circuit 33 transfers the communication state notification data $D_{sT_OUT}$ to the inter-chip communication circuit 13. The communication state notification data $D_{sT_OUT}$ transferred to the inter-chip communication circuit 13 are transmitted as the inter-chip communication data $D_{CHIP}$ to the other driver IC.

An error correctable code may be used as the error detecting code. In such a case, when detecting a data error for which error correction is possible, the inter-chip communication detection circuit 33 performs an error correction and outputs the input feature data $D_{CHR_IN}$ for which the data error is corrected. In this case, the inter-chip communication detection circuit 33 judges that the communication has been successfully completed and outputs communication ACK data as the communication state notification data $D_{ST_OUT}$. If detecting a data error for which error correction is impossible, on the other hand, the inter-chip communication detection circuit 33 outputs communication NG data as the communication state notification data $D_{ST_OUT}$.

The full-screen feature data operation circuit 34 calculates the feature value(s) of the entire image displayed on the display region of the LCD panel 5, from the feature data $D_{CHR_i}$ calculated by the feature data calculation circuit 31 and the input feature data $D_{CHR_IN}$ received from the inter-chip communication detection circuit 33 and generates full-screen feature data $D_{CHR_C}$ that indicate the calculated feature value(s). Here, the full-screen feature data $D_{CHR_C}$ indicate the feature value(s) of the entire image displayed on the display region of the LCD panel 5 in the current frame period. When this fact is emphasized, the full-screen feature data $D_{CHR_C}$ are referred to as "current-frame full-screen feature data $D_{CHR_C}$", hereinafter.

When the APL and the mean square value of the grayscale levels of the subpixels for each color are used as the feature values exchanged between the driver ICs 6-1 and 6-2, the full-screen feature data operation circuit 34 calculates the APL and the mean square value of the grayscale levels of the subpixels with respect to the entire image displayed on the display region of the LCD panel 5 for each color. The full-screen feature data operation circuit 34 further calculates the variance $\sigma^2$ of the grayscale levels of the subpixels with respect to the entire image displayed on the display region of the LCD panel 5 for each color, from the APL and the mean square value of the grayscale levels of the subpixels in the entire image displayed on the display region of the LCD panel 5, which are calculated for each color. In this case, the current-frame full-screen feature data $D_{CHR_C}$ generated by the full-screen feature data operation circuit 34 include the following data:

(a) the APL calculated for the R subpixels in the entire display region of the LCD panel 5 (hereinafter, referred to as "$APL_{AVE_R}$");
(b) the APL calculated for the G subpixels in the entire display region of the LCD panel 5 (hereinafter, referred to as "$APL_{AVE_G}$");
(c) the APL calculated for the B subpixels in the entire display region of the LCD panel 5 (hereinafter, referred to as "$APL_{AVE_B}$");
(d) the variance of the grayscale levels of the R subpixels in the entire display region of the LCD panel 5 (hereinafter, referred to as "$\sigma_{AVE_R}^2$");
(e) the variance of the grayscale levels of the G subpixels in the entire display region in the LCD panel 5 (hereinafter, referred to as "$\sigma_{AVE_G}^2$"); and
(f) the variance of the grayscale levels of the B subpixels in the entire display region in the LCD panel 5 (hereinafter, referred to as "$\sigma_{AVE_B}^2$").

The calculations of $APL_{AVE_R}$, $APL_{AVE_G}$, $APL_{AVE_B}$, $\sigma_{AVE_R}^2$, $\sigma_{AVE_2}$, and $\sigma_{AVE_B}^2$ are carried out as follows. First, a consideration is given of the full-screen feature data operation circuit 34 in the driver IC 6-1.

The full-screen feature data operation circuit 34 in the driver IC 6-1 receives the feature data $D_{CHR_1}$ calculated by the feature data calculation circuit 31 in the driver IC 6-1 and the feature data $D_{CHR_2}$ received as the input feature data $D_{CHR_IN}$ from the driver IC 6-2 (which are calculated by the feature data calculation circuit 31 in the driver IC 6-2). The full-screen feature data operation circuit 34 in the driver IC 6-1 calculates $APL_{AVE_R}$ as the average value of the APL of the R subpixels of the partial image displayed on the first portion 9-1 (that is, $APL_1^R$), which is described in the feature data $D_{CHR_1}$, and the APL of the R subpixels of the partial image displayed on the second portion 9-2 (that is, $APL_2^R$), which are described in the feature data $D_{CHR_2}$ (that is, the input feature data $D_{CHR_IN}$). In other words, it holds:

$$APL_{AVE_R}=(APL_1^R+APL_2^R)/2. \tag{3a}$$

Similarly, $APL_{AVE_G}$ and $APL_{AVE_B}$ are calculated as follows:

$$APL_{AVE_G}=(APL_1^G+APL_2^G)/2, \text{ and} \tag{3b}$$

$$APL_{AVE_B}=(APL_1^B+APL_2^B)/2. \tag{3c}$$

Also, the full-screen feature data operation circuit 34 in the driver IC 6-1 calculates the mean square value $<g_R^2>_{AVE}$ of the grayscale levels of the R subpixels with respect to the entire image displayed on the display region of the LCD panel 5 as the average value of the mean square value $<g_R^2>_1$ of the grayscale levels of the R subpixels of the partial image displayed on the first portion 9-1, which is described in the feature data $D_{CHR_1}$, and the mean square value $<g_R^2>_2$ of the grayscale levels of the R subpixels of the partial image displayed on the second portion 9-2, which is described in the feature data $D_{CHR_2}$ (namely, the input feature data $D_{CHR_IN}$). In other words, it holds:

$$<g_R^2>_{AVE}=(<g_R^2>_1+<g_R^2>_2)/2. \tag{4a}$$

Similarly, the mean square values $<g_G^2>_{AVE}$ and $<g_B^2>_{AVE}$ of the grayscale levels of the G subpixels and the B subpixels with respect to the entire image displayed on the display region of the LCD panel 5 are obtained by the following expressions:

$$<g_G^2>_{AVE}=(<g_G^2>_1+<g_G^2>_2)/2, \text{ and} \tag{4b}$$

$$<g_B^2>_{AVE}=(<g_B^2>_1+<g_B^2>_2)/2. \tag{4c}$$

Furthermore, $\sigma_{AVE_R}^2$, $\sigma_{AVE_G}^2$ and $\sigma_{AVE_B}^2$ are calculated by the following expressions:

$$\sigma_{AVE_R}^2=<g_R^2>_{AVE}-(APL_{AVE_R})^2, \tag{5a}$$

$$\sigma_{AVE_G}^2=<g_G^2>_{AVE}-(APL_{AVE_G})^2, \text{ and} \tag{5b}$$

$$\sigma_{AVE_B}^2=<g_B^2>_{AVE}-(APL_{AVE_B})^2. \tag{5c}$$

It would be easily understood by the person skilled in the art that the full-screen feature data operation circuit 34 in the driver IC 6-2 calculates $APL_{AVE_R}$, $APL_{AVE_G}$, $APL_{AVE_B}$, $\sigma_{AVE_R}^2$, $\sigma_{AVE_G}^2$, and $\sigma_{AVE_B}^2$ in the similar way.

When the APL calculated as the average value of the brightnesses of the pixels and the mean square value of the brightnesses of the pixels are used as the feature values exchanged between the driver ICs 6-1 and 6-2, on the other hand, the full-screen feature data operation circuit 34 calculates the APL and the mean square value of the brightness of the pixels with respect to the entire image displayed on the display region of the LCD panel 5. In this case, the APL is defined as the average value of the brightnesses of the pixels of the entire image displayed on the display region of the LCD panel 5. The full-screen feature data operation circuit 34 further calculates the variance $\sigma^2$ of the brightnesses of the pixels with respect to the entire image displayed on the display region of the LCD panel 5 from the APL and the mean square value of the brightnesses of the pixels of the entire image displayed on the display region of the LCD panel 5 In this case, the current-frame full-screen feature data $D_{CHR_C}$ generated by the full-screen feature data operation circuit 34 include the following data:

(a) the APL calculated for the pixels in the entire display region of the LCD panel 5 (hereinafter, referred to as "$APL_{AVE}$"); and (b) the variance of the brightnesses of the pixels in the entire display region of the LCD panel 5 (hereinafter, referred to as "$\sigma_{AVE}^2$").

The calculations of the $APL_{AVE}$ and $\sigma_{AVE}^2$ in each of the driver ICs 6-1 and 6-2 are performed as follows. The full-screen feature data operation circuit 34 in the driver IC 6-1 receives the feature data $D_{CHR_1}$ calculated by the feature data calculation circuit 31 in the driver IC 6-1, and the feature data $D_{CHR_2}$ received as the input feature data $D_{CHR_IN}$ from the driver IC 6-2 (which are calculated by the feature data calculation circuit 31 in the driver IC 6-2). The full-screen feature data operation circuit 34 in the driver IC 6-1 calculates the $APL_{AVE}$ as the average value of the APL of the pixels of the partial image displayed on the first portion 9-1 (that is, "$APL_1$"), which is described in the feature data $D_{CHR_1}$, and the APL of the pixels of the partial image displayed on the second portion 9-2 (that is, "$APL_2$"), which is described in the feature data $D_{CHR_2}$ (namely, the input feature data $D_{CHR_IN}$). In other words, it holds:

$$APL_{AVE}=(APL_1+APL_2)/2. \tag{3d}$$

Also, the full-screen feature data operation circuit 34 in the driver IC 6-1 calculates the mean square value $<Y^2>_{AVE}$ of the brightnesses of the pixels with respect to the entire image displayed on the display region of the LCD panel 5, as the average value of the mean square values $<Y^2>_1$ of the brightnesses of the pixels of the partial image displayed on the first portion 9-1, which is described in the feature data $D_{CHR_1}$, and the mean square value $<Y^2>_2$ of the brightnesses of the pixels of the partial image displayed on the second portion 9-2, which is described in the feature data $D_{CHR_2}$ (namely, the input feature data $D_{CHR_IN}$). In other words, it holds:

$$<Y^2>_{AVE}=(<Y^2>_1+<Y^2>2)/2. \tag{4d}$$

Furthermore, $\sigma_{AVE}^2$ is calculated by the following expression:

$$\sigma_{AVE}^2=<Y^2>_{AVE}-(APL_{AVE})^2. \tag{5d}$$

It would be easily understood by the person skilled in the art that the full-screen feature data operation circuit 34 in the driver IC 6-2 calculates $APL_{AVE}$ and $\sigma_{AVE}^2$ in the similar way.

As thus described, the current-frame full-screen feature data $D_{CHR_C}$ are calculated in both of the driver ICs 6-1 and 6-2, and the calculated current-frame full-screen feature data $D_{CHR_C}$ are transferred to the calculation result memory 23 and the correction point data calculation circuitry 24.

The communication state memory 35 receives the communication state notification data $D_{ST_IN}$, which are received from the other driver IC, from the inter-chip communication circuit 13 to temporarily store therein. The communication state notification data $D_{ST_IN}$ indicate whether the other driver IC has successfully received the input feature data $D_{CHR_IN}$ and include communication ACK data or communication NG data. The communication state notification data $D_{ST_IN}$ stored in the communication state memory 35 is transferred to the communication acknowledgement circuit 36.

The communication acknowledgement circuit 36 judges whether the feature data have been successfully exchanged by the communications between the driver ICs 6-1 and 6-2, on the basis of the communication state notification data $D_{ST_OUT}$ received from the inter-chip communication detection circuit 33 and the communication state notification data $D_{ST_IN}$ received from the communication state memory 35. When both of the communication state notification data $D_{ST_OUT}$ and the communication state notification data $D_{ST_IN}$ include communication ACK data in a certain frame period, the communication acknowledgement circuit 36 judges that the feature data have been successfully exchanged by the communications between the driver ICs 6-1 and 6-2 in the certain frame period and asserts a communication acknowledgement signal $S_{CMF}$. When at least one of the communication state notification data $D_{ST_OUT}$ and the communication state notification data $D_{ST_IN}$ includes communication NG data in a certain frame period, the communication acknowledgement circuit 36 judges that the feature data have not successfully exchanged by the communications between the driver ICs 6-1 and 6-2 in the certain frame period and negates the communication acknowledgement signal $S_{CMF}$.

Referring back to FIG. 7, the calculation result memory 23 has the function of capturing and storing the full-screen feature data $D_{CHR_C}$ in response to the communication acknowledgement signal $S_{CMF}$. In a frame period in which the communication acknowledgement signal $S_{CMF}$ is asserted (namely, in a frame period in which the communications between the driver ICs 6-1 and 6-2 are successfully completed), the full-screen feature data $D_{CHR_C}$ are stored in the calculation result memory 23. On the other hand, in a frame period in which the communication acknowledgement signal $S_{CMF}$ is negated, the contents of the calculation result memory 23 are not updated. That is, the calculation result memory 23 stores the full-screen feature data $D_{CHR_C}$ which are calculated in the last frame period in which the communications between the driver ICs 6-1 and 6-2 have been successfully completed at the beginning of each frame period. Hereinafter, the full-screen feature data $D_{CHR_C}$ stored in the calculation result memory 23 are referred to as previous-frame full-screen feature data $D_{CHR_P}$. The previous-frame full-screen feature data $D_{CHR_P}$ are supplied to the correction point data calculation circuitry 24.

It should be noted that the previous-frame full-screen feature data $D_{CHR_P}$ are not limited to the full-screen feature data $D_{CHR_C}$ calculated for the frame period just before the current frame period. For example, when the communications between the driver ICs 6-1 and 6-2 have not successfully completed for two frame periods including the current frame period, the full-screen feature data $D_{CHR_C}$ calculated two frame periods earlier are stored as the previous-frame full-screen feature data $D_{CHR_P}$ and supplied to the correction point data calculation circuitry 24.

The correction point data calculation circuitry 24 schematically performs the following operations: The correction point data calculation circuitry 24 selects the current-frame full-screen feature data $D_{CHR_C}$ or the previous-frame full-screen feature data $D_{CHR_P}$ in response to the communication acknowledgement signal $S_{CMF}$ and supplies the correction point dataset $CP_sel^k$ generated depending on the selected full-screen feature data to the approximate calculation correction circuit 15. In detail, the correction point data calculation circuitry 24 determines the correction point dataset $CP_sel^k$ by using the current-frame full-screen feature data $D_{CHR_C}$ in frame periods in which the communication acknowledgement signal $S_{CMF}$ is asserted (namely, in frame periods in which the communications between the driver ICs 6-1 and 6-2 have been successfully completed). On the other hand, the previous-frame full-screen feature data $D_{CHR_P}$ stored in the calculation result memory 23 are used to determine the correction point dataset $CP_sel^k$ in frame periods in which the communication acknowledgement signal $S_{CMF}$ is negated (namely, in frame periods in which the communications between the driver ICs 6-1 and 6-2 have not been successfully completed).

Such operations are performed in the correction point data calculation circuitry 24 in each of the driver ICs 6-1 and 6-2. As a result, in each of the driver ICs 6-1 and 6-2, the previous-frame full-screen feature data $D_{CHR_P}$ generated in the last frame period in which the communications between the driver ICs 6-1 and 6-2 have been successfully completed are used to determine the correction point dataset $CP_sel^k$ in frame periods in which the communications between the driver ICs 6-1 and 6-2 have been unsuccessfully completed. This effectively resolves the problem that a boundary is potentially visually perceived between the first and second portions 9-1 and 9-2 of the display region of the LCD panel 5, due to different correction calculations performed by the driver ICs 6-1 and 6-2.

Figure 11:
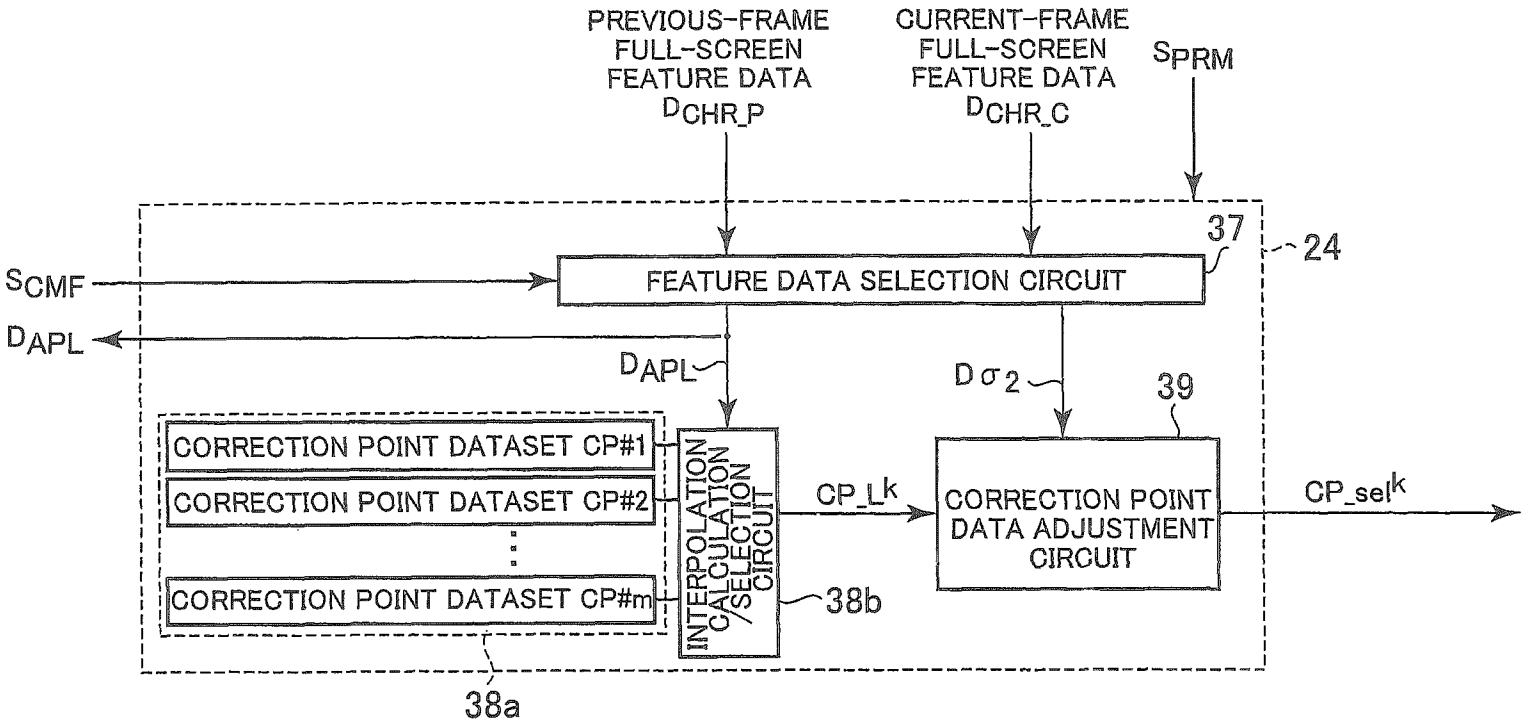
FIG. 11 is a block diagram illustrating an exemplary configuration of a correction point data calculation circuitry in the first embodiment.

FIG. 11 is a block diagram illustrating an exemplary configuration of the correction point data calculation circuitry 24. The correction point data calculation circuitry 24 includes a feature data selection circuit 37, a correction point dataset storage register 38*a*, an interpolation calculation/selection circuit 38*b* and a correction point data adjustment circuit 39.

The feature data selection circuit 37 has the function of selecting the current-frame full-screen feature data $D_{CHR_C}$ or the previous-frame full-screen feature data $D_{CHR_P}$ in response to the communication acknowledgement signal $S_{CMF}$. The feature data selection circuit 37 outputs the APL data $D_{APL}$ that indicate the APL(s) and the variance data $D\tau_2$ that indicate the variance(s) $\tau^2$ included in the selected full-screen feature data. The APL data $D_{APL}$ are transmitted to the interpolation calculation/selection circuit 38*b*, and the variance data $D\tau_2$ are transmitted to the correction point data adjustment circuit 39.

When the combination of the APL and the mean square value of the grayscale levels of the subpixels calculated for each color are used as the feature values exchanged between the driver ICs 6-1 and 6-2, the APL data $D_{APL}$ are generated to describe $APL_{AVE_R}$ calculated for the R subpixels, $APL_{AVE_G}$ calculated for the G subpixels, and $APL_{AVE_B}$ calculated for the B subpixels in the entire display region in the LCD panel 5. Here, the APL data $D_{APL}$ are generated as t3M-bit data which represent each of $APL_{AVE_R}$, $APL_{AVE_G}$ and $APL_{AVE_B}$ with M bits, where M is a natural number. Also, the variance data $D\sigma_2$ are generated to describe the variance $\sigma_{AVE_R}^2$ of the grayscale levels calculated for the R subpixels, the variance $\sigma_{AVE_G}^2$ of the grayscale levels calculated for the G subpixels, and the variance $\sigma_{AVE_B}^2$ of the grayscale levels calculated for the B subpixels in the entire display region of the LCD panel 5.

When the combination of the APL calculated as the average value of the brightnesses of the pixels and the mean square value of the brightnesses of the pixels is used as the feature values exchanged between the driver ICs 6-1 and 6-2, on the other hand, the APL data $D_{APL}$ include $APL_{AVE}$ calculated as the average value of the brightnesses of the pixels for the entire display region in the LCD panel 5, and the variance data $D\sigma_2$ include the variance $\sigma_{AVE}^2$ of the brightnesses of the pixels calculated for the entire display region of the LCD panel 5. Here, the APL data $D_{APL}$ are generated as M-bit data which represent $APL_{AVE}$ with M bits, where M is a natural number.

The APL data $D_{APL}$ are also transmitted to the above-described backlight brightness adjustment circuit 21 and used to generate the brightness control signal $S_{SPWM}$. That is, the brightness of the LED backlight 8 is controlled in response to the APL data $D_{APL}$. When the combination of the APL and the mean square value of the grayscale levels of the subpixels calculated for each color is used as the feature values exchanged between the driver ICs 6-1 and 6-2, the RGB-YUV transform is performed on $APL_{AVE_R}$, $APL_{AVE_G}$ and $APL_{AVE_B}$ and the brightness control signal $S_{PWM}$ is generated in response to brightness data $Y_{AVE}$ obtained by the RGB-YUV transform. That is, the brightness of the LED backlight 8 is controlled in response to the brightness data $Y_{AVE}$. When the combination of the APL calculated as the average value of the brightnesses of the pixels and the mean square value of the brightnesses of the pixels is used as the feature values exchanged between the driver ICs 6-1 and 6-2, on the other hand, the brightness control signal $S_{PWM}$ is generated in response to $APL_{AVE}$ described in the APL data $D_{APL}$. That is, the brightness of the LED backlight 8 is controlled in response to $APL_{AVE}$.

The correction point dataset storage register 38*a* stores a plurality of correction point datasets CP#1 to CP#m used as source data to calculate the correction point datasets $CP_sel^R$, $CP_sel^G$ and $CP_sel^B$, which are finally fed to the approximate calculation correction circuit 15. The correction point datasets CP#1 to CP#m are associated with different gamma values γ, and each of the correction point datasets CP#1 to CP#m includes the correction point data CP0 to CP5.

The correction point data CP0 to CP5 of a correction point dataset CP#i associated with a certain gamma value γ are calculated as follows:

(1) For γ<1, $$CP0 = 0 \tag{6a}$$

$$CP1 = \frac{4 \cdot \mathrm{Gamma}[K/4] - \mathrm{Gamma}[K]}{2}$$

$$CP2 = \mathrm{Gamma}[K-1]$$

$$CP3 = \mathrm{Gamma}[K]$$

$$CP4 = 2 \cdot \mathrm{Gamma}[(D_{IN}^{MAX} + K - 1)/2] - D_{OUT}^{MAX}$$

$$CP5 = D_{OUT}^{MAX}$$

and (2) for γ≥1

$$CP0=0$$

$$CP1=2\cdot\mathrm{Gamma}[K/2]-\mathrm{Gamma}[K]$$

$$CP2=\mathrm{Gamma}[K-1]$$

$$CP3=\mathrm{Gamma}[K]$$

$$CP4=2\cdot\mathrm{Gamma}[(D_{IN}^{MAX}+K-1)/2]-D_{OUT}^{MAX}$$

$$CP5=D_{OUT}^{MAX} \tag{6b}$$

where $D_{IN}^{MAX}$ is the allowed maximum value of the input image data $D_{INi}$, and $D_{OUT}^{MAX}$ is the allowed maximum value of the output image data $D_{OUT}$. K is a constant given by the following expression:

$$K=(D_{IN}^{MAX}+1)/2, \text{ and} \tag{7}$$

Gamma [x] is a function that represents the strict expression of the gamma correction and is defined by the following expression:

$$\mathrm{Gamma}[x]=D_{OUT}^{MAX}\cdot(x/D_{IN}^{MAX})^{\gamma} \tag{8}$$

In this embodiment, the correction point datasets CP#1 to CP#m are determined so that the gamma value γ in expression (8) is increased as j increases for the correction point dataset CP#j of the correction point datasets CP#1 to CP#m. That is, it holds:

$$\gamma_1<\gamma_2<\ldots<\gamma_{m-1}\gamma_m, \quad (9)$$

where $\gamma_j$ is the gamma value defined for the correction point dataset CP#j.

The number of the correction point datasets CP#1 to CP#m stored in the correction point dataset storage register 38*a* is $2^{M-(N-1)}$, where M is the number of the bits used to describe each of $APL_{AVE_R}$, $APL_{AVE_G}$ and $APL_{AVE_B}$ in the APL data $D_{APL}$ as described above, and N is a predetermined integer that is more than one and less than M. This implies that $m=2^{M-(N-1)}$. The correction point datasets CP#1 to CP#m stored in the correction point dataset storage register 38*a* may be supplied to each driver IC 6-*i* from the CPU 4 as an initial setting.

The interpolation calculation/selection circuit 38*b* has the function of determining correction point datasets $CP_L^R$, $CP_L^G$ and $CP_L^B$ in response to the APL data $D_{APL}$. The correction point datasets $CP_L^R$, $CP_L^G$ and $CP_L^B$ are intermediate data used to calculate the correction point datasets $CP_sel^R$, $CP_sel^G$ and $CP_sel^B$, which are finally fed to the approximate calculation correction circuit 15, each including the correction point data CP0 to CP4. The correction point datasets $CP_L^R$, $CP_L^G$ and $CP_L^B$ may be collectively referred to as correction point dataset $CP_L^k$, hereinafter.

In detail, in one embodiment, when the APL data $D_{APL}$ are generated to describe $APL_{AVE_R}$, $APL_{AVE_G}$ and $APL_{AVE_B}$ which are calculated for the R subpixel, the G subpixel and the B subpixel, respectively, the interpolation calculation/selection circuit 38*b* may select one of the above-described correction point datasets CP#1 to CP#m on in response to $APL_{AVE_k}$="R", "G" or "B") and determine the selected correction point dataset as the correction point dataset $CP_L^k$ (k="R", "G" or "B").

Alternatively, the interpolation calculation/selection circuit 38*b* may determine the correction point dataset $CP_L^k$ (k="R", "G" or "B") as follows: The interpolation calculation/selection circuit 38*b* selects two correction point datasets, which are referred to as correction point datasets CP#q and CP#(q+1), hereinafter, out of the correction point datasets CP#1 to CP#m stored in the correction point dataset storage register 38*a* in response to $APL_{AVE_k}$ described in the APL data $D_{APL}$, where q is a certain natural number from one to m−1. Moreover, the interpolation calculation/selection circuit 38*b* calculates the correction point data CP0 to CP5 of the correction point dataset $CP_L^k$ by an interpolation of the correction point data CP0 to CP5 of the selected two correction point datasets CP#q and CP#(q+1), respectively. The calculation of the correction point data CP0 to CP5 of the correction point dataset $CP_L^k$ through the interpolation calculation of the correction point data CP0 to CP5 of the selected two correction point datasets CP#q and CP#(q+1) advantageously allows finely adjusting the gamma value used for the gamma correction, even if the number of the correction point datasets CP#1 to CP#m stored in the correction point dataset storage register 38*a* is reduced.

When $APL_{AVE}$ calculated as the average value of the brightnesses of the pixels is described in the APL data $D_{APL}$, on the other hand, the interpolation calculation/selection circuit 38*b* may select one of the above correction point datasets CP#1 to CP#m in response to $APL_{AVE}$ and determine the selected correction point dataset as the correction point datasets $CP_L^R$, $CP_L^G$ and $CP_L^B$. In this case, the correction point datasets $CP_L^R$, $CP_L^G$ and $CP_L^B$ are equal to one another, all of which are equal to the selected correction point dataset.

Alternatively, the interpolation calculation/selection circuit 38*b* may determine the correction point datasets $CP_L^R$, $CP_L^G$ and $CP_L^B$ as follows. The interpolation calculation/selection circuit 38*b* selects two correction point datasets CP#q and CP4(q+1) out of the correction point datasets CP#1 to CP#m stored in the correction point dataset storage register 38*a* in response to $APL_{AVE}$ described in the APL data $D_{APL}$, where q is an integer from one to m−1. Furthermore, the interpolation calculation/selection circuit 38*b* calculates the correction point data CP0 to CP5 of each of the correction point datasets $CP_L^R$, $CP_L^G$ and $CP_L^B$ through an interpolation calculation of the correction point data CP0 to CP5 of the selected two correction point datasets CP#q and CP#(q+1), respectively. Also in this case, the correction point datasets $CP_L^R$, $CP_L^G$ and $CP_L^B$ are equal to one another. The calculation of the correction point data CP0 to CP5 of the correction point datasets $CP_L^R$, $CP_L^G$ and $CP_L^B$ through the interpolation calculation of the correction point data CP0 to CP5 of the selected two correction point datasets CP#q and CP#(q+1) advantageously allows finely adjusting the gamma value used for the gamma correction, even if the number of the correction point datasets CP#1 to CP#m stored in the correction point dataset storage register 38*a* is reduced.

The above-described interpolation calculation performed in determining the correction point datasets $CP_L^R$, $CP_L^G$ and $CP_L^B$ will be described later in detail.

The correction point datasets $CP_L^R$, $CP_L^G$ and $CP_L^B$ determined by the interpolation calculation/selection circuit 38*b* are transmitted to the correction point data adjustment circuit 39.

The correction point data adjustment circuit 39 modifies the correction point datasets $CP_L^R$, $CP_L^G$ and $CP_L^B$ in response to the variance data $D_{a2}$ received from the feature data selection circuit 37 to calculate the correction point datasets $CP_sel^R$, $CP_sel^G$ and $CP_sel^B$, which are finally fed to the approximate calculation correction circuit 15.

In detail, when the variance data $D_{\sigma 2}$ is generated to describe the variance $\sigma_{AVE_R}^2$ of the grayscale levels of the R subpixels, the variance. $\sigma_{AVE_G}^2$ of the grayscale levels of the G subpixels and the variance $\sigma_{AVE_B}^2$ of the grayscale of the B subpixels in the entire display region of the LCD panel 5, the correction point data adjustment circuit 39 calculates the correction point datasets $CP_sel^R$, $CP_sel^G$ and $CP_sel^B$ as follows. The correction point data adjustment circuit 39 modifies the correction point data CP1 and CP4 of the correction point dataset $CP_L^R$ in response to the variance $\sigma_{AVE_R}^2$ calculated for the R subpixels. The modified correction point data CP1 and CP4 are used as the correction point data CP1 and CP4 of the correction point dataset $CP_sel^R$. The correction point data CP0, CP2, CP3 and CP5 of the correction point dataset $CP_L^R$ are used as the correction point data CP0, CP2, CP3 and CP5 of the correction point dataset $CP_sel^R$, as they are.

Similarly, the correction point data adjustment circuit 39 modifies the correction point data CP1 and CP4 of the correction point dataset $CP_L^G$ in response to the variance $\sigma_{AVE_G}^2$ of the grayscale levels of the G subpixels. The modified correction point data CP1 and CP4 are used as the correction point data CP1 and CP4 of the correction point dataset $CP_sel^G$. Furthermore, the correction point data adjustment circuit 39 modifies the correction point data CP1 and CP4 of the correction point dataset $CP_L^B$ in response to the variance $\sigma_{AVE_B}^2$ of the grayscale levels of the B subpixels. The modified correction point data CP1 and CP4 are used as the correction point data CP1 and CP4 of the correction point dataset $CP_sel^B$. The correction point data CP0, CP2, CP3 and CP5 of the correction point datasets $CP_L^G$ and $CP_L^B$ are used as the correction point data CP0, CP2, CP3 and CP5 of the correction point datasets $CP_sel^G$ and $CP_sel^B$ as they are.

When the variance data $D_{\sigma 2}$ are generated to describe the variance $\sigma_{AVE}^2$ of the brightnesses of the pixels in the entire display region of the LCD panel 5, on the other hand, the correction point data adjustment circuit 39 modifies the correction point data CP1 and CP4 of the correction point datasets $CP_L^R$, $CP_L^G$ and $CP_L^B$ in response to the variance $\sigma_{AVE}^2$. The modified correction point data CP1 and CP4 are used as the correction point data CP1 and CP4 of the correction point datasets $CP_sel^R$, $CP_sel^G$ and $CP_sel^B$. The correction point data CP0, CP2, CP3 and CP5 of the correction point datasets $CP_L^R$, $CP_L^G$ and $CP_L^B$ are used as the correction point data CP0, CP2, CP3 and CP5 of the correction point datasets $CP_sel^R$, $CP_sel^G$ and $CP_sel^B$ as they are. In this case, the correction point datasets $CP_L^R$, $CP_L^G$ and $CP_L^B$ are equal to one another, and thus the correction point datasets $CP_sel^R$, $CP_sel^G$ and $CP_sel^B$ thus generated are also equal to one another.

The calculation of the correction point datasets $CP_sel^R$, $CP_sel^G$ and $CP_sel^B$ by modifying the correction point datasets $CP_L^R$, $CP_L^G$ and $CP_L^B$ will be described later in detail.

Figure 12:
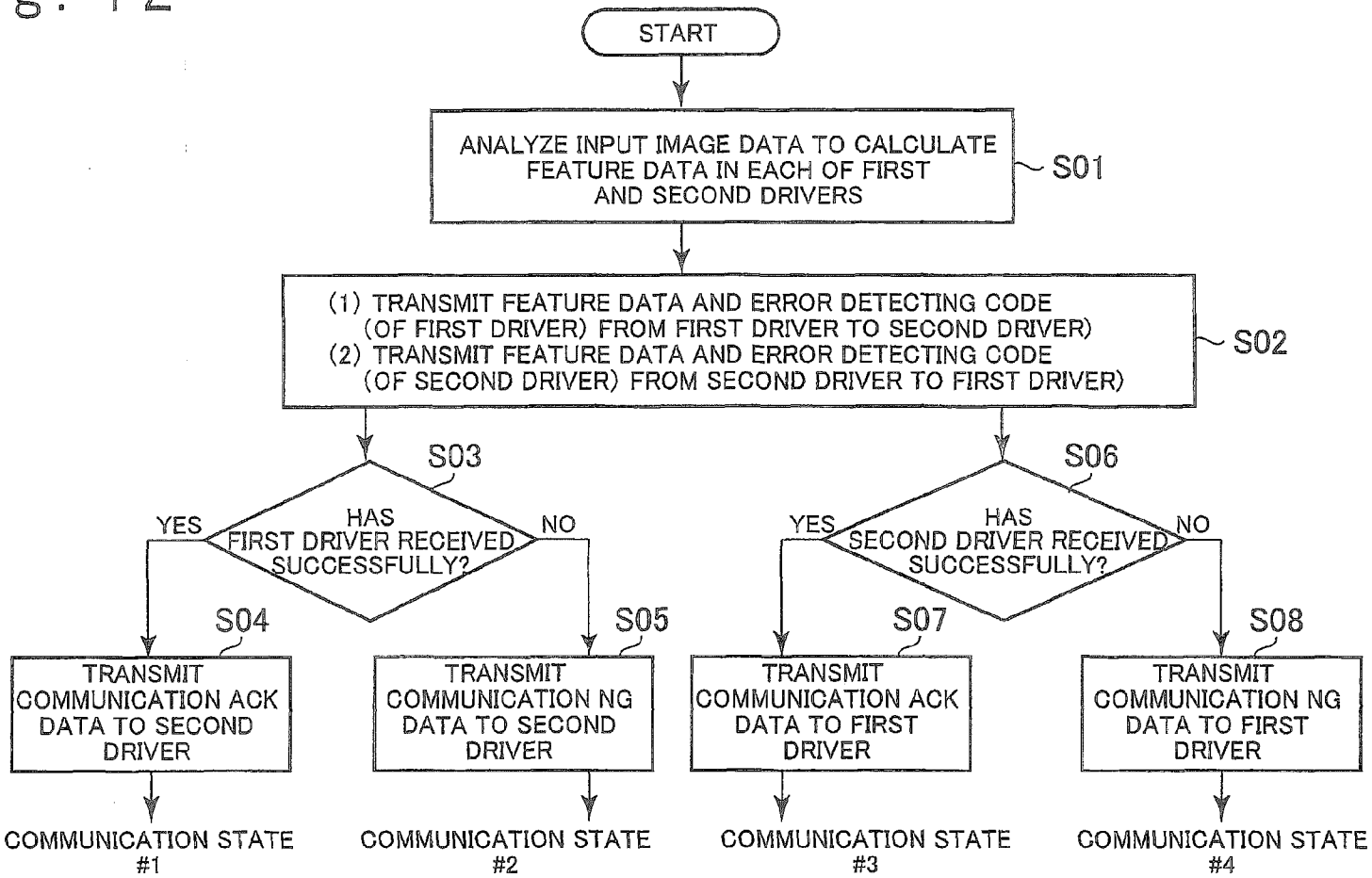
FIG. 12 is a flowchart illustrating exemplary operations of the driver IC in each frame period.

In the following, a description is given of an exemplary operation of the liquid crystal display device in this embodiment, especially, exemplary operations of the driver ICs 6-1 and 6-2. FIG. 12 is a flowchart illustrating exemplary operations of the driver IC 6-1 (first driver) and the driver IC 6-2 (second driver) in each frame period.

The feature data calculation circuits 31 of the feature data operation circuitries 22 in the driver ICs 6-1 and 6-2 analyze the input image data $D_{IN1}$ and $D_{IN2}$ and calculate the feature data $D_{CHR_1}$ and $D_{CHR_2}$, respectively (Step S01). As described above, the feature data $D_{CHR_1}$, which indicate the feature values of the partial image displayed on the first portion 9-1 of the LCD panel 5, are calculated from the input image data $D_{IN1}$ supplied to the driver IC 6-1. Similarly, the feature data $D_{CHR_2}$, which indicate the feature value of the picture displayed on the second portion 9-2 in the LCD panel 5, are calculated from the input image data $D_{IN2}$ supplied to the driver IC 6-2.

This is followed by transmitting the feature data $D_{CHR_1}$, which is calculated by the driver IC 6-1, from the driver IC 6-1 to the driver IC 6-2, and transmitting the feature data $D_{CHR_2}$, which is calculated by the driver IC 6-2, from the driver IC 6-2 to the driver IC 6-1 (Step S02). In detail, the driver IC 6-1 transmits the output feature data $D_{CHR_OUT}$ generated by adding the error detecting code to the feature data $D_{CHR_1}$ calculated by the feature data calculation circuit 31, to the driver IC 6-2. The addition of the error detecting code is achieved by the error detecting code addition circuit 32. The driver IC 6-2 receives the output feature data $D_{CHR_OUT}$, which is transmitted from the driver IC 6-1, as the input feature data $D_{CHR_IN}$. Similarly, the driver IC 6-2 transmits the output feature data $D_{CHR_OUT}$ generated by adding the error detecting code to the feature data $D_{CHR_2}$ calculated by the feature data calculation circuit 31, to the driver IC 6-1. The driver IC 6-1 receives the output feature data $D_{CHR_OUT}$ which is transmitted from the driver IC 6-2, as the input feature data $D_{CHR_IN}$.

The inter-chip communication detection circuit 33 in the driver IC 6-1 judges whether the driver IC 6-1 has successfully received the input feature data $D_{CHR_IN}$ from the driver IC 6-2, on the basis of the error detecting code added to the input feature data $D_{CHR_IN}$ (Step S03).

In detail, when detecting no data error in the input feature data $D_{CHR_IN}$ (or when detecting no uncorrectable data error in the case that an error correctable code is used), the inter-chip communication detection circuit 33 in the driver IC 6-1 judges that the input feature data $D_{CHR_IN}$ has been successfully received, and outputs communication ACK data as the communication state notification data $D_{ST_OUT}$. The communication state notification data $D_{ST_OUT}$ including the communication ACK data are transmitted from the driver IC 6-1 to the driver IC 6-2. In other words, the communication ACK data are transmitted from the driver IC 6-1 to the driver IC 6-2 (Step S04). Hereinafter, the state in which the communication ACK data are sent from the driver IC 6-1 to the driver IC 6-2 is referred to as "communication state #1".

When detecting a data error, (or when detecting an uncorrectable data error in the case that an error correctable code is used), on the other hand, the inter-chip communication detection circuit 33 in the driver IC 6-1 outputs communication NG data as the communication state notification data $D_{ST_OUT}$. The communication state notification data $D_{ST_OUT}$ including the communication NG data are transmitted from the driver IC 6-1 to the driver IC 6-2. That is, the communication NG data are transmitted from the driver IC 6-1 to the driver IC 6-2 (Step S05). Hereinafter, the state in which the communication NG data are transmitted from the driver IC 6-1 to the driver IC 6-2 is referred to as "communication state #2".

Similarly, the inter-chip communication detection circuit 33 in the driver IC 6-2 judges whether the driver IC 6-2 has successfully received the input feature data $D_{CHR_IN}$ from the driver IC 6-1 by using the error detecting code added to the input feature data $D_{CHR_IN}$ (Step S06).

In detail, when detecting no data error in the input feature data $D_{CHR_IN}$ (or when detecting no uncorrectable data error in the case that an error correctable code is used), the inter-chip communication detection circuit 33 in the driver IC 6-2 judges that the input feature data $D_{CHR_IN}$ has been normally received, and outputs communication ACK data as the communication state notification data $D_{ST_OUT}$. The communication state notification data $D_{ST_OUT}$ including the communication ACK data are transmitted from the driver IC 6-1 to the driver IC 6-2. That is, the communication ACK data are transmitted from the driver IC 6-2 to the driver IC 6-1 (Step S07). Hereinafter, the state in which the communication ACK data are transmitted from the driver IC 6-2 to the driver IC 6-1 is referred to as "communication state #3".

When detecting a data error, (or when detecting an uncorrectable data error in the case that an error correctable code is used), on the other hand, the inter-chip communication detection circuit 33 in the driver IC 6-2 outputs communication NG data as the communication state notification data $D_{ST_OUT}$. The communication state notification data $D_{ST_OUT}$ including the communication NG data are transmitted from the driver IC 6-2 to the driver IC 6-1. That is, the communication NG data are transmitted from the driver IC 6-2 to the driver IC 6-1 (Step S08). Hereinafter, the state in which the communication NG data are transmitted from the driver IC 6-2 to the driver IC 6-1 is referred to as "communication state #4".

In each frame periods, the following four combinations of communication states are allowed:

Combination A: the combination of communication states #1 and #3

Combination B: the combination of communication states #1 and #4

Combination C: the combination of Communications States #2 and #3

Combination D: the combination of communication states #2 and #4

When combination A occurs (namely, when the communication ACK data are sent from the driver IC 6-1 to the driver IC 6-2 and from the driver IC 6-2 to the driver IC 6-1), both of the driver ICs 6-1 and 6-2 select the current-frame full-screen feature data $D_{CHR_C}$ calculated in the current frame period. Furthermore, the correction point dataset $CP_sel^k$ is determined in response to the current-frame full-screen feature data $D_{CHR_C}$, and the determined correction point dataset $CP_sel^k$ is fed to the approximate calculation correction circuit 15 and used for the correction calculation of the input image data $D_{IN1}$ and $D_{IN2}$. In this case, the current-frame full-screen feature data $D_{CHR_C}$ are stored in the calculation result memory 23.

In detail, when combination A occurs, the communication state notification data $D_{ST_OUT}$ and $D_{ST_IN}$ supplied to the communication acknowledgement circuits 36 both include the communication ACK data in both of the driver ICs 6-1 and 6-2. The communication acknowledgement circuit 36 in each of the driver ICs 6-1 and 6-2 recognizes the occurrence of combination A, on the basis of the face that the communication state notification data $D_{ST_OUT}$ and $D_{ST_IN}$ both include the communication ACK data. In this case, the communication acknowledgement circuit 36 in each of the driver ICs 6-1 and 6-2 asserts the communication acknowledgement signal $S_{CMF}$. In response to the assertion of the communication acknowledgement signal $S_{CMF}$, the feature data selection circuit 37 in the correction point data calculation circuitry 24 selects the current-frame full-screen feature data $D_{CHR_C}$ in each of the driver ICs 6-1 and 6-2. The correction point data calculation circuitry 24 determines the correction point dataset $CP_sel^k$ in response to the selected current-frame full-screen feature data $D_{CHR_C}$. In addition, the calculation result memory 23 receives and stores the current-frame full-screen feature data $D_{CHR_C}$ in response to the assertion of the communication acknowledgement signal $S_{CMF}$. As a result, the contents of the calculation result memory 23 are updated to the current-frame full-screen feature data $D_{CHR_C}$ calculated in the current frame period.

When any one of the states other than combination A occurs (namely, when any one of combinations B, C and D occurs), on the other hand, the driver ICs 6-1 and 6-2 both select the previous-frame full-screen feature data $D_{CHR_P}$. Here, the occurrence of the states other than combination A, namely, the occurrence of any of combination B, C and D implies that communication NG data are transmitted from the driver IC 6-1 to the driver IC 6-2, and/or from the driver IC 6-2 to the driver IC 6-1. Furthermore, the correction point dataset $CP_sel^k$ is determined in response to the previous-frame full-screen feature data $D_{CHR_P}$, and the determined correction point dataset $CP_sel^k$ is fed to the approximate calculation correction circuit 15 and used for the correction calculation of the input image data $D_{IN1}$ and $D_{IN2}$. In this case, the previous-frame full-screen feature data $D_{CHR_P}$ stored in the calculation result memory 23 are not updated.

In detail, when any one of the states of combinations B, C and D occurs, at least one of the communication state notification data $D_{ST_OUT}$ and $D_{ST_IN}$ supplied to the communication acknowledgement circuit 36 includes the communication NG data in both the driver ICs 6-1 and 6-2. The communication acknowledgement circuit 36 in each of the driver ICs 6-1 and 6-2 recognizes the occurrence of combination B, C or D on the basis of the fact that at least one of the communication state notification data $D_{ST_OUT}$ and $D_{ST_IN}$ includes the communication NG data. In this case, the communication acknowledgement circuit 36 in each of the driver ICs 6-1 and 6-2 negates the communication acknowledgement signal $S_{CMF}$. In response to the negation of the communication acknowledgement signal $S_{CMF}$, the feature data selection circuits 37 in the correction point data calculation circuitries 24 select the previous-frame full-screen feature data $D_{CHR_P}$ in both of the driver ICs 6-1 and 6-2. The correction point data calculation circuitry 24 determines the correction point dataset $CP_sel^k$ in response to the selected previous-frame full-screen feature data $D_{CHR_P}$ in each of the driver ICs 6-1 and 6-2. In this case, the calculation result memory 23 holds the previous-frame full-screen feature data $D_{CHR_P}$ in response to the negation of the communication acknowledgement signal $S_{CMF}$, without updating the contents of the calculation result memory 23.

The correction point dataset $CP_sel^k$ is determined for each case of combinations A, B, C and D in accordance with the above-described procedure. The approximate calculation correction circuit 15 in the driver IC 6-1 performs the gamma correction on the input image data $D_{IN1}$ in accordance with the gamma curve determined by the correction point dataset $CP_sel^k$ by using the calculation expression, to output the output image data $D_{OUT}$. Similarly, the approximate calculation correction circuit 15 in the driver IC 6-2 performs the gamma correction on the input image data $D_{IN2}$ in accordance with the gamma curve determined by the correction point dataset $CP_sel^k$ by using the calculation expression, to output the output image data $D_{OUT}$. The data line drive circuits 18 in the driver ICs 6-1 and 6-2 drive the data lines of the first portion 9-1 and the second portion 9-2 of the display region of the LCD panel 5, respectively, in response to the outputted output image data $D_{OUT}$ (more specifically, in response to the color-reduced image data $D_{OUT_D}$).

Figure 13A:
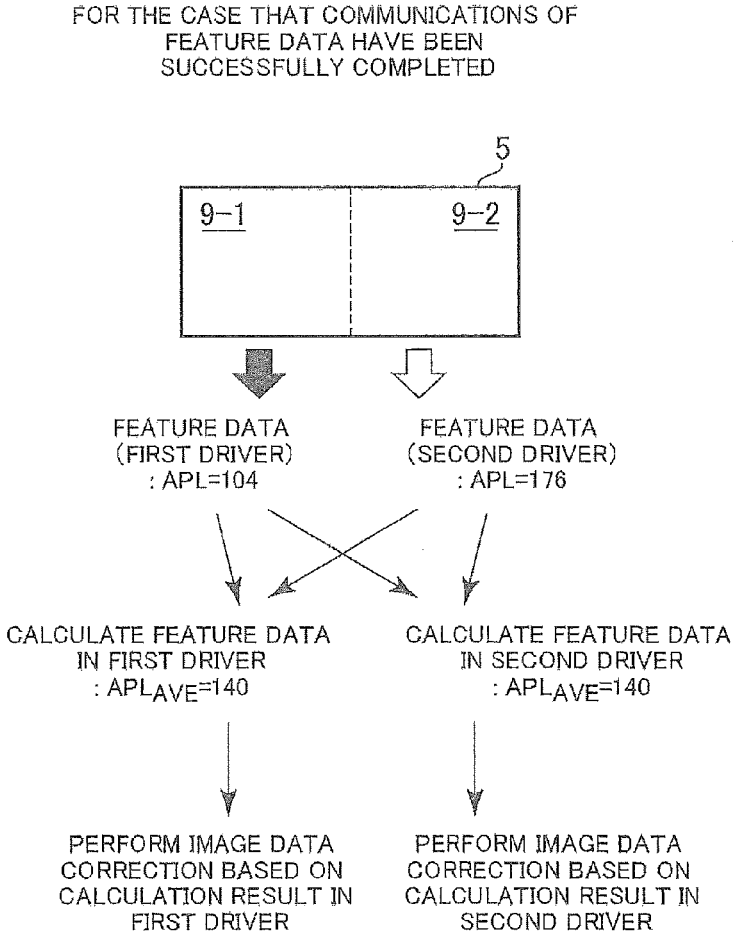
FIG. 13A is a conceptual diagram illustrating the operation when communications of feature data between the driver ICs are successfully completed.
Figure 13B:
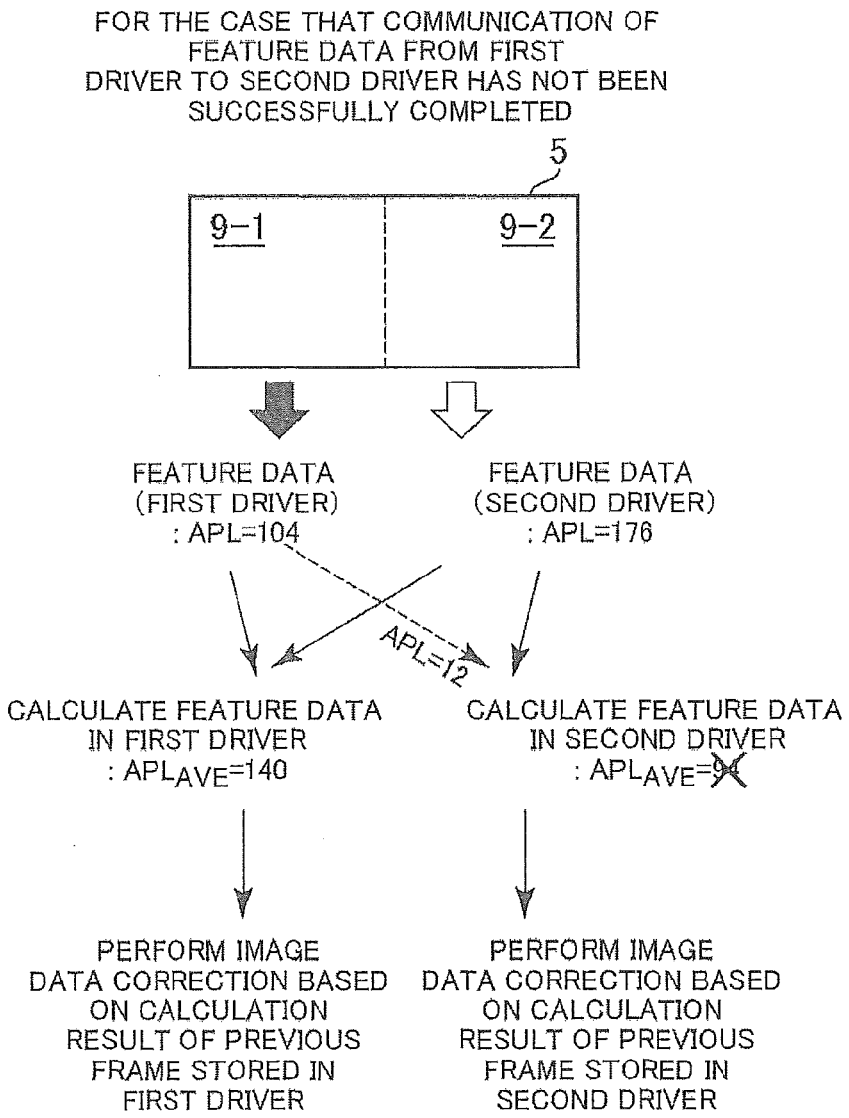
FIG. 13B is a conceptual diagram illustrating the operation when communications of feature data between the driver ICs are not successfully completed.

FIGS. 13A and 13B illustrate the operation in the case that the communications of the feature data between the driver ICs 6-1 and 6-2 have been successfully completed and the operation in the case that the communications of the feature data have been unsuccessfully completed. Although FIGS. 13A and 13B illustrate only the APLs calculated as the average values of the brightnesses of the pixels out of the feature values which are allowed to be described in the feature data exchanged between the driver ICs 6-1 and 6-2, the similar processes are performed for the other parameters (for example, the APLs and the mean square values of the gray-scale levels of the subpixels calculated for the respective colors, or the mean square value of the brightnesses of the pixels).

The operation in the case that the communications of the feature data between the driver ICs 6-1 and 6-2 have been successfully completed is illustrated in FIG. 13A. The operation in the case that the communications of the feature data between the driver ICs 6-1 and 6-2 have been successfully completed is as follows. The driver IC 6-1 (first driver) calculates the feature values of the partial image displayed on the first portion 9-1 of the display region of the LCD panel 5, on the basis of the input image data $D_{IN1}$ transmitted to the driver IC 6-1. Similarly, the driver IC 6-2 (second driver) calculates the feature values of the partial image displayed on the second portion 9-2 of the display region of the LCD panel 5, on the basis of the input image data $D_{IN2}$ transmitted to the driver IC 6-2. In the example illustrated in FIG. 13A, the driver IC 6-1 calculates the APL of the partial image displayed on the first portion 9-1 as 104, and the driver IC 6-2 calculates the APL of the partial image displayed on the second portion 9-2 as 176.

Furthermore, the driver IC 6-1 transmits the feature data that indicate the feature values calculated by the driver IC 6-1 (the feature values of the partial image displayed on the first portion 9-1) to the driver IC 6-2, and the driver IC 6-2 transmits the feature data that indicates the feature values calculated by the driver IC 6-2 (the feature values of the partial image displayed on the second portion 9-2) to the driver IC 6-1.

The driver IC 6-1 calculates the feature values of the entire image displayed on the display region of the LCD panel 5 from the feature values calculated by the driver IC 6-1 (namely, the feature values of the partial image displayed on the first portion 9-1) and the feature values indicated in the feature data received from the driver IC 6-2 (namely, the feature values of the partial image displayed on the second portion 9-2). It should be noted that the average value $APL_{AVE}$ between the APL of the partial image displayed on the first portion 9-1 and the APL of the partial image displayed on the second portion 9-2 is equal to the APL of the entire image displayed on the display region. In the example illustrated in FIG. 13A, the APL of the partial image displayed on the first portion 9-1 is 104, and the APL of the partial image displayed on the second portion 9-2 is 176. Accordingly, the driver IC 6-1 calculates the average value $APL_{AVE}$ as 140.

Similarly, the driver IC 6-2 calculates the feature values of the entire image displayed on the display region of the LCD panel 5, from the feature values calculated by the driver IC 6-2 (namely, the feature values of the partial image displayed on the second portion 9-2) and the feature values indicated in the feature data received from the driver IC 6-1 (namely, the feature values of the image displayed on the first portion 9-1). With regard to the APL, the average value $APL_{AVE}$ between the APL of the partial image displayed on the first portion 9-1 and the APL of the partial image displayed on the second portion 9-2 is calculated. In the example shown in FIG. 13, the driver IC 6-2 calculates the average value $APL_{AVE}$ as 140, similarly to the driver IC 6-1.

The driver IC 6-1 performs the correction calculation on the input image data $D_{IN1}$ on the basis of the feature values of the entire image displayed on the display region of the LCD panel 5, which is calculated by the driver IC 6-1 (as for the APL, the average value $APL_{AVE}$), and drives the pixels disposed in the first portion 9-1 in response to the output image data $D_{OUT}$ obtained by the correction calculation. Similarly, the driver IC 6-2 performs the correction calculation on the input image data $D_{IN2}$ on the basis of the feature values of the entire image displayed on the display region, which is calculated by the driver IC 6-2, and drives the pixels disposed in the second portion 9-2 in response to the output image data $D_{OUT}$ obtained by the correction calculation.

The operation in the case that the communications of the feature data between the driver ICs 6-1 and 6-2 have not successfully completed is illustrated in FIG. 13B. The operation in the case that the communications of the feature data between the driver ICs 6-1 and 6-2 have not successfully completed is as follows. Similarly to the case when the communications of the feature data have been successfully completed, the driver ICs 6-1 and 6-2 respectively calculate the feature values of the partial images displayed on the first and second portions 9-1 and 9-2 in the display region of the LCD panel 5 in response to the input image data $D_{IN1}$ and $D_{IN2}$, and the feature data that indicate the calculated feature values are exchanged between the driver ICs 6-1 and 6-2.

Here, a consideration is given of the case that the communication of the feature data from the driver IC 6-1 to the driver IC 6-2 has not been successfully completed. It is assumed, for example, that, although the APL of the partial image displayed on the first portion 9-1 calculated by the driver IC 6-1 is originally to be calculated as 104, the feature data received by the driver IC 6-2 indicate that the APL of the partial picture displayed on the first portion 9-1 is 12.

In this case, the APL of the entire image displayed on the display region of the LCD panel 5 is not correctly calculated in the driver IC 6-2; however, the driver IC 6-2 can recognize that the communication of the feature data from the driver IC 6-1 to the driver IC 6-2 has not been successfully completed through the error detection. Accordingly, the driver IC 6-2 uses the feature values indicated in the previous-frame full-screen feature data $D_{CHR_P}$ stored in the calculation result memory 23 to perform the correction calculation on the input image data $D_{IN2}$.

Also, the driver IC 6-1 can recognize that the communication of the feature data from the driver IC 6-1 to the driver IC 6-2 has not been successfully completed on the basis of the communication state notification data $D_{ST_IN}$ received from the driver IC 6-2. Thus, the driver IC 6-1 uses the feature values indicated in the previous-frame full-screen feature data $D_{CHR_P}$ stored in the calculation result memory 23 to perform the correction calculation on the input image data $D_{IN1}$. The driver ICs 6-1 and 6-2 drive the pixels disposed in the first portion 9-1 and the second portion 9-2, respectively, in response to the output image data $D_{OUT}$ obtained by the correction calculation.

As described above, when the communications of the feature data between the driver ICs 6-1 and 6-2 have not been successfully completed, the feature values indicated in the previous-frame full-screen feature data $D_{CHR_P}$ stored in the calculation result memory 23 are used to perform the correction calculation. Accordingly, no boundary can be visually perceived between the first portion 9-1 and the second portion 9-2 in the display region of the LCD panel 5 even if the communications have not been successfully completed.

Figure 14A:
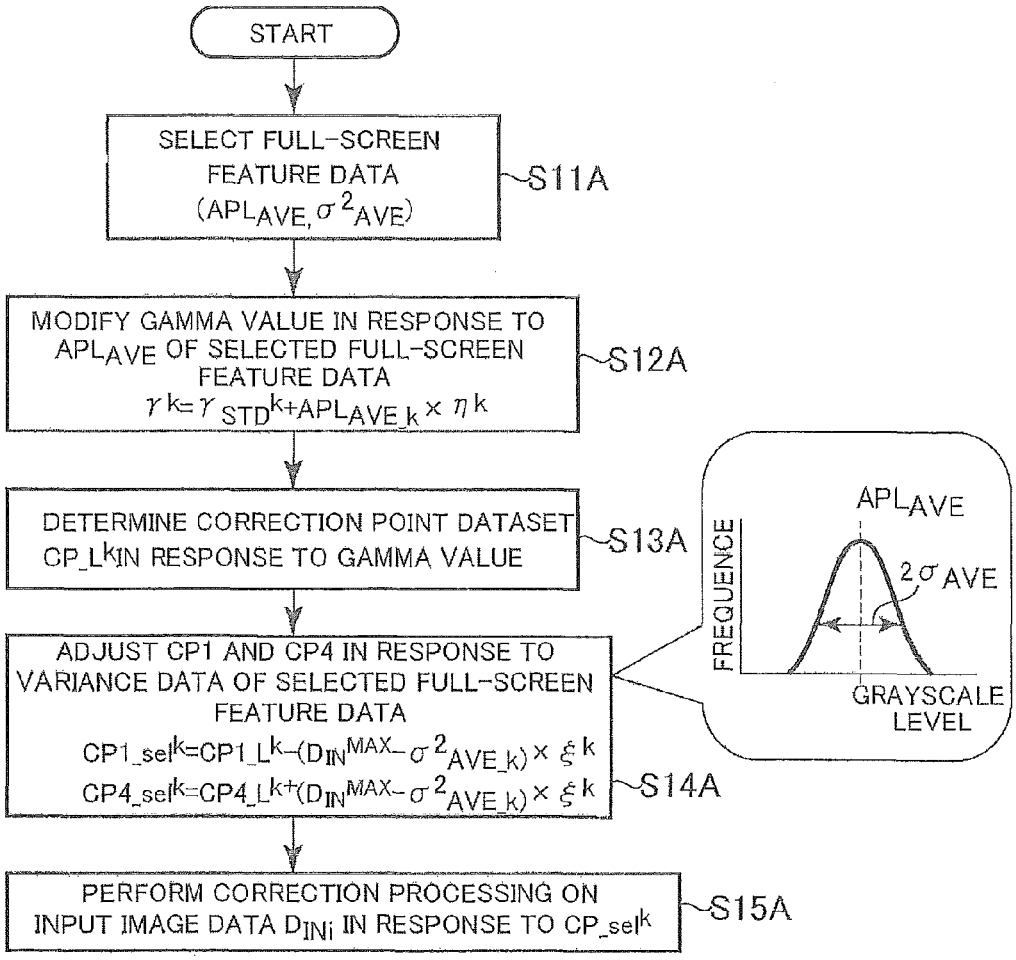
FIG. 14A is a flowchart illustrating one example of the operation of the correction point data calculation circuitry in the first embodiment.

FIG. 14A is a flowchart illustrating an exemplary operation of the correction point data calculation circuitry 24, when the combination of the APL and the mean square value of the grayscale levels of the subpixels calculated for each color is used as the feature values exchanged between the driver ICs 6-1 and 6-2. It should be noted that both of the current-frame full-screen feature data $D_{CHR_C}$ and the previous-frame full-screen feature data $D_{CHR_P}$ include the APL data $D_{APL}$ which describe $APL_{AVE_R}$, $APL_{AVE_G}$ and $APL_{AVE_B}$ and the variance data $D_{\sigma 2}$ which describe $\sigma_{AVE_R}^2$, $\sigma_{AVE_G}^2$ and $\sigma_{AVE_B}^2$. The correction point data calculation circuitry 24 determines the correction point dataset $CP_sel^k$ to be fed to the approximate calculation correction circuit 15 in response to the current-frame full-screen feature data $D_{CHR_C}$ or previous-frame full-screen feature data $D_{CHR_P}$, which both include the above-described data.

First, the current-frame full-screen feature data $D_{CHR_C}$ or the previous-frame full-screen feature data $D_{CHR_P}$ are selected by the feature data selection circuit 37 in response to the communication acknowledgement signal $S_{CMF}$ received from the communication acknowledgement circuit (Step S11A). The feature data selected at step S11A are hereinafter referred to as selected feature data. It should be noted that the selected feature data always include the APL data $D_{APL}$ which describe $APL_{AVE_R}$, $APL_{AVE_G}$ and $APL_{AVE_B}$ and the variance data $D_{\sigma 2}$ which describe $G_{AVE_R}^2$, $\sigma_{AVE_G}^2$ and $\sigma_{AVE_B}^2$, regardless of which of the current-frame full-screen feature data $D_{CHR_C}$ and the previous-frame full-screen feature data $D_{CHR_P}$ are selected as the selected feature data.

Furthermore, the interpolation calculation/selection circuit 38*b* determines the gamma value on the basis of the APL data $D_{APL}$ included in the selected feature data (Step S12A). The determination of the gamma value is carried out for each color (namely, for each of the R, G and B subpixels). The gamma value $\gamma^R$ for red or R subpixels, the gamma value $\gamma^G$ for green or G subpixels, and the gamma value $\gamma^B$ for blue or B subpixels are determined so that the gamma values $\gamma^R$, $\gamma^G$ and $\gamma^B$ are increases as $APL_{AVE_R}$, $APL_{AVE_G}$ and $APL_{AVE_B}$ increase, respectively. In one embodiment, the gamma values $\gamma^R$, $\gamma^G$ and $\gamma^B$ are determined, for example, by the following expressions:

$$\gamma^R=\gamma_{STD}{}^R+\mathrm{APL}_{AVE_R}\cdot\eta^R, \tag{10a}$$

$$\gamma^G=\gamma_{STD}{}^G+\mathrm{APL}_{AVE_G}\cdot\eta^G, \text{ and} \tag{10b}$$

$$\gamma^B=\gamma_{STD}{}^B+\mathrm{APL}_{AVE_B}\cdot\eta^B, \tag{10c}$$

where $\gamma_{STD}{}^R$, $\gamma_{STD}{}^G$ and $\gamma_{STD}{}^B$ are standard gamma values, which are defined as predetermined constants, and $\eta^R$, $\eta^G$ and $\eta^B$ are predetermined proportional constants. It should be noted that $\gamma_{STD}{}^R$, $\gamma_{STD}{}^G$ and $\gamma\mathrm{STD}^B$ may be equal to or different from one another and $\eta^R$, $\eta^G$ and $\eta^B$ may be equal to or different from one another.

After the gamma values $\gamma^R$, $\gamma^G$ and $\gamma^B$ are determined, the interpolation calculation/selection circuit 38*b* determines the correction point datasets CP_L$^R$, CP_L$^G$ and CP_L$^B$ on the basis of the gamma values $\gamma^R$, $\gamma^G$ and $\gamma^B$ (Step S13A).

Figure 15:
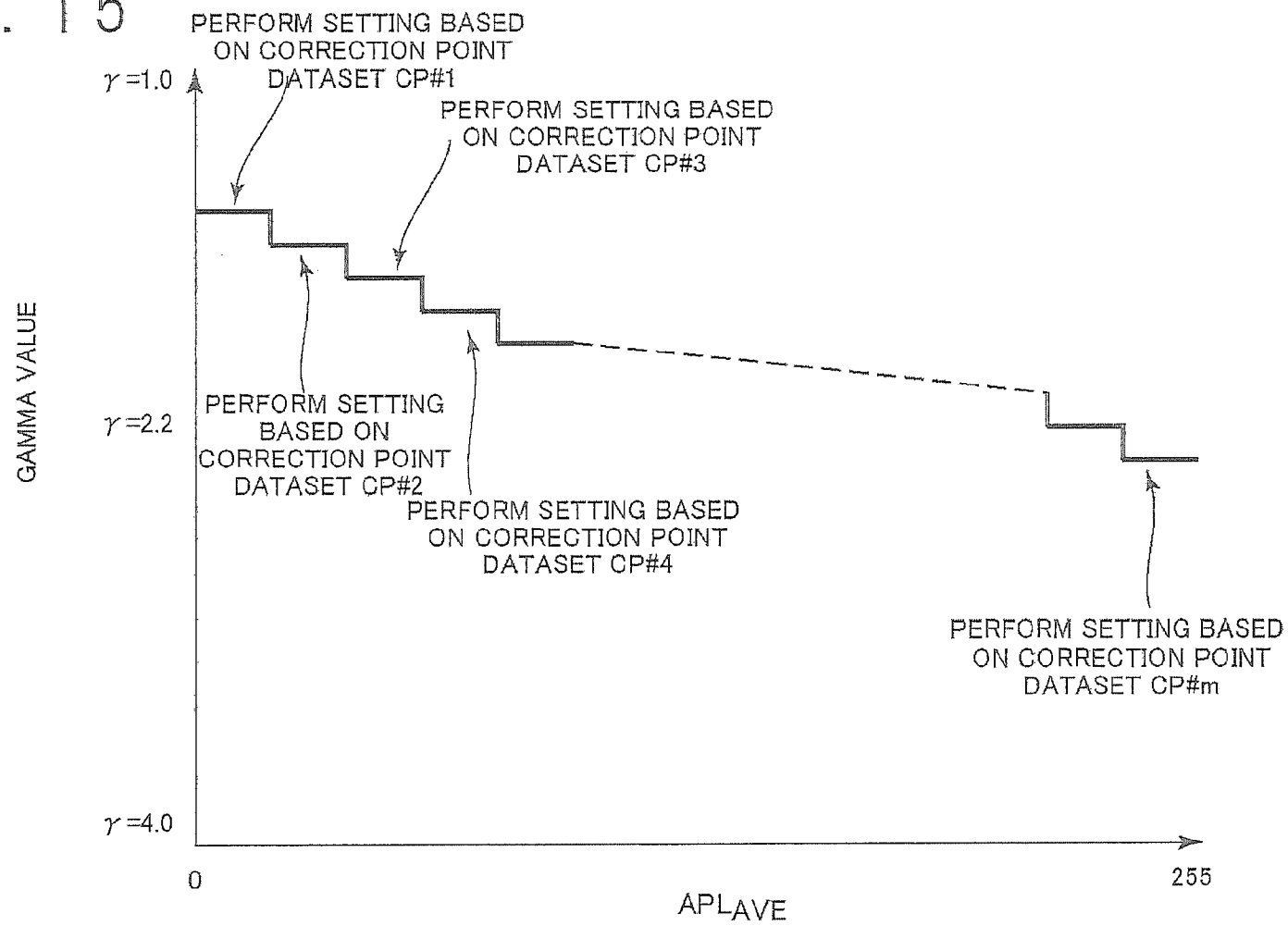
FIG. 15 is a graph illustrating the relation of $APL_{AVE}$, to the gamma value and correction point dataset $CP_L^k$ in one embodiment.

In one embodiment, one of the correction point datasets CP#1 to CP#m may be selected in response to $\mathrm{APL}_{AVE_k}$ (k is "R", "G" or "B") to determine the selected correction point dataset as the correction point dataset CP_L$^k$ (k is "R", "G" or "B"). FIG. 15 is a graph illustrating the relation among $\mathrm{APL}_{AVE_k}$, $\gamma^k$ and the correction point dataset CP_L$^k$ when the correction point dataset CP_L$^k$ is determined in this way. As $\mathrm{APL}_{AVE_k}$ increases, the gamma value $\gamma^k$ is set to a larger value and the correction point dataset CP#j associated with a larger j is selected.

In another embodiment, the correction point dataset CP_L$^k$ (k is "R", "G" or "B") may be determined as follows: First, the two correction point datasets, namely, the correction point datasets CP#q and CP#(q+1) are selected from the correction point datasets CP#1 to CP#m stored in the correction point dataset storage register 38*a*, in response to the higher (M-N) bits of $\mathrm{APL}_{AVE}$, described in the APL data $D_{APL}$. It should be noted that, as described above, M is the number of bits of $\mathrm{APL}_{AVE_k}$, and N is a predetermined constant. Also, q is an integer from 1 to (m−1). As $\mathrm{APL}_{AVE_k}$ increases, the gamma value $\gamma^k$ is set to a larger value and the correction point datasets CP#q and CP#(q+1) with a larger q are accordingly selected.

Furthermore, the correction point data CP0 to CP5 of the correction point dataset CP_L$^k$ are calculated by an interpolation calculation of the correction point data CP0 to CP5 of the selected two correction point datasets CP#q and CP#(q+1), respectively. More specifically, the correction point data CP0 to CP5 of the correction point dataset CP_L$^k$ (k is "R", "G" or "B") are calculated from the correction point data CP0 to CP5 of the selected two correction point datasets CP#q and CP#(q+1) by using the following expression:

$$\mathrm{CP}\alpha_L^k=\mathrm{CP}\alpha(\#q)+\{(\mathrm{CP}\alpha(\#q+1)-\mathrm{CP}\alpha(\#q)/2^N)\}\times \mathrm{APL}_{AVE_k}[N-1:0], \tag{11}$$

where α, CPα_L$^k$, CPα(#q), CPα(#q+1) and $\mathrm{APL}_{AVE_k}$[N−1:0] are defined as follows:

α: an integer from 0 to 5

CPα_L$^k$: correction point data CPα of correction point dataset CP_L$^k$

CPα(#q): correction point data CPα of selected correction point dataset CP#q

CPα(#q+1): correction point data CPα of selected correction point dataset CP#(q+1)

$\mathrm{APL}_{AVE_k}$ [N−1:0]: the lower N bits of $\mathrm{APL}_{AVE_k}$

Figure 16:
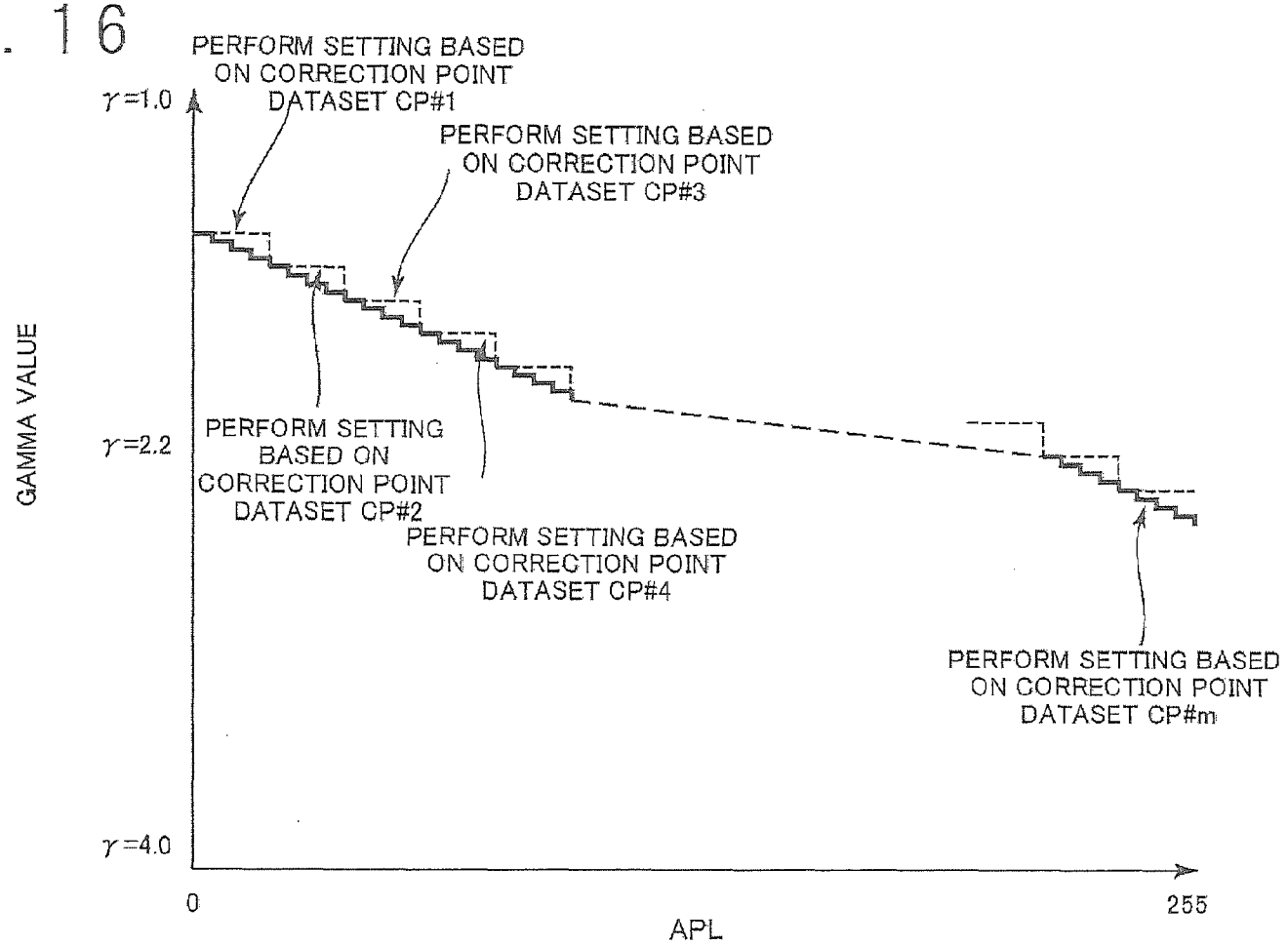
FIG. 16 is a graph illustrating the relation of $APL_{AVE}$, to the gamma value and correction point dataset $CP_L^k$ in another embodiment.

FIG. 16 is a graph illustrating the relation among $\mathrm{APL}_{AVE_k}$, $\gamma^k$, and the correction point dataset CP_L$^k$ when the correction point dataset CP_L$^k$ is determined in this way. As $\mathrm{APL}_{AVE_k}$ increases, the gamma value $\gamma^k$ is set to a larger value and the correction point datasets CP#q and CP#(q+1) with a larger q are accordingly selected. This results in that the correction point dataset CP_L$^k$ is determined to correspond to an intermediate value between gamma values $\gamma_q$ and $\gamma_{q+1}$, which respectively correspond to the correction point datasets CP#q and CP#(q+1).

Figure 17:
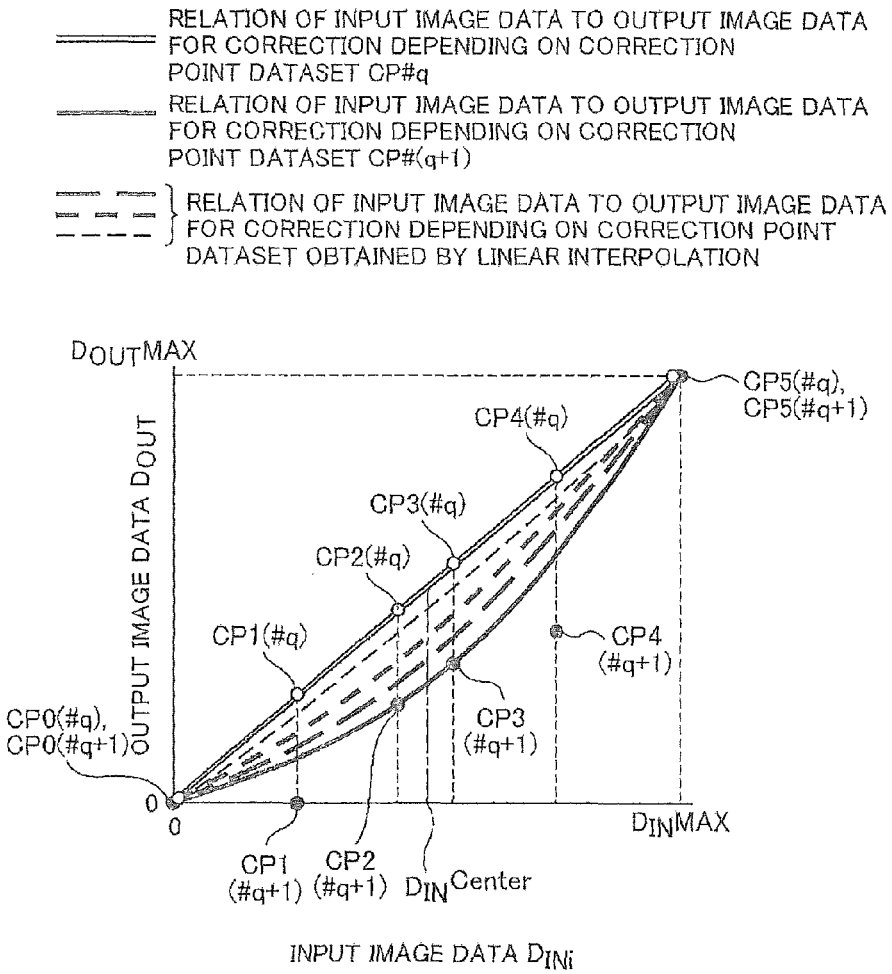
FIG. 17 is a graph conceptually illustrating the shapes of gamma curves corresponding to correction point datasets CP#q and CP#(q+1), respectively, and the shape of a gamma curve corresponding to the correction point dataset $CP_L^k$.

FIG. 17 is a graph conceptually illustrating the shapes of the gamma curves corresponding to the correction point datasets CP#q and CP#(q+1), respectively, and the shape of the gamma curve corresponding to the correction point dataset CP_L$^k$. Since the correction point data CPα of the correction point dataset CP_L$^k$ are calculated by the interpolation calculations of the correction point data CPα(#q) and CPα(#q+1) of the correction point datasets CP#q and CP#(q+1) (where α is an integer from 0 to 5), the gamma curve corresponding to the correction point dataset CP_L$^k$ is shaped to be located between the gamma curves corresponding to the correction point datasets CP#q and CP#(q+1).

Referring back to FIG. 14A, after the correction point dataset CP_L$^k$ is determined, the correction point dataset CP_L$^k$ is modified on the basis of the variance $\sigma_{AVE_k}{}^2$ described in the variance data $D\sigma_2$ (Step S14). The modified correction point dataset CP_L$^k$ is finally fed to the approximate calculation correction circuit 15 as the correction point dataset CP_sel$^k$ (Step S14A).

Figure 18:
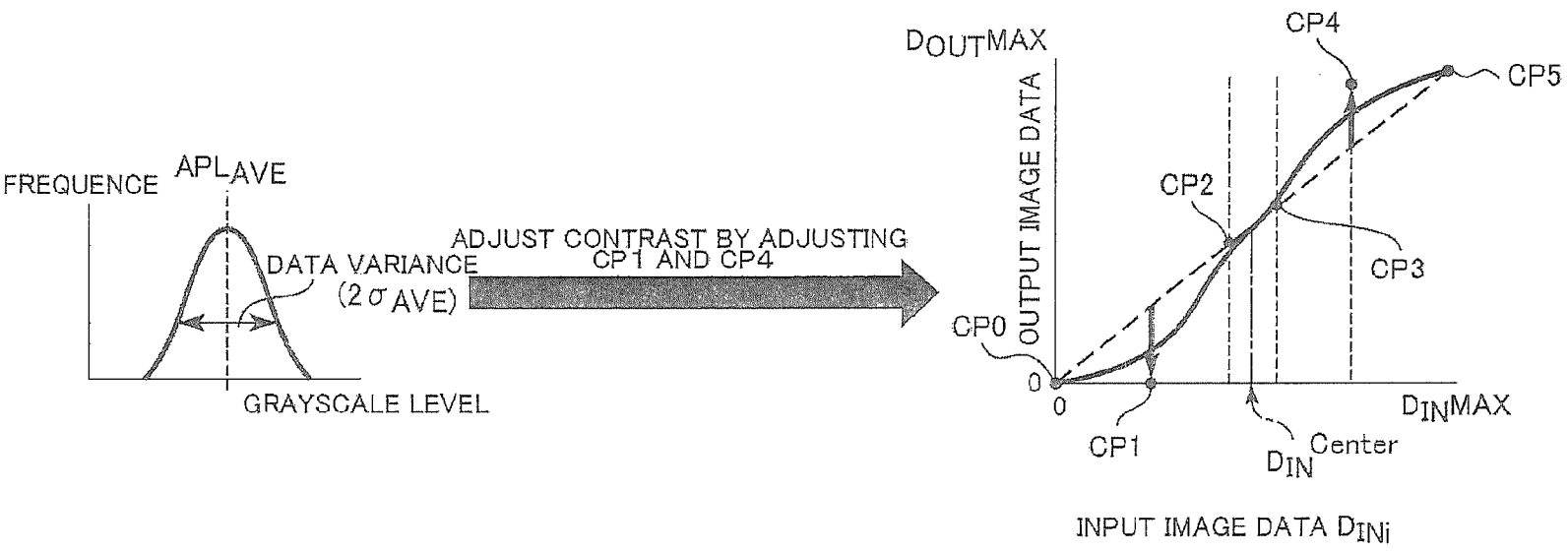
FIG. 18 is a conceptual diagram illustrating a technical concept of modification of the correction point dataset $CP_L^k$ on the basis of a variance $\sigma_{AVE}^2$.

FIG. 18 is a conceptual diagram illustrating the technical concept of the modification of the correction point dataset CP_L$^k$ on the basis of the variance $\sigma_{AVE_k}{}^2$. When the variance $\sigma_{AVE_k}{}^2$ is large, this implies that there are many subpixels having grayscale levels away from $\mathrm{APL}_{AVE_k}$; in other words, this fact implies that the contrast of the image is large. When the contrast of the image is large, the contrast of the image can be represented with a reduced brightness of the LED backlight 8 by performing the correction calculation in the approximate calculation correction circuit 15 so as to emphasize the contrast.

In this embodiment, since the correction point data CP1 and CP4 of the correction point dataset CP_L$^k$ have a large influence on the contrast, the correction point data CP1 and CP4 of the correction point dataset CP_L$^k$ are modified on the basis of the variance $\sigma_{AVE_k}{}^2$. The correction point data CP1 of the correction point dataset CP_L$^k$ is modified so that the correction point data CP1 of the correction point dataset CP_sel$^k$, which is finally fed to the approximate calculation correction circuit 15, is decreased as the variance $\sigma_{AVE_k}{}^2$ is increased. Also, the correction point data CP4 of the correction point dataset CP_L$^k$ is modified so that the correction point data CP4 of the correction point dataset CP_sel$^k$, which is finally fed to the approximate calculation correction circuit 15, is decreased as the variance $\sigma_{AVE_k}{}^2$ is decreased. Such modifications result in that the contrast is emphasized by the correction calculation in the approximate calculation correction circuit 15 when the contrast of the image is large. It should be noted that the correction point data CP0, CP2, CP3 and CP5 of the correction point dataset CP_L$^k$ are not modified in this embodiment. In other words, the values of the correction point data CP0, CP2, CP3 and CP5 of the correction point dataset CP_sel$^k$ are equal to those of the correction point data CP0, CP2, CP3 and CP5 of the correction point dataset CP_L$^k$, respectively.

In one embodiment, the correction point data CP1 and CP4 of the correction point dataset CP_sel$^k$ are calculated by the following expressions:

$$\mathrm{CP1_sel}^R=\mathrm{CP1}_L^R-(D_{IN}{}^{MAX}-\sigma_{AVE_R}{}^2)\cdot\xi^R, \tag{12a}$$

$$\mathrm{CP1_sel}^G=\mathrm{CP1}_L^G-(D_{IN}{}^{MAX}-\sigma_{AVE_R}{}^2)\cdot\xi^G, \tag{12b}$$

$$CP1_sel^B = CP1_L^B - (D_{IN}^{MAX} - \sigma_{AVE_R}^2) \cdot \xi^B, \quad (12c)$$

$$CP1_sel^R = CP1_L^R - (D_{IN}^{MAX} - \sigma_{AVE_R}^2) \cdot \xi^R, \quad (13a)$$

$$CP1_sel^G = CP1_L^G - (D_{IN}^{MAX} - \sigma_{AVE_R}^2) \cdot \xi^G, \quad (13b)$$

$$CP1_sel^B = CP1_L^B - (D_{IN}^{MAX} - \sigma_{AVE_R}^2) \cdot \xi^B, \quad (13c)$$

where $D_{IN}^{MAX}$ is the allowed maximum value of the input image data $D_{IN1}$ and $D_{IN2}$. It should be noted that $\xi^R$, $\xi^G$ and $\xi^B$ are predetermined proportional constants; $\xi^R$, $\xi^G$ and $\xi^B$ may be equal to or different from one another. It should be also noted that CP1 $sel^k$ and CP4 $sel^k$ are the correction point data CP1 and CP4 of the correction point dataset $CP_sel^k$, respectively, and $CP1_L^k$ and $CP4_L^k$ are the correction point data CP1 and CP4 of the correction point dataset $CP_L^k$, respectively.

Figure 19:
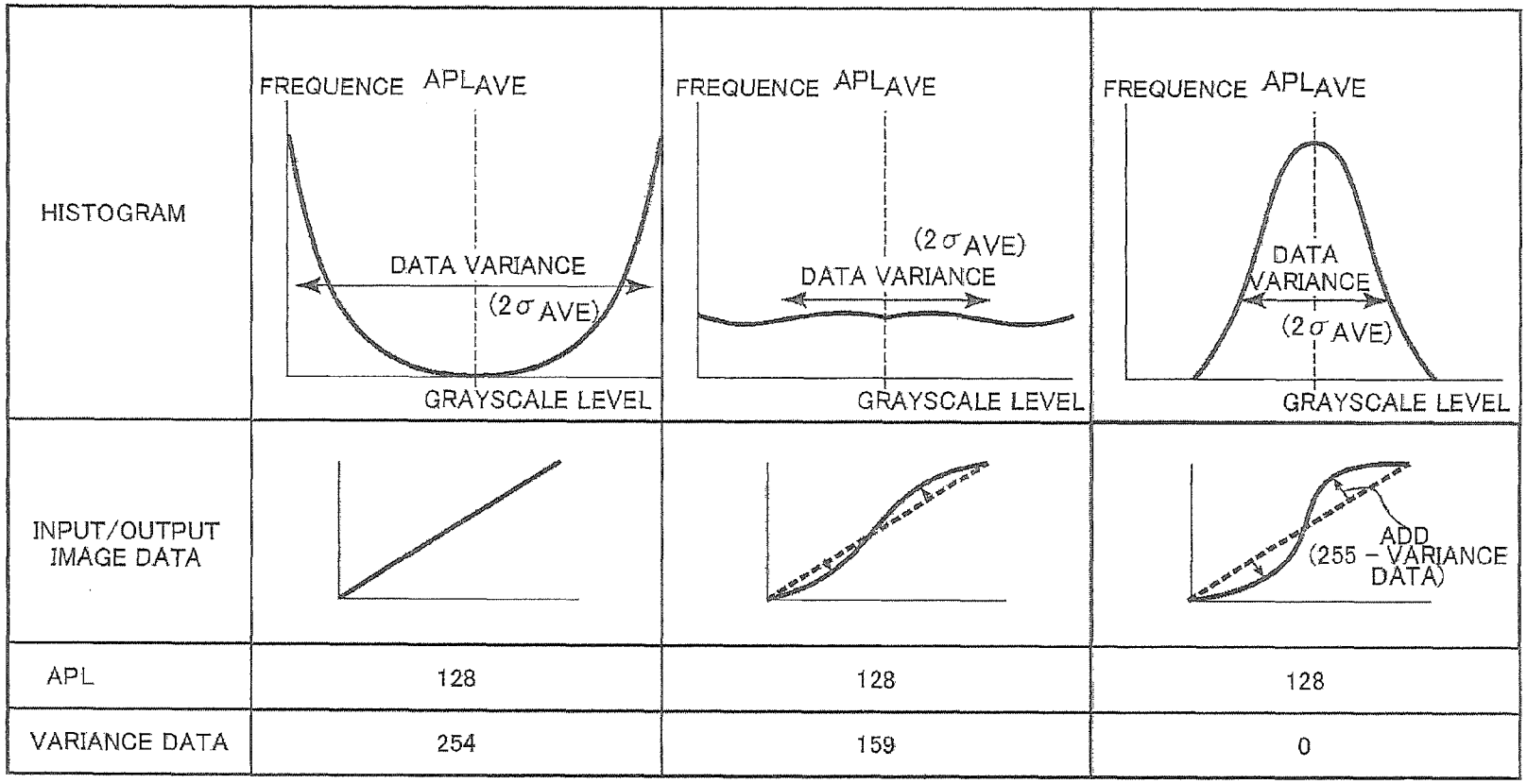
FIG. 19 is a table conceptually illustrating a relation of the distribution (or histogram) of the grayscale levels to the correction calculation in the case when correction point data CP1 and CP4 are modified on the basis of the variance $\sigma_{AVE}^2$.

FIG. 19 conceptually illustrates the relation between the distribution (or the histogram) of the grayscale levels and the contents of the correction calculation, in the case when the correction point data CP1 and CP4 are modified in accordance with the above-described expressions. When the contract of the image varies, the variance $\tau_{AVE_k}^2$ also varies even if $APL_{AVE_k}$ is unchanged. When a larger number of subpixels in the image have grayscale levels close to $APL_{AVE_k}$, the contrast of the image is small and the variance $\tau_{AVE_k}^2$ is also small. In such a case, the modification is performed so that the correction point data CP1 is reduced and the correction point data CP4 is increased; this effectively emphasizes the contrast (as illustrated in the right column). When a larger number of subpixels have grayscale levels away from the $APL_{AVE_k}$, on the other hand, the contrast is large and the variance $\tau_{AVE_k}^2$ is also large. In such a case, the correction point data CP1 and CP4 are modified only slightly, and the contrast is not so emphasized (as illustrated in the left column). It would be easily understood that the above-described expressions (12a) to (12c) and (13a) to (3c) to satisfy such requirements.

Referring back to FIG. 14A, the approximate calculation units 15R, 15G and 15B of the approximate calculation correction circuit 15 in the driver ICs 6-1 and 6-2 use the thus-calculated correction point datasets $CP_sel^R$, $CP_sel^G$ and $CP_sel^B$ to perform the correction calculations on the input image data $D_{INi}^R$ and $D_{INi}^G$ and $D_{INi}^B$, to generate the output image data $D_{OUT}^R$, $D_{OUT}^G$ and $D_{OUT}^B$, respectively (Step S15A).

Each approximate calculation unit $\mathbf{15}_k$ of the driver IC 6-*i* uses the following expressions to consequently calculate the output image data $D_{OUT}^k$ from the input image data $D_{INi}^k$:

(1) In the case that $D_{INi}^k < D_{IN}^{Center}$ and CP1>CP0, $$D_{OUT}^k = \frac{2(CP1 - CP0) \cdot PD_{INS}}{K^2} + \frac{(CP3 - CP0)D_{INS}}{K} + CP0 \quad (14a)$$

It should be noted that, when the correction point data CP1 is greater than the correction point data CP0, this implies that the gamma value γ used for the gamma correction is smaller than one.

(2) In the case that $D_{INi}^k < D_{IN}^{Center}$ and CP1≤CP0, $$D_{OUT}^k = \frac{2(CP1 - CP0) \cdot ND_{INS}}{K^2} + \frac{(CP3 - CP0)D_{INS}}{K} + CP0 \quad (14b)$$

It should be noted that, when the correction point data CP1 is equal to or less than the correction point data CP0, this implies that the gamma value γ used for the gamma correction is one or more.

(3) In the case that $D_{INi}^k > D_{IN}^{Center}$, $$D_{OUT}^k = \frac{2(CP4 - CP2) \cdot ND_{INS}}{K^2} + \frac{(CP5 - CP2)D_{INS}}{K} + CP2 \quad (14c)$$

In these expressions, $D_{IN}^{Center}$ is an intermediate data value which is defined by the following expression (15) in which the allowed maximum value $D_{IN}^{MAX}$ of the input image data $D_{INi}$ is used:

$$D_{IN}^{Center} = D_{IN}^{MAX}2. \quad (15)$$

Also, K is a parameter given by the above-described expression (7). Moreover, $D_{INS}$, $PD_{INS}$ and $ND_{INS}$ which appear in expressions (14a) to (14c) are values defined as follows:

(a) $D_{INS}$ $D_{INS}$ is a value determined depending on the input image data $D_{INi}^k$ and given by the following expressions:

$$D_{INS} = D_{INi}^k \text{ (for } D_{INi}^k < D_{IN}^{Center}) \quad (16a)$$

$$D_{INS} = D_{INi}^k 1 - K \text{ (for } D_{INi}^k > D_{IN}^{Center}) \quad (16b)$$

(b) $PD_{INS}$ $PD_{INS}$ is defined by the following expression (17a), in which a parameter R defined by the expression (17b) is used:

$$PD_{INS} = (K - R) \cdot R \quad (17a)$$

$$R = K^{1/2} \cdot D_{INS}^{1/2} \quad (17b)$$

As is understood from the expressions (16a), (16b) and (17b), the parameter R is a value proportional to the square root of $D_{INi}^k$ and thus $PD_{INS}$ is a value calculated by an expression including a term proportional to the square root of the input image data $D_{INi\ hu\ k}$ and a term proportional to the first power of the input image data $D_{INi}^k$.

(c) $ND_{INS}$ $ND_{INS}$ is given by the following expression:

$$ND_{INS} = (K - D_{INS}) \cdot D_{INS} \quad (18)$$

As understood from expressions (16a), (16b) and (18), $ND_{INS}$ is a value calculated by an expression including a term proportional to the second power of the input image data $D_{INi}^k$.

The output image data $D_{OUT}^R$, $D_{OUT}^G$ and $D_{OUT}^B$, which are calculated in accordance with the above-described expressions in the approximate calculation correction circuit 15, are transmitted to the color-reduction processing circuit 16. The color-reduction processing circuit 16 performs color-reduction processing on the output image data $D_{OUT}^R$, $D_{OUT}^G$ and $D_{OUT}^B$ to generate color-reduced data $D_{OUT_D}$. The color-reduced data $D_{OUT_D}$ are transmitted to the data line drive circuit 18 through the latch circuit 17. The data lines of the LCD panel 5 are driven in response to the color-reduced data $D_{OUT_D}$.

Figure 14B:
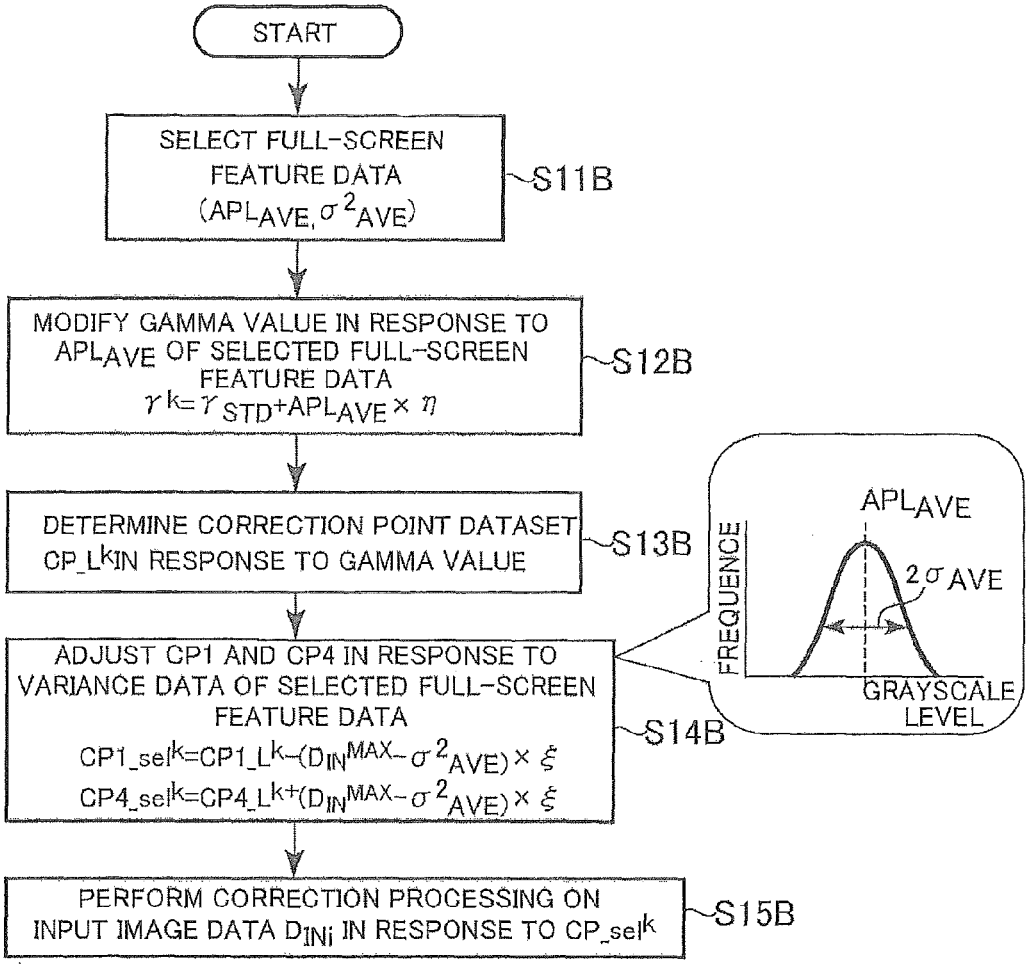
FIG. 14B is a flowchart illustrating another example of the operation of the correction point data calculation circuitry in the first embodiment.

FIG. 14B is, on the other hand, a flowchart illustrating another exemplary operation of the correction point data calculation circuitry 24, when the combination of the APL calculated as the average value of the brightnesses of the pixels and the mean square value of the brightnesses of the pixels is used as the feature values exchanged between the driver ICs 6-1 and 6-2. It should be noted that, in this case, both of the current-frame full-screen feature data $D_{CHR_C}$ and the previous-frame full-screen feature data $D_{CHR_P}$ include the APL data $D_{APL}$ describing $APL_{AVE}$ of the entire image displayed on the display region of the LCD panel 5 and the variance data $D\sigma_t$ describing $\sigma_{AVE}$. The correction point data calculation circuitry 24 determines the correction point dataset $CP_sel^k$ to be fed to the approximate calculation correction circuit 15 on the basis of the current-frame full-screen feature data $D_{CHR_C}$ or previous-frame full-screen feature data $D_{CHR_P}$, which include the above-described data.

First, the current-frame full-screen feature data $D_{CHR_C}$ or the previous-frame full-screen feature data $D_{CHR_P}$ are selected as selected feature data in response to the communication acknowledgement signal $S_{CMF}$ transmitted from the communication acknowledgement circuit 36 (Step S11B). It should be noted that the selected feature data always include the APL data $D_{APL}$ describing $APL_{AVE}$ and the variance data $D_{\sigma 2}$ describing $\sigma_{AVE}^2$, regardless of which of the current-frame full-screen feature data $D_{CHR_C}$ and the previous-frame full-screen feature data $D_{CHR_P}$ are selected as the selected feature data.

Furthermore, the interpolation calculation/selection circuit 38*b* determines the gamma value on the basis of the APL data $D_{APL}$ included in the selected feature data (Step S12B). When the combination of the APL calculated as the average value of the brightnesses of the pixels and the mean square value of the brightnesses of the pixels is used as the feature values exchanged between the driver ICs 6-1 and 6-2, the gamma value γ is commonly determined for all the colors. Here, the gamma value γ is determined so that the gamma value γ is increased as $APL_{AVE}$ described in the APL data $D_{APL}$ increases. In one embodiment, the gamma value γ may be determined by the following expression:

$$\gamma=\gamma_{STD}+APL_{AVE}\cdot\eta, \tag{19}$$

where $\gamma_{STD}$ is a standard gamma value and η is a predetermined proportional constant.

After the gamma value γ is determined, the interpolation calculation/selection circuit 38*b* determines the correction point datasets $CP_L^R$, $CP_L^G$ and $CP_L^B$ on the basis of the gamma value γ (Step S13B). It should be noted that, when the combination of the APL calculated as the average value of the brightnesses of the pixels and the mean square value of the brightnesses of the pixels is used as the feature values exchanged between the driver ICs 6-1 and 6-2, the correction point datasets $CP_L^R$, $CP_L^G$ and $CP_L^B$ are determined to be equal to one another.

In one embodiment, one of the above correction point datasets CP#1 to CP#m may be selected on the basis of the $APL_{AVE}$ to determine the selected correction point dataset as the correction point datasets $CP_L^R$, $CP_L^G$ and $CP_L^B$. The relation among $APL_{AVE}$, γ and the correction point dataset $CP_L^k$ in the case that the correction point datasets $CP_L^R$, $CP_L^G$ and $CP_L^B$ are determined in this way is as illustrated in FIG. 15 as described above.

In another embodiment, the correction point datasets $CP_L^R$, $CP_L^G$ and $CP_L^B$ may be determined as follows. First, two correction point datasets, namely, correction point datasets CP#q and CP#(q+1) are selected from the correction point datasets CP#1 to CP#m stored in the correction point dataset storage register 38*a* on the basis of the higher (M-N) bits of $APL_{AVE}$ described in the APL data $D_{APL}$. Here, as described above, M is the number of bits of $APL_{AVE}$, and N is a predetermined constant. Also, q is an integer from 1 to (m−1). As $APL_{AVE}$ increases, the gamma value γ is increased and the correction point datasets CP#q and CP#(q+1) associated with a larger q are accordingly selected.

Furthermore, the correction point data CP0 to CP5 of the correction point datasets $CP_L^R$, $CP_L^G$ and $CP_L^B$ are calculated by an interpolation calculation of the correction point data CP0 to CP5 of the selected two correction point datasets CP#q and CP#(q+1), respectively. More specifically, the correction point data CP0 to CP5 of the correction point dataset $CP_L^k$ (k=any of "R", "G" or "B") are calculated from the correction point data CP0 to CP5 of the selected two correction point datasets CP#q and CP#(q+1) by using the following expression.

$$CP\alpha_L^k=CP\alpha(\#q)+\{(CP\alpha(\#q+1)-CP\alpha(\#q)/2^N)\}\times APL_{AVE}[N-1:0], \tag{20}$$

where α, $CP\alpha_L^k$, CPα(#q), CPα(#q+1) and $APL_{AVE_k}$ [N−1:0] are defined as follows:

α: an integer from 0 to 5

$CP\alpha_L^k$: correction point data CPα of correction point dataset $CP_L^k$

CPα(#q): correction point data CPα of selected Correction point dataset CP#q

CPα(#q+1): correction point data CPα of selected Correction point dataset CP#(q+1)

$APL_{AVE}$ [N−1:0]: the lower N bits of $APL_{AVE}$

The relation among $APL_{AVE}$, γ and the correction point dataset $CP_L^k$ in the case that the correction point dataset $CP_L^k$ is determined in this way is as illustrated in FIG. 16. Also, the shapes of the gamma curves corresponding to the correction point datasets CP#q and CP#(q+1), respectively, and the shape of the gamma curve corresponding to the correction point dataset $CP_L^k$ are as illustrated in FIG. 17.

Referring back to FIG. 14B, after the correction point datasets $CP_L^R$, $CP_L^G$ and $CP_L^B$ are determined, the correction point datasets $CP_L^R$, $CP_L^G$ and $CP_L^B$ are modified on the basis of the variance $\sigma_{AVE}^2$ described in the variance data $D\sigma_2$ (Step S14B). The modified correction point datasets $CP_L^R$, $CP_L^G$ and $CP_L^B$ are finally fed to the approximate calculation correction circuit 15 as the correction point datasets $CP_sel^R$, $CP_sel^G$ and $CP_sel^B$ (Step S14B). It should be noted that, in the case that the combination of the APL calculated as the average value of the brightnesses of the pixels and the mean square value of the brightnesses of the pixels is used as the feature values exchanged between the driver ICs 6-1 and 6-2, the correction point datasets $CP_sel^R$, $CP_sel^G$ and $CP_sel^B$ are determined to be equal to one another.

In one embodiment, the correction point data CP1 and CP4 of the correction point dataset $CP_sel^k$ may be calculated by the following expressions:

$$CP1_sel^k=CP1_L^k-(D_{IN}^{MAX}-\sigma_{AVE}^2)\cdot\xi, \text{ and} \tag{12a}$$

$$CP4_sel^k=CP4_L^k+(D_{IN}^{MAX}-\sigma_{AVE}^2)\cdot\xi, \tag{13a}$$

where $D_{IN}^{MAX}$ is the allowed maximum value of the input image data $D_{IN1}$ and $D_{IN2}$, and ξ is a predetermined proportional constant. $CP1_sel^k$ and the $CP4_sel^k$ are the correction point data CP1 and CP4 of the correction point dataset $CP_sel^k$, respectively, and $CP1_L^k$ and $CP4_L^k$ are the correction point data CP1 and CP4 of the correction point dataset $CP_L^k$, respectively. The relation between the distribution (histogram) of the grayscale levels and the content of the correction calculation in the case that the correction point data CP1 and CP4 are modified in accordance with the above-described expressions is as illustrated in FIG. 19.

Referring back to FIG. 14B, the approximate calculation units 15R, 15G and 15B of the approximate calculation correction circuit 15 in the driver ICs 6-1 and 6-2 use the thus-calculated correction point datasets $CP_sel^R$, $CP_sel^G$ and $CP_sel^B$ to perform the correction calculation on the input image data $D_{INi}^R$, $D_{INi}^G$ and $D_{INi}^B$ to thereby generate the output image data $D_{OUT}^R$, $D_{OUT}^G$ and $D_{OUT}^B$, respectively (Step S15B). The calculation for generating the output image data $D_{OUT}^R$, $D_{OUT}^G$ and $D_{OUT}^B$ from the input image data $D_{INi}^R$, $D_{INi}^G$ and $D_{INi}^B$ through the correction calculation based on the correction point datasets $CP_sel^R$, $CP_sel^G$ and $CP_sel^B$ is identical to the case when the combination of the APL and the mean square value of the grayscale levels of the subpixels calculated for each color is used as the feature values exchanged between the driver ICs 6-1 and 6-2 (refer to the above-described expressions (14a) to (14c), (15), (16a), (16b), (17a), (17b) and (18)).

As thus discussed, the display device in this embodiment is configured so that each of the driver ICs 6-1 and 6-2 calculates the feature value(s) of the entire image displayed on the display region of the LCD panel 5 on the basis of the feature data exchanged between the driver ICs 6-1 and 6-2, and performs the correction calculation on the input image data $D_{IN1}$ and $D_{IN2}$ in response to the calculated feature values. Such operations allows performing the correction calculation on the basis of the feature value(s) of the entire image displayed on the display region of the LCD panel 5 calculated in each of the driver ICs 6-1 and 6-2. In other words, the correction calculation can be performed on the basis of the feature values of the entire image displayed on the display region of the LCD panel 5 without using any additional picture processing IC (refer to FIG. 2). This contributes to the cost reduction. On the other hand, it is unnecessary to transmit the image data corresponding to the entire image displayed on the display region of the LCD panel 5 to each of the driver ICs 6-1 and 6-2. That is, the input image data $D_{IN1}$ corresponding to the image displayed on the first portion 9-1 of the display region of the LCD panel 5 are transmitted to the driver IC 6-1, and the input image data $D_{IN2}$ corresponding to the image displayed on the second portion 9-2 of the display region of the LCD panel 5 are transmitted to the driver IC 6-2. This effectively decreases the necessary data transmission rate in the display device of this embodiment.

Furthermore, when the communications of the feature data between the driver ICs 6-1 and 6-2 have not been successfully completed, the feature value(s) described in the previous-frame full-screen feature data $D_{CHR_P}$ stored in the calculation result memory 23 are used to perform the correction calculation. Accordingly, no boundary is visually perceived between the first and second portions 9-1 and 9-2 of the display region of the LCD panel 5, even when the communications have not been successfully completed.

Figure 20:
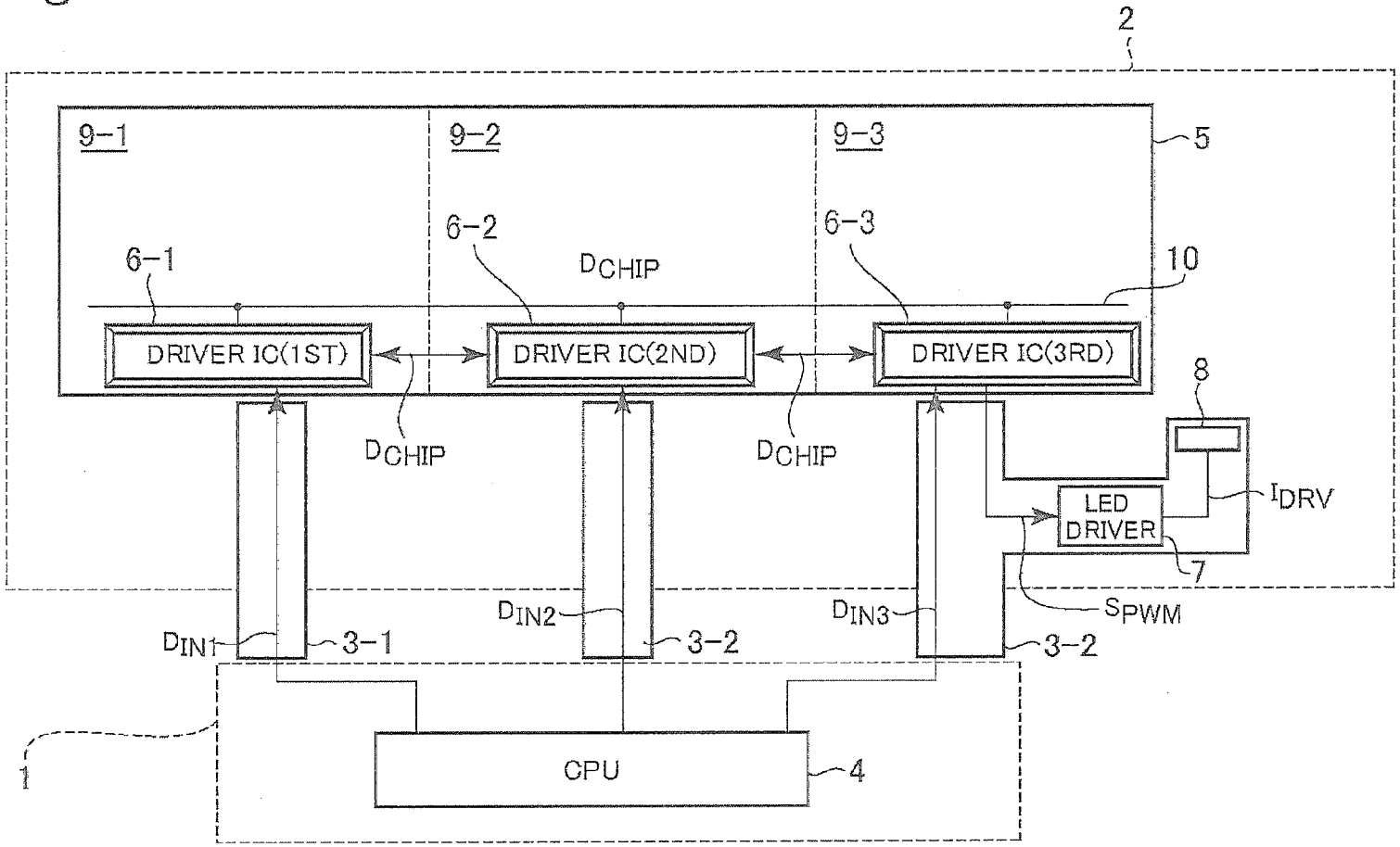
FIG. 20 is a block diagram illustrating an exemplary configuration of a liquid crystal display device in which pixels on the display region in the LCD panel are driven by three driver ICs in the first embodiment.

Although the configuration in which the pixels disposed in the display region of the LCD panel 5 are driven by two driver ICs **6-*i* and 6-2 is described in the above, three or more driver ICs may be used to drive the pixels disposed in the display region of the LCD panel 5. FIG. 20 is a block diagram illustrating an exemplary configuration in which the pixels disposed in the display region of the LCD panel 5 are driven by using three driver ICs 6-1 to 6-3**.

In the configuration in FIG. 20, a communication bus 10 is disposed on the LCD panel and the driver ICs 6-1 to 6-3 exchange the inter-chip communication data $D_{CHIP}$, that is, the feature data and the communication state notification data, via the communication bus 10. Each of the driver ICs 6-1 to 6-3 calculates the current-frame full-screen feature data from the feature data ($D_{CHR_i}$) generated by each of the driver ICs 6-1 to 6-3 and the feature data ($D_{CHR_IN}$) received from the other driver ICs.

When the APL and the mean square value of the grayscale levels which are calculated for each of the R, G and B subpixels are used as the feature values exchanged among the driver ICs 6-1 and 6-3, the average value of the APLs described in the feature data $D_{CHR_1}$ to $D_{CHR_3}$ are calculated as the APL of the entire image displayed on the display region of the LCD panel 5, and the average value of the mean square values of the grayscale levels of the subpixels described in the feature data $D_{CHR_1}$ to $D_{CHR_3}$ is calculated as the mean square value of the grayscale levels of the subpixels with respect to the entire image displayed on the display region of the LCD panel 5. Moreover, the variance of the grayscale levels of the subpixels is calculated from the APL and the mean square value of the grayscale levels of the subpixels with respect to the entire image displayed on the display region of the LCD panel 5. Then, the correction calculation is performed on the basis of the APL and the variance of the grayscale levels of the subpixel with respect to the entire image displayed on the display region of the LCD panel 5.

Also, when the APL calculated as the average value of the brightnesses of the pixels and the mean square value of the brightnesses of the pixels is used as the feature data exchanged among the driver ICs 6-1 and 6-3, the average value of the APLs described in the feature data $D_{CHR_1}$ to $D_{CHR_3}$ is calculated as the APL of the entire image displayed on the display region of the LCD panel 5, and the average value of the mean square values of the brightnesses of the pixels described in the feature data $D_{CHR_1}$ to $D_{CHR_3}$ is calculated as the mean square value of the brightnesses of the pixels with respect to the entire image displayed on the display region of the LCD panel 5. Furthermore, the variance of the brightnesses of the pixels is calculated from the APL and the mean square value of the brightnesses of the pixels with respect to the entire image displayed on the display region of the LCD panel 5, and the correction calculation is performed on the basis of the APL and the variance of the brightnesses of the pixels with respect to the entire image displayed on the display region of the LCD panel 5.

Furthermore, if all of the communication state notification data $D_{ST_OUT}$ generated by each of the driver ICs 6-1 to 6-3 and the communication state notification data $D_{ST_IN}$ received from the other driver ICs include communication ACK data, each of the driver ICs 6-1 to 6-3 selects the current-frame full-screen feature data $D_{CHR_C}$, and otherwise selects the previous-frame full-screen feature data $D_{CHR_P}$. Such operation allows the three or more driver ICs included in the display device to perform the same correction calculation, even if the communications have not been successfully completed.

(Second Embodiment)

Figure 21:
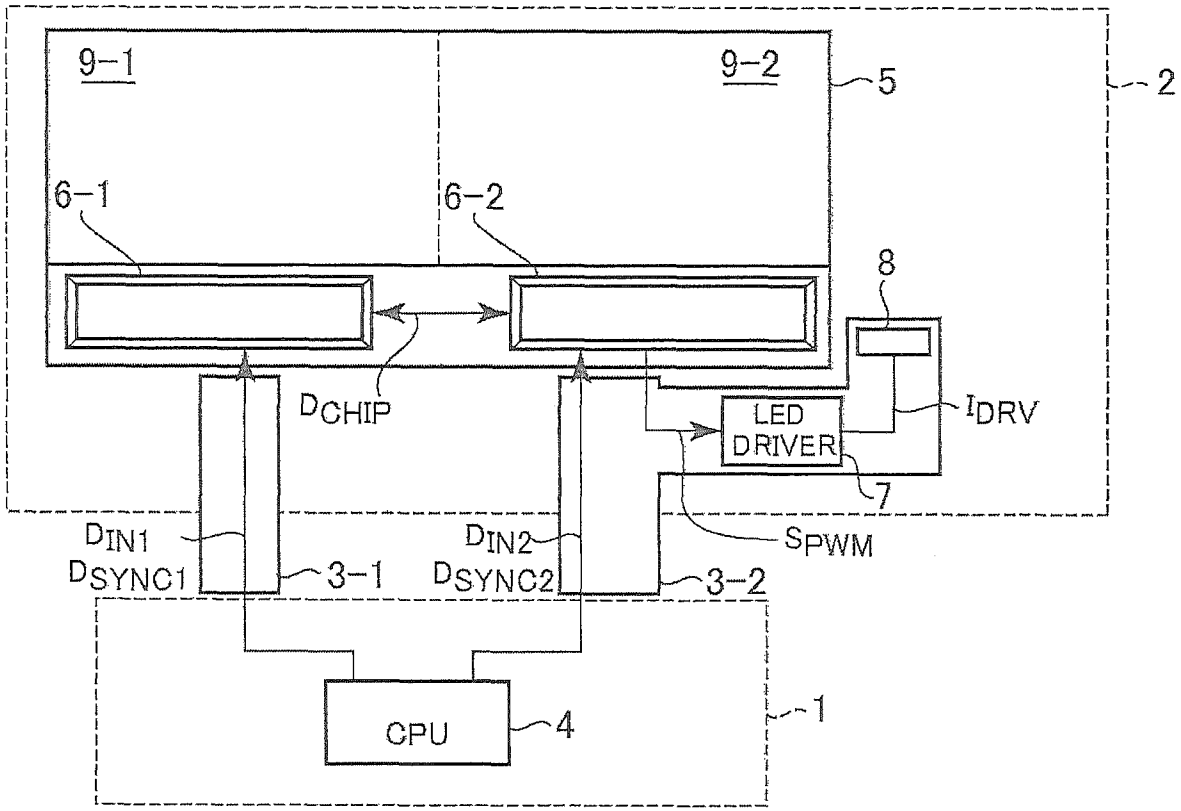
FIG. 21 is a block diagram illustrating an exemplary configuration of a liquid crystal display device in a second embodiment.

FIG. 21 is a block diagram illustrating an exemplary configuration of a liquid crystal display device in a second embodiment of the present invention. In the second embodiment, as is the case with the first embodiment, the LCD panel 5 is driven by two driver ICs 6-1 and 6-2. Although the configuration of the driver ICs 6-1 and 6-2 in the second embodiment is substantially the same as the first embodiment, the second embodiment differs from the first embodiment in the operation for unifying the correction calculations in the driver ICs 6-1 and 6-2 (namely, the operation for instructing the driver ICs 6-1 and 6-2 to perform the same correction calculation).

In the second embodiment, one of the driver ICs 6-1 and 6-2 is operated as a master driver, and the other is operated as a slave driver. Here, the master driver is a driver which controls the operation for unifying the correction calculations in the driver ICs 6-1 and 6-2. The slave driver is a driver which performs the correction calculation under the control of the master drive. In the following, a description is given of the case when the driver IC 6-1 operates as the slave driver, and the driver IC 6-2 operates as the master driver.

Figure 22:
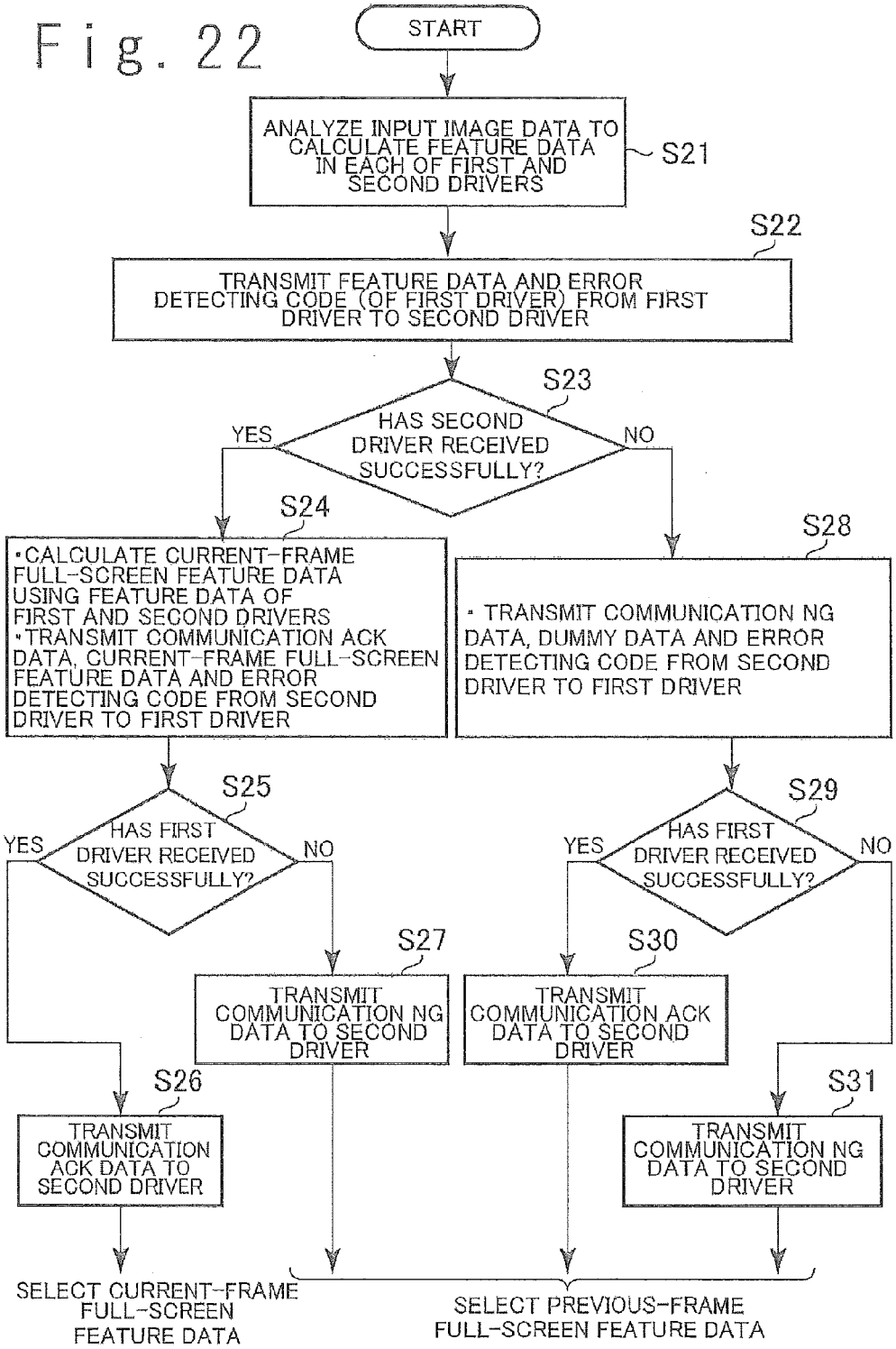
FIG. 22 is a diagram illustrating exemplary operations of the driver ICs in the second embodiment.
Figure 23:
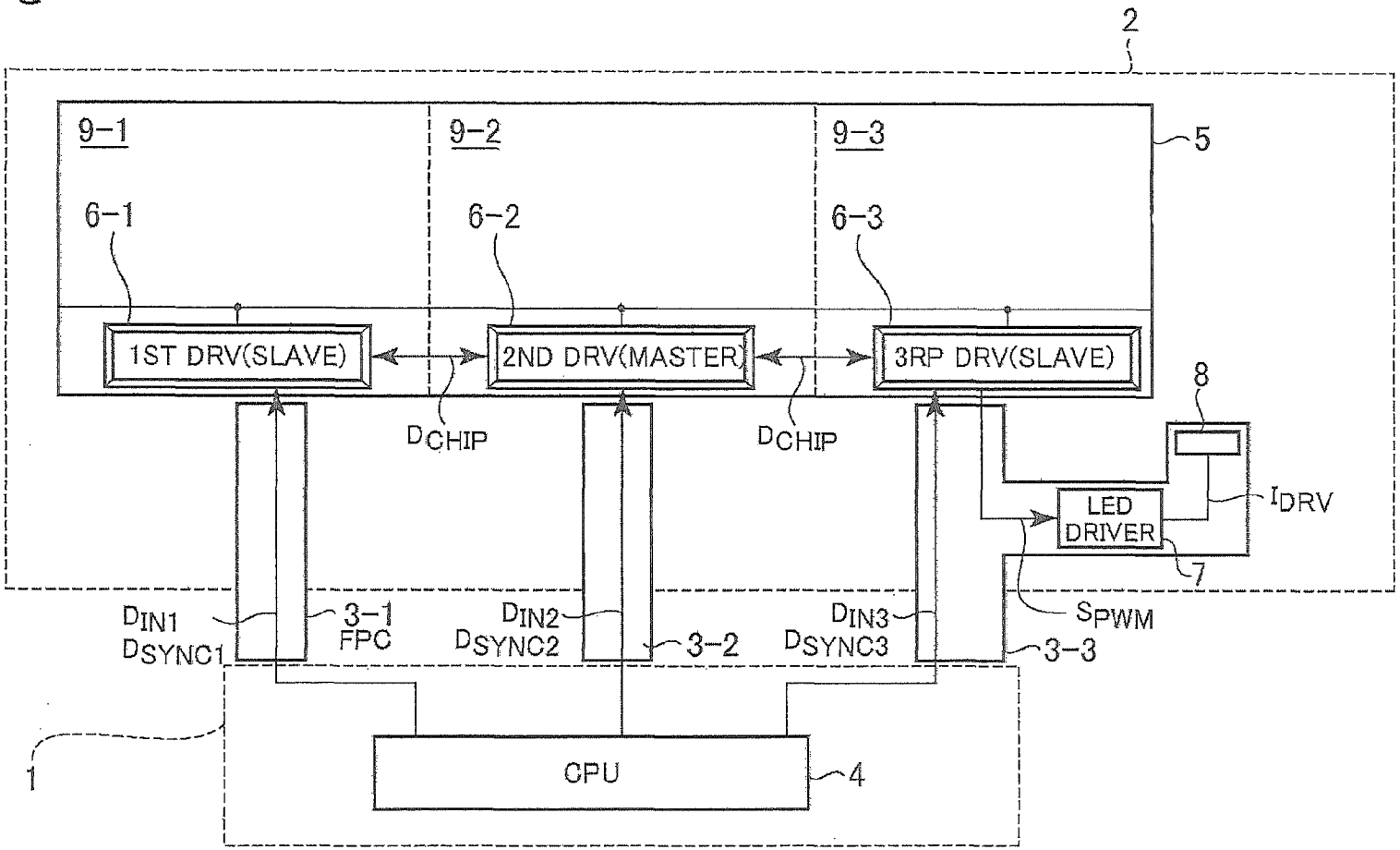
FIG. 23 is a view illustrating an exemplary configuration of a liquid crystal display device in which pixels on the display region in the LCD panel are driven by three driver ICs in the second embodiment.

FIG. 22 is a diagram illustrating exemplary operations of the driver ICs 6-1 and 6-2 in the second embodiment. First, the feature data operation circuitries 22 in the driver ICs 6-1 and 6-2 analyze the input image data $D_{INi}$ and $D_{IN2}$ to calculate the feature data $D_{CHR_1}$ and $D_{CHR_2}$, respectively (Step S21). As mentioned above, the feature data $D_{CHR_1}$, which indicate the feature value(s) of the partial image displayed on the first portion 9-1 of the LCD panel 5, are calculated from the input image data $D_{IN1}$ supplied to the driver IC 6-1. Similarly, the feature data $D_{CHR_2}$, which indicate the feature value(s) of the partial image displayed on the second portion 9-2 of the LCD panel 5, are calculated from the input image data $D_{IN2}$ supplied to the driver IC 6-2. In this embodiment, as is the case with the first embodiment, the APL and the mean square value of the grayscale levels of the subpixels calculated for each of the R, G, and B subpixels may be used as the feature values calculated in each of the driver ICs 6-1 and 6-2. Alternatively, the APL calculated as the average value of the brightnesses of the pixels and the mean square value of the brightnesses of the pixels may be used as the feature values calculated in each of the driver ICs 6-1 and 6-2.

Subsequently, the feature data $D_{CHR_1}$ calculated in the driver IC 6-1, which operate as the slave drive, are transmitted from the driver IC 6-1 to the driver IC 6-2, which operates as the master driver (Step S22). In detail, the driver IC 6-1 transmits the output feature data $D_{CHR_OUT}$ generated by adding an error detecting code to the feature data $D_{CHR_1}$ calculated by the feature data calculation circuit 31, to the driver IC 6-2. The addition of the error detecting code is carried out by the error detecting code addition circuit 32. The driver IC 6-2 receives the output feature data $D_{CHR_OUT}$, which are transmitted from the driver IC 6-1, as the input feature data $D_{CHR_IN}$.

The inter-chip communication detection circuit 33 in the driver IC 6-2, which operates as the master driver, judges whether the input feature data $D_{CHR_IN}$ have been successfully received from the driver IC 6-1, by using the error detecting code added to the input feature data $D_{CHR_IN}$ (Step S23). In detail, if detecting no data error in the input feature data $D_{CHR_IN}$ (or if detecting no uncorrectable data error in the case when an error correctable code is used), the inter-chip communication detection circuit 33 in the driver IC 6-2 judges that the input feature data $D_{CHR_IN}$ have been successfully received and outputs communication ACK data as the communication state notification data $D_{ST_OUT}$. If detecting a data error (or if detecting a data error for which error correction is impossible, in the case when an error correctable code is used), on the other hand, the inter-chip communication detection circuit 33 in the driver IC 6-2 outputs communication NG data as the communication state notification data $D_{ST_OUT}$.

If the driver IC 6-2, which operates as the master driver, judges that the input feature data $D_{CHR_IN}$ have been successfully received from the driver IC 6-1 at step S23, the below-described operations are carried out at steps S24 to S27:

At step S24, the full-screen feature data operation circuit 34 in the driver IC 6-2, which operates as the master driver, first calculates the current-frame full-screen feature data from the input feature data $D_{CHR_IN}$ received from the driver IC 6-1 (namely, the feature data $D_{CHR_1}$) and the feature data $D_{CHR_2}$ calculated by the driver IC 6-2 itself. The calculation method of the current-frame full-screen feature data in the second embodiment is the same as that in the first embodiment. When the APL and the mean square value of the grayscale levels calculated for each color are used as the feature values, for example, the average value of the APLs described in the feature data $D_{CHR_1}$ and $D_{CHR_2}$ is calculated as the APL of the entire image displayed on the display region of the LCD panel 5, and the average value of the mean square values described in the feature data $D_{CHR_1}$ and $D_{CHR_2}$ is calculated as the mean square value of the grayscale levels of the subpixels for the entire image displayed on the display region of the LCD panel 5. Furthermore, the variance of the grayscale levels of the subpixels is calculated on the basis of the APL and the mean square value of the grayscale levels of the subpixels calculated for each color with respect to the entire image displayed on the display region of the LCD panel 5. The correction calculation for each color is carried out on the basis of the APL and the variance of the grayscale levels of the subpixels with respect to the entire image displayed on the display region of the LCD panel 5. When the APL calculated as the average value of the brightnesses of the pixels and the mean square value of the brightnesses of the pixels are used as the feature values, on the other hand, the average value of the APLs described in the feature data $D_{CHR_1}$ and $D_{CHR_2}$ is calculated as the APL of the entire image displayed on the display region of the LCD panel 5, and the average value of the mean square values of the brightnesses described in the feature data $D_{CHR_1}$ and $D_{CHR_2}$ is calculated as the mean square value of the brightnesses of the pixels for the entire image displayed on the display region of the LCD panel 5. Moreover, the variance of the brightnesses of the pixels is calculated on the basis of the APL and the mean square value of the brightnesses of the pixels, which are calculated for the entire image displayed on the display region of the LCD panel 5. The correction calculation is carried out on the basis of the APL and the variance of the brightnesses of the pixels with respect to the entire image displayed on the display region of the LCD panel 5.

Furthermore, the driver IC 6-2, which operates as the master driver, generates the output feature data $D_{CHR_OUT}$ by adding an error detecting code to the current-frame full-screen feature data at step S24 and transmits the generated output feature data $D_{CHR_OUT}$ and the communication state notification data $D_{ST_OUT}$ which include communication ACK data, to the driver IC 6-1, which operates as the slave driver. In this case, the driver IC 6-1 receives the data in which the error detecting code is added to the current-frame full-screen feature data, as the input feature data $D_{CHR_IN}$ and receives the communication state notification data $D_{ST_OUT}$, which include the communication ACK data, as the communication state notification data $D_{ST_IN}$.

Subsequently, the inter-chip communication detection circuit 33 in the driver IC 6-1, which operates as the slave driver judges whether the input feature data $D_{CHR_IN}$ (namely, the current-frame full-screen feature data) have been successfully received from the driver IC 6-2 by using the error detecting code added to the input feature data $D_{CHR_IN}$ (step S25). In detail, if detecting no data error in the input feature data $D_{CHR_IN}$, namely, the current-frame full-screen feature data to which the error detecting code is added (or if detecting no uncorrectable data error in the case when an error correctable code is used), the inter-chip communication detection circuit 33 in the driver IC 6-1 judges that the input feature data $D_{CHR_IN}$ have been successfully received and outputs communication ACK data as the communication state notification data $D_{ST_OUT}$. The communication state notification data $D_{ST_OUT}$ which include the communication ACK data are transmitted from the driver IC 6-1 to the driver IC 6-2. That is, communication ACK data are transmitted from the driver IC 6-1 to the driver IC 6-2 (step S26).

If detecting a data error at step S25 (or if detecting a data error for which error correction is impossible in the case when the error correction code is used), on the other hand, the inter-chip communication detection circuit 33 in the driver IC 6-1 outputs communication NG data as the communication state notification data $D_{ST_OUT}$. The communication state notification data $D_{ST_OUT}$ which include the communication NG data are transmitted from the driver IC 6-1 to the driver IC 6-2. That is, communication NG data are transmitted from the driver IC 6-1 to the driver IC 6-2 (step S27).

Furthermore, if the driver IC 6-2, which operates as the master driver, judges at step S23 that the input feature data $D_{CHR_IN}$ have been successfully received from the driver IC 6-1, the below-described operations are carried out at steps S28 to S31.

At step S28, the driver IC 6-2, which operates as the master driver, generates the output feature data $D_{CHR_OUT}$ by adding an error detecting code to dummy data which have the same format as the current-frame full-screen feature data and transmits the generated output feature data $D_{CHR_OUT}$ and the communication state notification data $D_{ST_OUT}$ which include the communication NG data, to the driver IC 6-1, which operate as the slave driver. In this case, the driver IC 6-1 receives the data in which the error detecting code is added to the dummy data as the input feature data $D_{CHR_IN}$, and receives the communication state notification data $D_{ST_OUT}$ which include the communication NG data as the communication state notification data $D_{ST_IN}$.

Subsequently, the inter-chip communication detection circuit 33 in the driver IC 6-1, which operates as the slave driver judges whether the input feature data $D_{CHR_IN}$ (namely, the dummy data) have been successfully received from the driver IC 6-2 by using the error detecting code added to the input feature data $D_{CHR_IN}$ (step S29). In detail, if detecting no data error in the input feature data $D_{CHR_IN}$ namely, the dummy data to which the error detecting code is added (or if detecting no uncorrectable data error in the case when an error correctable code is used), the inter-chip communication detection circuit 33 in the driver IC 6-1 judges that the input feature data $D_{CHR_IN}$ have been successfully received, and outputs communication ACK data as the communication state notification data $D_{ST_OUT}$. The communication state notification data $D_{ST_OUT}$ which include the communication ACK data are transmitted from the driver IC 6-1 to the driver IC 6-2. That is, the communication ACK data are transmitted from the driver IC 6-1 to the driver IC 6-2 (Step S30).

If detecting a data error at step S29 (or if detecting a data error for which error correction is impossible in the case when an error correctable code is used), on the other hand, the inter-chip communication detection circuit 33 in the driver IC 6-1 outputs communication NG data as the communication state notification data $D_{ST_OUT}$. The communication state notification data $D_{ST_OUT}$ which include the communication NG data are transmitted from the driver IC 6-1 to the driver IC 6-2. That is, the communication NG data are transmitted from the driver IC 6-1 to the driver IC 6-2 (Step S31).

Each of the driver ICs 6-1 and 6-2 selects which of the current-frame full-screen feature data or the previous-frame full-screen feature data are to be used to perform the correction calculation (namely, which of the current-frame full-screen feature data and the previous-frame full-screen feature data are to be used to generate the correction point dataset $CP_sel^k$), on the basis of the communication state notification data $D_{ST_OUT}$ generated by the inter-chip communication detection circuit 33 in each of the driver ICs 6-1 and 6-2 and the communication state notification data $D_{ST_IN}$ received from the other driver IC. Each of the driver ICs 6-1 and 6-2 selects the current-frame full-screen feature data, if both of the communication state notification data $D_{ST_OUT}$ generated by the inter-chip communication detection circuit 33 in each of the driver ICs 6-1 and 6-2 and the communication state notification data $D_{ST_IN}$ received from the exterior include the communication ACK data. Here, the driver IC 6-2 selects the current-frame full-screen feature data calculated by the full-screen feature data operation circuit 34 included in the driver IC 6-2, and the driver IC 6-1 selects the current-frame full-screen feature data transmitted from the driver IC 6-2. If the current-frame full-screen feature data are selected, the contents of the calculation result memory 23 are updated to the current-frame full-screen feature data in each of the driver ICs 6-1 and 6-2.

If at least one of the communication state notification data $D_{ST_OUT}$ and $D_{ST_IN}$ includes the communication NG data, each of the driver ICs 6-1 and 6-2 selects the previous-frame full-screen feature data stored in the calculation result memory 23. The driver IC 6-1, which operates as the slave driver, receives the dummy data without receiving the current-frame full-screen feature data if the driver IC 6-1 receives the communication NG data from the driver IC 6-2, which operates as the master driver (namely, if having not successfully received the feature data $D_{CHR_1}$); however, the previous-frame full-screen feature data is selected in this case and therefore the reception of the dummy data causes no influence on the operation.

Also in the display device of this embodiment, the correction calculation is performed on the input image data $D_{IN1}$ and $D_{IN2}$ on the basis of the feature value(s) calculated for the entire image displayed on the display region of the LCD panel 5 in each of the driver ICs 6-1 and 6-2. Such operation allows performing the correction calculation on the basis of the feature value(s) of the entire image displayed on the display region of the LCD panel 5 calculated in each of the driver ICs 6-1 and 6-2. It is unnecessary, on the other hand to transmit the image data corresponding to the entire image displayed on the display region of the LCD panel 5 to each of the driver ICs 6-1 and 6-2. That is, the input image data $D_{IN1}$ corresponding to the partial image displayed on the first portion 9-1 of the display region of the LCD panel 5 are transmitted to the driver IC 6-1 and the input image data $D_{IN2}$ corresponding to the partial image displayed on the second portion 9-2 of the display region of the LCD panel 5 are transmitted to the driver IC 6-2. This effectively decreases the necessary data transmission rate in the display device of this embodiment.

Furthermore, if the communications of the feature data (or the current-frame full-screen feature data) between the driver ICs 6-1 and 6-2 have not been successfully completed, the feature value(s) indicated in the previous-frame full-screen feature data $D_{CHR_P}$ stored in the calculation result memory 23 is used to perform the correction calculation. Accordingly, no boundary is visually perceived between the first and second portions 9-1 and 9-2 of the display region of the LCD panel 5 even if the communications have not been successfully completed.

It should be noted that, although the configuration in which the liquid crystal display device includes two driver ICs 6-1 and 6-2 is described above in the second embodiment, the display device may include three or more driver ICs; in this case, two or more slave drivers (namely, two or more driver ICs which carry out the same operation as the operation of the driver IC 6-1 described above) are incorporated in the liquid crystal display device. In this case, the master driver receives the feature data and the communication state notification data from all of the slave drivers and transmits the current-frame full-screen feature data and the communication state notification data to all of the slave drivers. Each of the driver ICs (the master driver and the slave drivers) selects the current-frame full-screen feature data if all of the communication state notification data generated by the each driver IC and the communication state notification data received from the other driver ICs include communication ACK data, and otherwise, selects the previous-frame full-screen feature data. Such an operation allows performing the same correction calculation in all of the driver ICs in the display device that includes three or more driver ICs, even if the communications have not been successfully completed.

Although various embodiments of the present invention are specifically described in the above, the present invention should not be construed to be limited to the above-mentioned embodiments; it would be apparent to the person skilled in the art that the present invention may be implemented with various modifications. It should be noted, in particular, that, although the present invention is applied to the liquid crystal display device in the above-described embodiments, the present invention is generally applicable to display devices that include a plurality of display panel drivers adapted to correction calculations.

What is claimed is:

1. A display device, comprising:

a display panel;

a plurality of drivers driving said display panel; and a processor, wherein said plurality of drivers include:

a first driver driving a first portion of a display region of said display panel; and a second driver driving a second portion of said display region, wherein said processor supplies first input image data associated with a first image displayed on said first portion of said display region and supplies second input image data associated with a second image displayed on said second portion of said display region, wherein said first driver is configured to calculate first feature data indicating a feature value of said first image from said first input image data, wherein said second driver is configured to calculate second feature data indicating a feature value of said second image from said second input image data, wherein said first driver is configured to calculate first full-screen feature data indicating a feature value of an entire image displayed on said display region of said display panel, based on said first and second feature data, to generate first output image data by performing a correction calculation on said first input image data in response to said first full-screen feature data, and to drive said first portion of said display region in response to said first output image data, and wherein said second driver is configured to generate second output image data by performing the same correction calculation as that performed in said first driver on said second input image data and to drive said second portion of said display region in response to said second output image data.

2. The display device according to claim 1, wherein said first driver transmits said first feature data to said second driver, wherein said second driver is configured to calculate second full-screen feature data indicating the feature value of the entire image displayed on said display region of said display panel, based on said first feature data received from said first driver and second feature data, and to generate second output image data by performing said correction calculation on said second input image data in response to said second full-screen feature data.

3. The display device according to claim 2, wherein said first driver transmits said first feature data with an error detecting code to said second driver, wherein said second driver transmits said second feature data with an error detecting code to said first driver, wherein said first driver performs an error detection on said second feature data received from said second driver to generate first communication state notification data, wherein said second driver performs an error detection on said first feature data received from said first driver to generate second communication state notification data, and transmits said second communication state notification data to said first driver, wherein said first communication state notification data include communication ACK data in a case when said first driver has successfully received said second feature data from said second driver, and include communication NG data in a case when said first driver has not successfully received said second feature data, wherein said second communication state notification data include communication ACK data in a case when said second driver has successfully received said first feature data from said first driver, and include communication NG data in a case when said second driver has not successfully received said first feature data, wherein said first driver includes a first calculation result memory storing first previous-frame full-screen feature data generated with respect to a previous-frame period which is a frame period before a current frame period, wherein, when both of said first and second communication state notification data include the communication ACK data, said first driver generates said first output image data by performing the correction calculation on said first input image data in response to first current-frame full-screen feature data which are said first full-screen feature data generated with respect to said current frame, and updates said first previous-frame full-screen feature data stored in said first calculation result memory to said first current-frame full-screen feature data, wherein, when at least one of said first and second communication state notification data includes the communication NG data, said first driver generates said first output image data by performing the correction calculation on said first input image data in response to said first previous-frame full-screen feature data stored in said first calculation result memory.

4. The display device according to claim 3, wherein said first driver transmits said first communication state notification data to said second driver, wherein said second driver includes a second calculation result memory storing second previous-frame full-screen feature data generated with respect to said previous-frame period, wherein, when both of said first and second communication state notification data include the communication ACK data, said second driver generates said second output image data by performing the correction calculation on said second input image data in response to second current-frame full-screen feature data which are said second full-screen feature data generated with respect to said current frame, and updates said second previous-frame full-screen feature data stored in said second calculation result memory to said second current-frame full-screen feature data, and wherein, when at least one of said first and second communication state notification data includes the communication NG data, said second driver generates said second output image data by performing the correction calculation on said second input image data in response to said second previous-frame full-screen feature data stored in said second calculation result memory.

5. The display device according to claim 1, wherein said first feature data include a first average picture level which is an average picture level calculated with respect to said first image, wherein said second feature data include a second average picture level which is an average picture level calculated with respect to said second image, wherein said first full-screen feature data include a full-screen average picture level which is an average picture level calculated with respect to the entire image displayed on said display region of said display panel, and wherein said full-screen average picture level is calculated based on said first and second average picture levels.

6. The display device according to claim 1, wherein said first feature data include:

a first average picture level which is an average picture level calculated with respect to said first image; and a first mean square which is a mean square of brightnesses of pixels calculated with respect to said first image, wherein said second feature data include:

a second average picture level which is an average picture level calculated with respect to said second image; and a second mean square which is a mean square of brightnesses of pixels calculated with respect to said second image, and wherein said first full-screen feature data are obtained from said first average picture level, said first mean square, said second average picture level and said second mean square.

7. The display device according to claim 6, wherein said first full-screen feature data include:

data indicating a full-screen average picture level which is an average picture level calculated with respect to an entire image displayed on said display region of said display panel; and full-screen variance data indicating a variance of brightnesses of pixels calculated with respect to the entire image displayed on said display region of said display panel, wherein said full-screen average picture level is calculated based on said first and second average picture levels, and wherein said full-screen variance data are calculated based on said first average picture level, said first mean square, said second average picture level and said second mean square.

8. The display device according to claim 5, further comprising:

a backlight illuminating said display panel, wherein a brightness of said backlight is controlled in response to said full-screen average picture level.

9. The display device according to claim 1, wherein said first driver transmits said first full-screen feature data to said second driver, and wherein said second driver is configured to generate said second output image data by performing said correction calculation on said second input image data in response to said first full-screen feature data received from said first driver.

10. The display device according to claim 9, wherein said second driver transmits said second feature data with an error detection code, wherein said first driver performs an error detection on said second feature data received from said second driver to generate first communication state notification data, wherein said first communication state notification data include communication ACK data in a case when said first driver has successfully received said second feature data from said second driver, and include communication NG data in a case when said first driver has not successfully received said second feature data, wherein, when said first communication state notification data include the communication ACK data, said first driver transmits to said second driver said first full-screen feature data with an error detection code, wherein said second driver performs an error detection on said first feature data received from said first driver to generate second communication state notification data, and transmits said second communication state notification data to said first driver, wherein said second communication state notification data include communication ACK data in a case when said second driver has successfully received said first full-screen feature data from said first driver, and include communication NG data in a case when said second driver has not successfully received said first full-screen feature data, wherein said first driver includes a first calculation result memory storing first previous-frame full-screen feature data generated with respect to a previous-frame period which is a frame period before a current frame period, wherein, when both of said first and second communication state notification data include the communication ACK data, said first driver generates said first output image data by performing the correction calculation on said first input image data in response to current-frame full-screen feature data which are said first full-screen feature data generated with respect to said current frame, and updates said first previous-frame full-screen feature data stored in said first calculation result memory to said current-frame full-screen feature data, wherein, when at least one of said first and second communication state notification data includes the communication NG data, said first driver generates said first output image data by performing the correction calculation on said first input image data in response to said first previous-frame full-screen feature data stored in said first calculation result memory.

11. The display device according to claim 10, wherein said first driver transmits said first communication state notification data to said second driver, wherein said second driver includes a second calculation result memory storing second previous-frame full-screen feature data generated with respect to said previous-frame period, wherein, when both of said first and second communication state notification data include the communication ACK data, said second driver generates said second output image data by performing the correction calculation on said second input image data in response to said current-frame full-screen feature data, and updates said second previous-frame full-screen feature data stored in said second calculation result memory to said current-frame full-screen feature data, and wherein, when at least one of said first and second communication state notification data includes the communication NG data, said second driver generates said second output image data by performing the correction calculation on said second input image data in response to said second previous-frame full-screen feature data stored in said second calculation result memory.

12. A display panel driver for driving a first portion of a display region of a display panel, comprising:

a feature data calculation circuit receiving input image data associated with a first image displayed on said first portion of said display region and calculating first feature data indicating a feature value of said first image from said input image data;

a communication circuit receiving from another driver second feature data indicating a feature value of a second image displayed on a second portion of said display region driven by said other driver;

a full-screen feature data operation circuit calculating full-screen feature data indicating a feature value of an entire image displayed on said display region of said display panel, based on said first and second feature data;

a correction circuit generating output image data by performing a correction calculation on said input image data in response to said full-screen feature data; and a drive circuitry driving said first portion of said display region in response to said output image data.

13. The display panel driver according to claim 12, further comprising:

a detection circuit performing an error detection on said second feature data received from said other driver to generate first communication state notification data; and a calculation result memory storing a previous-frame full-screen feature data generated with respect to a previous frame period which is a frame period before a current frame period, wherein said communication circuit receives from said other driver second communication state notification data generated by said other driver performing an error detection on said first feature data received from said display panel driver, wherein said first communication state notification data include communication ACK data in a case when said communication circuit has successfully received said second feature data from said other driver and include communication NG data in a case when said communication circuit has not successfully received said second feature data, wherein said second communication state notification data include communication ACK data in a case when said other driver has successfully received said first feature data from said display panel driver and include communication NG data in a case when said other driver has not successfully received said first feature data, wherein, when both of said first and second communication state notification data include the communication ACK data, said output image data are generated by performing the correction calculation on said input image data in response to current-frame full-screen feature data which are said full-screen feature data generated with respect to said current frame period, and said previous-frame full-screen characterization stored in said calculation result memory are updated to said current-frame full-screen feature data, and wherein, when at least one of said first and second communication state notification data includes the communication NG data, said output image data are generated by performing the correction calculation on said input image data in response to said previous-frame full-screen characterization stored in said calculation result memory.

14. An operation method of a display device including a display panel and a plurality of drivers driving said display panel, said plurality of drivers comprising a first driver driving a first portion of a display region of said display panel and a second driver driving a second portion of said display region, said method comprising:

supplying first input image data associated with a first image displayed on said first portion of said display region to said first driver;

supplying second input image data associated with a second image displayed on said second portion of said display region to said second driver;

calculating first feature data indicating a feature value of said first image from said first input image data in said first driver;

calculating second feature data indicating a feature value of said second image from said second input image data in said second driver;

transmitting said second feature data from said second driver to said first driver;

calculating first full-screen feature data indicating a feature value of an entire image displayed on said display region of said display panel, based on said first and second feature data in said first driver;

generating first output image data by performing a correction calculation on said first input image data, based on first full-screen feature data in said first driver;

driving said first portion of said display region in response to said first output image data;

generating second output image data by performing the same correction calculation as that performed in said first driver on said second input image data in said second driver; and driving said second portion of said display region in response to said second output image data.

15. The operation method according to claim 14, further comprising:

transmitting said first feature data from said first driver to said second driver, wherein, in generating said second output image data in said second driver, second full-screen feature data indicating the feature value of the entire image displayed on said display region of said display panel are calculated based on said first and second feature data in said second driver, and said second output image data are generated by performing said correction calculation on said second input image data in response to said second full-screen feature data.

16. The operation method according to claim 14, further comprising generating a brightness control signal to control a backlight brightness of said display panel, using said feature value of said entire image displayed on said display region of said display panel.

17. The operation method according to claim 15, further comprising generating a brightness control signal to control a backlight brightness of said display panel, using said feature value of said entire image displayed on said display region of said display panel from only one of said first driver and said second driver.

18. The operation method according to claim 14, wherein said feature data comprises one of:

an APL value, an average of grayscale values of subpixels of said image as calculated for each color;

a histogram of grayscale levels of subpixels of said image as calculated for each color; and a combination of said APL value and a variance of grayscale levels of subpixels as calculated for each color.

19. The operation method according to claim 14, wherein said feature data is calculated on a basis of brightness.

20. The operation method according to claim 19, wherein said first and second input image data are provided in RGB (red/green/blue) format, said operation method further comprising transforming said RGB-format data into a brightness format YUV.

* * * * *